US009361757B2

(12) United States Patent
Fujisawa et al.

(10) Patent No.: US 9,361,757 B2
(45) Date of Patent: Jun. 7, 2016

(54) GAMING MACHINE WITH BET-AMOUNT-DEPENDENT QUALIFICATION TIME FOR SUBSEQUENT GAMES AND GAME CONTROL METHOD THEREOF

(75) Inventors: Masumi Fujisawa, Tokyo (JP); Takehisa Itagaki, Tokyo (JP); Kensaku Yoshikawa, Tokyo (JP); Daisyun Okamoto, Tokyo (JP); Hiroki Munakata, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 408 days.

(21) Appl. No.: 13/569,977

(22) Filed: Aug. 8, 2012

(65) Prior Publication Data

US 2013/0040719 A1 Feb. 14, 2013

(30) Foreign Application Priority Data

Aug. 9, 2011 (JP) ..... 2011-174420

(51) Int. Cl.
*G07F 17/32* (2006.01)
*G07F 17/34* (2006.01)

(52) U.S. Cl.
CPC ..... *G07F 17/3267* (2013.01); *G07F 17/3211* (2013.01); *G07F 17/3272* (2013.01); *G07F 17/34* (2013.01)

(58) Field of Classification Search
CPC .. G07F 17/3267; G07F 17/3272; G07F 17/34
See application file for complete search history.

(56) References Cited

U.S. PATENT DOCUMENTS

| | | | | |
|---|---|---|---|---|
| 7,690,998 | B2 * | 4/2010 | Okada | 463/43 |
| 7,931,530 | B2 * | 4/2011 | Anderson et al. | 463/20 |
| 8,323,098 | B2 * | 12/2012 | Okada | 463/25 |
| 2006/0009283 | A1 | 1/2006 | Englman et al. | |
| 2011/0118010 | A1 * | 5/2011 | Brune | 463/43 |
| 2011/0230251 | A1 * | 9/2011 | Nicely et al. | 463/20 |
| 2012/0115614 | A1 * | 5/2012 | Munakata et al. | 463/42 |
| 2014/0087815 | A1 * | 3/2014 | Caputo et al. | 463/18 |

OTHER PUBLICATIONS

Office Action dated Aug. 20, 2015 issued in connection with corresponding Australian Application No. 2012211450.

* cited by examiner

*Primary Examiner* — Milap Shah
*Assistant Examiner* — Robert T Clarke, Jr.
(74) *Attorney, Agent, or Firm* — KMF Patent Services, PLLC; Kenneth M. Fagin, Esq.; S. Peter Konzel, Esq.

(57) ABSTRACT

Game qualification time may be set to allow participation in a common game from a basic game. This game qualification time is awarded in accordance with a bet amount stored in a RAM 243, after receiving a bet which is input by means of a 1-bet button 26 and a maximum bet button 27. A winning probability in a quick catch bonus game that occurs when a game result of the basic game is a predetermined game result is increased in accordance with the length of the game qualification time stored in a game qualification time management table in the RAM 243 (i.e., a basic quick catch bonus payout table is replaced with a special quick catch bonus payout table).

5 Claims, 62 Drawing Sheets

SPECIAL QUICK CATCH BONUS PAYOUT TABLE

| | THE NUMBER OF PAYLINES ACTIVATED | | | | |
|---|---|---|---|---|---|
| TYPE OF THE BENEFIT | 1 | 2 | 3 | 5 | 10 |
| AWARD GAME QUALIFICATION TIME CORRESPONDING TO ONE BET | 471 | 160 | 160 | 160 | 160 |
| AWARD GAME QUALIFICATION TIME CORRESPONDING TO TWO BETS | 80 | 391 | 80 | 80 | 80 |
| AWARD GAME QUALIFICATION TIME CORRESPONDING TO THREE BETS | 0 | 0 | 311 | 0 | 0 |
| AWARD GAME QUALIFICATION TIME CORRESPONDING TO FIVE BETS | 0 | 0 | 0 | 311 | 0 |
| AWARD GAME QUALIFICATION TIME CORRESPONDING TO TEN BETS | 0 | 0 | 0 | 0 | 311 |
| BLANK | 17487 | 17487 | 17487 | 17487 | 17487 |
| TOTAL | 18038 | 18038 | 18038 | 18038 | 18038 |

RANGE OF RANDOM NUMBERS: 1–18038

FIG.9

LEVER POSITION DETERMINING TABLE

| LEVER POSITIONS | DETECTED MAGNETIC FORCES |
|---|---|
| STARTING POINT | ND78 |
| FIRST POSITION | ND84 |
| SECOND POSITION | ND90 |
| THIRD POSITION | ND96 |
| FOURTH POSITION | ND102 |
| ... | ... |
| ENDING POINT | ND126 |

FIG.13

BASE GAME SYMBOL TABLE

| | | FIRST COLUMN | SECOND COLUMN | THIRD COLUMN | FOURTH COLUMN | FIFTH COLUMN |
|---|---|---|---|---|---|---|
| CODE NUMBERS | RANDOM NUMBERS | SYMBOLS | SYMBOLS | SYMBOLS | SYMBOLS | SYMBOLS |
| 0 | 0-3277 | J | SPECIFIC SYMBOL | A | Q | J |
| 1 | 3278-6555 | Q | A | J | J | A |
| 2 | 6556-9833 | ANGELFISH | Q | ANGELFISH | ANGELFISH | ANGELFISH |
| 3 | 9834-13111 | J | CLOWNFISH | TUNA | Q | J |
| 4 | 13112-16389 | Q | TUNA | COELACANTH | K | A |
| 5 | 16390-19667 | COELACANTH | SPECIFIC SYMBOL | ANGELFISH | ANGELFISH | ANGELFISH |
| 6 | 19668-22945 | A | ANGELFISH | SPECIFIC SYMBOL | A | COELACANTH |
| 7 | 22946-26223 | CLOWNFISH | CLOWNFISH | A | K | SPECIFIC SYMBOL |
| 8 | 26224-29501 | TUNA | K | J | CLOWNFISH | K |
| 9 | 29502-32779 | CLOWNFISH | COELACANTH | CLOWNFISH | Q | CLOWNFISH |
| 10 | 32780-36057 | A | SPECIFIC SYMBOL | A | CLOWNFISH | Q |
| 11 | 36058-39335 | Q | A | Q | TUNA | ANGELFISH |
| 12 | 39336-42613 | TUNA | CLOWNFISH | CLOWNFISH | SPECIFIC SYMBOL | K |
| 13 | 42614-45891 | COELACANTH | CLOWNFISH | K | K | CLOWNFISH |
| 14 | 45892-49169 | K | J | ANGELFISH | TUNA | TUNA |
| 15 | 49170-52447 | A | TUNA | Q | CLOWNFISH | J |
| 16 | 52448-55725 | CLOWNFISH | TUNA | SPECIFIC SYMBOL | A | SPECIFIC SYMBOL |
| 17 | 55726-59003 | J | ANGELFISH | A | CLOWNFISH | CLOWNFISH |
| 18 | 59004-62281 | Q | SPECIFIC SYMBOL | CLOWNFISH | ANGELFISH | TUNA |
| 19 | 62282-65535 | ANGELFISH | SPECIFIC SYMBOL | TUNA | COELACANTH | Q |

RANGE OF RANDOM NUMBERS : 0-65535

FIG.14

BASE GAME QUALIFICATION TIME AWARDING TABLE

| | NUMBER OF ACTIVATED PAYLINES | | | | |
|---|---|---|---|---|---|
| PAYOUT RATES | 1 | 2 | 3 | 5 | 10 |
| 1 | 5 | 0 | 0 | 0 | 0 |
| 2 | 0 | 5 | 0 | 0 | 0 |
| 3 | 0 | 0 | 5 | 0 | 0 |
| 4 | 0 | 0 | 0 | 0 | 0 |
| 5 | 0 | 0 | 0 | 5 | 0 |
| 6 | 0 | 0 | 0 | 0 | 0 |
| 7 | 0 | 0 | 0 | 0 | 0 |
| 8 | 0 | 0 | 0 | 0 | 0 |
| 9 | 0 | 0 | 0 | 0 | 0 |
| 10 | 0 | 0 | 0 | 0 | 5 |

FIG.15

GAME QUALIFICATION TIME MANAGEMENT TABLE

| | GAMING TERMINAL | | | | | |
|---|---|---|---|---|---|---|
| PAYOUT RATES | 10a | 10b | 10c | 10d | 10e | 10f |
| 1 | 6 | 30 | 0 | 6 | 41 | 1 |
| 2 | 12 | 2 | 0 | 0 | 20 | 1 |
| 3 | 18 | 1 | 0 | 0 | 3 | 3 |
| 4 | 6 | 0 | 0 | 0 | 6 | 4 |
| 5 | 0 | 0 | 0 | 0 | 2 | 2 |
| 6 | 0 | 0 | 0 | 0 | 7 | 14 |
| 7 | 0 | 0 | 0 | 0 | 9 | 10 |
| 8 | 0 | 0 | 0 | 0 | 12 | 2 |
| 9 | 0 | 0 | 0 | 0 | 2 | 0 |
| 10 | 0 | 0 | 0 | 0 | 6 | 0 |
| ... | ... | ... | ... | ... | ... | ... |

FIG.16

MAXIMUM QUALIFICATION TIME TABLE

| PAYOUT RATES | UPPER LIMIT OF ACCUMULATION |
|---|---|
| 1 | 40 |
| 2 | 40 |
| 3 | 40 |
| 4 | 40 |
| 5 | 40 |
| 6 | 40 |
| 7 | 40 |
| 8 | 40 |
| 9 | 40 |
| 10 | 40 |

FIG.17

ACCUMULATION CALCULATION TABLE

| PAYOUT RATES | ··· | 5 | 4 | 3 | 2 | 1 |
|---|---|---|---|---|---|---|
| BEFORE-AWARDED COMMON GAME QUALIFICATION TIME | ··· | 0 | 6 | 16 | 14 | 2 |
| TO-BE-AWARDED GAME QUALIFICATION TIME | ··· | 0 | 0 | 5 | 0 | 0 |
| AWARDED GAME QUALIFICATION TIME | ··· | 0 | 6 | 21 | 14 | 2 |
| ACCUMULATION OF AWARDED GAME QUALIFICATION TIME | ··· | 0 | 6 | 27 | 41 | 43 |
| ACCUMULATION UPPER LIMIT OF QUALIFICATION TIME | ··· | 40 | 40 | 40 | 40 | 40 |
| VALUE EXCEEDING THE ACCUMULATION UPPER LIMIT OF QUALIFICATION TIME | ··· | 0 | 0 | 0 | 1 | 2 |
| VALUE CALCULATED BY SUBTRACTING THE VALUE EXCEEDING THE ACCUMULATION UPPER LIMIT OF QUALIFICATION TIME | ··· | 0 | 6 | 21 | 13 | 0 |

FIG.18

BASIC QUICK CATCH BONUS PAYOUT TABLE

| | THE NUMBER OF PAYLINES ACTIVATED | | | | |
|---|---|---|---|---|---|
| BENEFIT | 1 | 2 | 3 | 5 | 10 |
| AWARD GAME QUALIFICATION TIME CORRESPONDING TO ONE BET | 311 | 0 | 0 | 0 | 0 |
| AWARD GAME QUALIFICATION TIME CORRESPONDING TO TWO BETS | 0 | 311 | 0 | 0 | 0 |
| AWARD GAME QUALIFICATION TIME CORRESPONDING TO THREE BETS | 0 | 0 | 311 | 0 | 0 |
| AWARD GAME QUALIFICATION TIME CORRESPONDING TO FIVE BETS | 0 | 0 | 0 | 311 | 0 |
| AWARD GAME QUALIFICATION TIME CORRESPONDING TO TEN BETS | 0 | 0 | 0 | 0 | 311 |
| BLANK | 17727 | 17727 | 17727 | 17727 | 17727 |
| TOTAL | 18038 | 18038 | 18038 | 18038 | 18038 |

RANGE OF RANDOM NUMBERS: 1–18038

FIG.19

SPECIAL QUICK CATCH BONUS PAYOUT TABLE

| | THE NUMBER OF PAYLINES ACTIVATED | | | | |
|---|---|---|---|---|---|
| TYPE OF THE BENEFIT | 1 | 2 | 3 | 5 | 10 |
| AWARD GAME QUALIFICATION TIME CORRESPONDING TO ONE BET | 471 | 160 | 160 | 160 | 160 |
| AWARD GAME QUALIFICATION TIME CORRESPONDING TO TWO BETS | 80 | 391 | 80 | 80 | 80 |
| AWARD GAME QUALIFICATION TIME CORRESPONDING TO THREE BETS | 0 | 0 | 311 | 0 | 0 |
| AWARD GAME QUALIFICATION TIME CORRESPONDING TO FIVE BETS | 0 | 0 | 0 | 311 | 0 |
| AWARD GAME QUALIFICATION TIME CORRESPONDING TO TEN BETS | 0 | 0 | 0 | 0 | 311 |
| BLANK | 17487 | 17487 | 17487 | 17487 | 17487 |
| TOTAL | 18038 | 18038 | 18038 | 18038 | 18038 |

RANGE OF RANDOM NUMBERS: 1-18038

FIG.22

INDEPENDENT SPECIAL GAME QUALIFICATION TIME AWARDING TABLE

| | NUMBER OF ACTIVATED PAYLINES | | | | |
|---|---|---|---|---|---|
| PAYOUT RATES | 1 | 2 | 3 | 5 | 10 |
| 1 | 29 | 0 | 0 | 0 | 0 |
| 2 | 5 | 30 | 0 | 0 | 0 |
| 3 | 0 | 4 | 29 | 0 | 0 |
| 4 | 0 | 0 | 3 | 0 | 0 |
| 5 | 0 | 0 | 0 | 30 | 0 |
| 6 | 0 | 0 | 0 | 0 | 0 |
| 7 | 0 | 0 | 0 | 0 | 0 |
| 8 | 0 | 0 | 0 | 0 | 0 |
| 9 | 0 | 0 | 0 | 0 | 0 |
| 10 | 0 | 0 | 0 | 0 | 27 |

FIG.24

BONUS TYPE TABLE

| BONUS TYPES | UNIT PAYOUT AMOUNTS | RANKS |
|---|---|---|
| BLUE MARLIN | 10000 | 1 |
| BLUE FIN TUNA | 5000 | 2 |
| DOLPHIN FISH | 4000 | 2 |
| NAPOLEON FISH | 3000 | 2 |
| YELLOW FIN TUNA | 2000 | 3 |
| WAHOO | 1500 | 3 |
| BLACK SEABASS | 1500 | 3 |
| HALIBUT | 1000 | 4 |
| ... | ... | ... |

FIG.25

INDEPENDENT SPECIAL GAME PROBABILITY TABLE

| RANDOM NUMBERS | WINNING BONUS TYPES |
|---|---|
| 0-9 | BLUE MARLIN |
| 10-19 | BLUE FIN TUNA |
| 20-22 | DOLPHIN FISH |
| 23-25 | NAPOLEON FISH, BLACK SEABASS |
| 26-48 | YELLOW FIN TUNA, HALIBUT |
| 49-116 | WAHOO, BLACK SEABASS |
| 117-210 | BLACK SEABASS, HALIBUT |
| 211-293 | WAHOO, BLACK SEABASS, HALIBUT |
| ... | ... |

RANGE OF RANDOM NUMBERS : 0-65535

FIG.27

MYSTERY BONUS START RANDOM DETERMINATION TABLE

| | NUMBER OF ACTIVATED PAYLINES | | | | |
|---|---|---|---|---|---|
| MYSTERY BONUS | 1 | 2 | 3 | 5 | 10 |
| OCCURRENCE | 0-1 | 0-2 | 0-3 | 0-4 | 0-5 |
| EFFECT ONLY | 2-5 | 3-8 | 4-11 | 5-14 | 6-17 |
| NON-OCCURRENCE | 6-299 | 9-299 | 12-299 | 15-299 | 18-299 |

RANGE OF RANDOM NUMBERS:0-299

FIG.28

MYSTERY BONUS PROBABILITY TABLE

| RANDOM NUMBERS | WINNING BONUS TYPES |
|---|---|
| 0-1 | BLUE MARLIN |
| 2-5 | BLUE FIN TUNA |
| 6-11 | DOLPHIN FISH |
| 12-19 | NAPOLEON FISH |
| 20-29 | YELLOW FIN TUNA |
| 30-40 | WAHOO |
| 41-53 | BLACK SEABASS |
| 54-67 | HALIBUT |
| ... | ... |

RANGE OF RANDOM NUMBERS: 0-5000

FIG.30

COMMON GAME START RANDOM DETERMINATION TABLE

| | |
|---|---|
| OCCURRENCE | 0-1 |
| EFFECT ONLY | 2-3 |
| NON-OCCURRENCE | 4-1214 |

RANGE OF RANDOM NUMBERS:0-1214

FIG.31

COMMON GAME TYPE RANDOM DETERMINATION TABLE

| | |
|---|---|
| FIRST COMMON GAME | 0-31 |
| SECOND COMMON GAME | 32-63 |
| THIRD COMMON GAME | 64-83 |
| FIRST COMMON GAME + THIRD COMMON GAME | 84-91 |
| SECOND COMMON GAME + THIRD COMMON GAME | 92-99 |
| PROGRESSIVE BONUS GAME | 100-109 |

RANGE OF RANDOM NUMBERS:0-109

FIG.35

FIRST COMMON GAME PROBABILITY TABLE

| RANDOM NUMBERS | WINNING BONUS TYPES |
|---|---|
| 0-9 | BLUE MARLIN, BLACK SEABASS, HALIBUT |
| 10-19 | BLUE FIN TUNA,WAHOO, HALIBUT |
| 20-22 | DOLPHIN FISH, BLACK SEABASS, HALIBUT |
| 23-25 | NAPOLEON FISH, BLACK SEABASS, HALIBUT |
| 26-48 | YELLOW FIN TUNA, WAHOO, HALIBUT, HALIBUT |
| 49-116 | WAHOO, BLACK SEABASS, HALIBUT, HALIBUT |
| 117-210 | BLACK SEABASS, HALIBUT, HALIBUT |
| 211-293 | WAHOO, WAHOO, BLACK SEABASS, HALIBUT |
| ... | ... |

RANGE OF RANDOM NUMBERS:0-65535

FIG.40

THIRD COMMON GAME PROBABILITY TABLE

| RANDOM NUMBERS | WINNING BONUS TYPES |
|---|---|
| 0-19 | BLUE MARLIN |
| 20-76 | BLUE FIN TUNA |
| 77-399 | DOLPHIN FISH |

RANGE OF RANDOM NUMBERS: 0-399

FIG.41

MOVEMENT PATTERN TABLE

| IDENTIFICATION INFORMATION | MOVEMENT PATTERNS |
|---|---|
| 0001 | HIGH DEGREE OF VIBRATION |
| 0002 | HIGH DEGREE OF ROTATION |
| 0003 | HIGH DEGREE OF VIBRATION, HIGH DEGREE OF ROTATION |
| ... | ... |

FIG.42

DISPLAY PATTERN TABLE

| IDENTIFICATION INFORMATION | DISPLAY PATTERNS |
|---|---|
| 0001 | LARGE FISH TOOK BAIT |
| 0002 | FISH IS BEING LIFTED |
| 0003 | LARGE FISH IS BEING LIFTED |
| ... | ... |

BASE GAME QUALIFICATION TIME AWARDING TABLE

| | NUMBER OF ACTIVATED PAYLINES | | | | |
|---|---|---|---|---|---|
| PAYOUT RATES | 1 | 2 | 3 | 5 | 10 |
| 1 | 6 | 1 | 1 | 1 | 1 |
| 2 | 0 | 4 | 2 | 1 | 1 |
| 3 | 0 | 1 | 3 | 1 | 1 |
| 4 | 0 | 0 | 1 | 1 | 1 |
| 5 | 0 | 0 | 0 | 4 | 2 |
| 6 | 0 | 0 | 0 | 0 | 1 |
| 7 | 0 | 0 | 0 | 0 | 1 |
| 8 | 0 | 0 | 0 | 0 | 1 |
| 9 | 0 | 0 | 0 | 0 | 1 |
| 10 | 0 | 0 | 0 | 0 | 1 |

GAMING MACHINE WITH BET-AMOUNT-DEPENDENT QUALIFICATION TIME FOR SUBSEQUENT GAMES AND GAME CONTROL METHOD THEREOF

CROSS REFERENCE TO RELATED APPLICATION

The present application claims priority from Japanese Patent Application No. 2011-174420, which was filed on Aug. 9, 2011, the disclosure of which is herein incorporated by reference in its entirety.

BACKGROUND OF THE INVENTION

The present invention relates to a gaming machine.

A conventional gaming machine includes a plurality of gaming terminals, terminal controllers provided for the respective gaming terminals to cause each gaming terminal to execute a game, and a center controller controlling the terminal controllers. Such a conventional gaming machine is disclosed in, for example, the specification of Published U.S. Application No. 2006/0009283.

Each terminal controller individually runs a basic game for the associated gaming terminal, and awards a payout based on the base game. The center controller provides a common game, in which two or more players compete against one another for various jackpots, such as a progressive jackpot and a mystery jackpot, through the gaming terminals. Thus, how to run a common game at each gaming terminal has traditionally been an important element of improving the entertainment characteristic in the gaming machine having the plurality of gaming terminals.

Among such common games, there is a common game which allows a player satisfying a predetermined qualification requirement to participate therein. More specifically, the player obtains, in a basic game, points or qualification time for participating in a common game, and whether to allow the player to participate in the common game is determined based on the points or qualification time.

A common game requires the participation of more than one player. In this regard, because the progress of the game is different among the players, obtained points or qualification time required for participating in the common game are different among the players. This is problematic in that a player's points or qualification time having been obtained may become of no use, when other players cannot obtain enough points or qualification time.

To solve this problem, a part of the obtained points or qualification time may be returned to the players in some way. In this regard, this may be achieved by increasing the payout rates in common games. However, the payout rates in common games are already high, and further increasing the payout rates may be perceived as too thrilling for players who want to calmly enjoy playing common games and basic games.

SUMMARY OF THE INVENTION

An object of the present invention is to provide a gaming machine offering a common game that is highly entertaining for many players, and a game control method of the gaming machine.

The present invention relates to a gaming machine that transits from a first game in which no game qualification time is set to a third game in which the game qualification time is set and participation to the third game is allowed when the game qualification time is owned, the gaming machine comprising: a display configured to display a game result; a switch configured to receive a bet; a memory configured to store a bet amount; a timer configured to count the game qualification time; and a controller.

The controller is programmed to execute the steps of: starting the first game after receiving the bet input by means of the switch, displaying a first game result of the first game on the display, and awarding an award based on the first game result; storing the bet amount received in the first game in the memory; awarding the game qualification time based on the bet amount stored in the memory and adding the awarded game qualification time to the timer; when the game result of the first game is a predetermined game result, transiting to a second game in which a winning probability is different from a winning probability in the first game; and increasing the winning probability in the second game as the game qualification time stored in the timer is increased.

According to the arrangement above, game qualification time for participating in the third game from the first game is available. This game qualification time is awarded in accordance with a bet amount stored in the memory after receiving a bet input by means of the switch. A winning probability in a second game which is played when the first game results in a predetermined result is increased in accordance with the length of the game qualification time defined in the timer. This motivates the player to continue the first game and also to participate in the third game, with the result that the entertainment factor is enhanced.

In addition to the above, the present invention relates to a gaming machine that transits from a first game in which no game qualification time is set to a third game in which the game qualification time is set and participation to the third game is allowed when the game qualification time is owned, the gaming machine comprising: a display configured to display a game result; a switch configured to receive a bet; a memory configured to store a bet amount; a timer configured to count the game qualification time; and a controller.

The controller is programmed to execute the steps of: storing the bet amount received by means of the switch in the memory; after receiving the bet, starting the first game in which a plurality of symbols are rearranged on the display and awarding an award based on a combination of the rearranged symbols; if in the first game a predetermined condition is satisfied, awarding a second game which is run independently from the first game; in the second game, awarding a benefit based on a second game basic random determination table that defines a winning probability of the benefit; awarding the game qualification time in accordance with the bet amount stored in the memory, adding the awarded game qualification time to the timer, and counting down the game qualification time stored in the timer; if the game qualification time stored in the timer exceeds a predetermined upper limit, awarding a benefit in the second game based on a second game specific random determination table that defines a winning probability which is increased in accordance with a time exceeding the upper limit; and determining whether a condition to start the third game is established at predetermined intervals, running the third game if the condition to start the third game is established and the game qualification time is owned, and awarding an award based on an execution result of the third game.

According to the arrangement above, game qualification time for participating in the third game from the first game is available. This game qualification time is counted and stored in the timer, in accordance with the bet amount stored in the memory after receiving a bet input by means of the switch. When in the first game the second game is awarded as a result of satisfying a predetermined condition and second game is executed, an award is awarded based on the second game basic random determination table defining a winning probability of the award.

In this regard, according to the present arrangement, because a predetermined upper limit is applied for the game qualification time, it is possible to prevent the participation in a third game from becoming too advantageous for the players, and hence the balance in the benefit is balanced between the players and the administrator of the gaming machine. However, it is unilaterally disadvantageous toward the players if the game qualification time does not increase beyond the upper limit when the awarded game qualification time becomes longer than the upper limit.

To solve this problem, when the game qualification time stored in the timer exceeds the predetermined upper limit, the disadvantage of the players is resolved such that, in the second game, a benefit is awarded based on the second game specific random determination table defining the winning probability which has been increased in accordance with the time exceeding the upper limit.

This motivates the player to continue the first game and also to participate in the third game, with the result that the entertainment factor is enhanced.

In addition to the above, the present invention relates to a gaming machine that transits from a first game run in a gaming terminal to a third game in which game qualification time is set and only a gaming terminal that owns the game qualification time is allowed to participate in the third game, the gaming machine comprising: a plurality of gaming terminals each having a switch configured to receive a bet, a terminal display configured to display a game result, and a terminal controller programmed to execute steps (a1) to (a5); a memory configured to store a bet amount; a timer configured to count the game qualification time; and a center controller programmed to execute steps (b1) to (b6).

The terminal controller executes the steps of: (a1) transmitting information of the bet amount received by means of the switch to the center controller; (a2) after receiving the bet, starting a first game in which a plurality of symbols are rearranged on the display, independently from other gaming terminals, and awarding an award based on a combination of the rearranged symbols; (a3) when a predetermined condition is satisfied in the first game, awarding a second game that is run independently of the first game; (a4) in the second game, awarding a benefit based on a second game basic random determination table defining a winning probability of a benefit; (a5) if award information regarding the third game is received, awarding an award based on the award information, and the center controller executes the steps of: (b1) storing the transmitted bet amount in the memory for each of the gaming terminals; (b2) awarding the game qualification time in accordance with the bet amount stored in the memory and adding the awarded game qualification time to the timer; (b3) counting down the game qualification time stored in the timer; (b4) when the game qualification time stored in the timer exceeds a predetermined upper limit, in the next second game, awarding a benefit based on a second game specific random determination table that defines a winning probability which is increased in accordance with a time exceeding the upper limit; (b5) determining whether a condition to start the third game is established at predetermined intervals, running the third game in which the gaming terminals having the game qualification time are synchronized, if the condition to start the third game is established, and determining an award and selecting which gaming terminal receives the award; (b6) transmitting the award information to the selected gaming terminal.

According to the arrangement above, regarding a gaming machine in which a plurality of gaming terminals and a center controller are used and a first game run by a gaming terminal is shifted to a third game in which game qualification time is set and in which only a gaming terminal having a game qualification time is able to participate, whether a starting condition of a third game is established is determined at predetermined intervals, a third game in which gaming terminals having the game qualification time are synchronized is executed when the starting condition of the third game is established, and an award and a winning gaming terminal receiving the award are determined based on the execution result of the third game. When the game qualification time counted in the timer exceeds the predetermined upper limit, the disadvantage of the players is resolved such that, in the second game, a benefit is awarded based on the second game specific random determination table defining the winning probability which has been increased in accordance with the time exceeding the upper limit.

This motivates the player to continue the first game and also to participate in the third game, with the result that the entertainment factor is enhanced.

In addition to the above, the present invention relates to a gaming machine that transits from a first game run in a gaming terminal to a third game in which game qualification time is set and only a gaming terminal that owns the game qualification time is allowed to participate in the third game, the gaming machine comprising: a plurality of gaming terminals each having a switch configured to receive a bet, a terminal display configured to display a game result, and a terminal controller programmed to execute steps (c1) to (c5); a memory configured to store a bet amount; a timer configured to count the game qualification time; and a center controller programmed to execute steps (d1) to (d6).

The terminal controller executes the steps of: (c1) transmitting information of the bet amount received by means of the switch to the center controller; (c2) after receiving the bet, starting a first game in which a plurality of symbols are rearranged on the display, independently from other gaming terminals, and awarding an award based on a combination of the rearranged symbols; (c3) when a predetermined condition is satisfied in the first game, awarding a second game that is run independently of the first game; (c4) in the second game, awarding a benefit based on a second game basic random determination table defining a winning probability of a benefit; (c5) if payout amount information regarding the third game is received, awarding an award based on the payout amount information, and the center controller executes the steps of: (d1) storing the transmitted bet amount in the memory for each of the gaming terminals; (d2) determining the game qualification time to be awarded and a payout rate of each unit time of the game qualification time based on the bet amount stored in the memory, and adding the game qualification time of each payout rate to the timer in association with the payout rate, for each of the gaming terminals; (d3) counting down the game qualification time which is associated with the highest payout rate of each of the gaming terminals; (d4) when the game qualification time of each payout rate in the timer exceeds the predetermined upper limit associated with each payout rate, in the next second game, awarding a benefit based on a second game specific random determination table that defines a winning probability which is increased in accordance with a time exceeding the upper limit; (d5) determining whether a condition to start the third game is established at predetermined intervals, running the third game in which the gaming terminals having the game qualification time are synchronized, and determining a unit payout amount and selecting which gaming terminal receives the payout based on an execution result of the third game; (d6) sending, to the selected gaming terminal, the payout amount information calculated by multiplying, by the unit payout amount, the highest payout rate among the payout rates associated with the game qualification time of the selected gaming terminal.

According to this arrangement, only a gaming terminal to which the game qualification time is awarded is allowed to participate in the third game. Based on the bet amount stored in the memory, game qualification time to be awarded and a payout rate in each unit time of the game qualification time are determined, and, for each gaming terminal, the game qualification time of each payout rate is associated with the payout rate and the game qualification time is accumulatively stored in the timer. This motivates the players to continue the playing of the first game with a high bet amount, thereby improving the entertainment characteristics.

In addition to the above, the gaming machine of the present invention is arranged so that the winning probability defined in the second game specific random determination table is calculated by adding a value calculated by multiplying a time exceeding upper limit by a predetermined value to the winning probability defined in the second game basic random determination table.

According to the arrangement above, a winning probability in the second game specific random determination table is calculated by adding, to the winning probability defined in the second game basic random determination table, a value calculated by multiplying the time exceeding the upper limit by a predetermined value. This makes it possible to balance the winning probabilities between the second game specific random determination table and the second game basic random determination table, so as to prevent the winning probability in the second game specific random determination table from becoming excessively high or low.

In addition to the above, the present invention relates to a game control method of a gaming machine that transits from a first game in which no game qualification time is set to a third game in which the game qualification time is set and participation to the third game is allowed when the game qualification time is owned, a game being run by using: a display configured to display a game result; a switch configured to receive a bet; a memory configured to store a bet amount; a timer configured to count the game qualification time; and a controller.

The controller executes the steps of: starting the first game after receiving the bet input by means of the switch, displaying a first game result of the first game on the display, and awarding an award based on the first game result; storing the bet amount received in the first game in the memory; awarding the game qualification time in accordance with the bet amount stored in the memory and adding the awarded game qualification time to the timer; when the game result of the first game is a predetermined game result, transiting to a second game in which a winning probability is different from a winning probability in the first game; increasing the winning probability in the second game as the game qualification time stored in the timer is increased.

According to the arrangement above, game qualification time for participating in the third game from the first game is available. This game qualification time is awarded in accordance with a bet amount stored in the memory after receiving a bet input by means of the switch. A winning probability in a second game which is played when the first game results in a predetermined result is increased in accordance with the length of the game qualification time defined in the timer. This motivates the player to continue the first game and also to participate in the third game, with the result that the entertainment factor is enhanced.

In addition to the above, the present invention relates to a gaming machine comprising: a display configured to display a game result; a memory configured to store a bet amount; a switch configured to receive a bet; and a controller.

The controller is programmed to execute the steps of: starting a first game after receiving the bet input by means of the switch, displaying a first game result of the first game on the display, and awarding an award in accordance with the first game result; storing a bet amount consumed in the first game in the memory; when the game result of the first game is a predetermined game result, transiting to a second game in which a winning probability is different from a winning probability in the first game; and increasing the winning probability in the second game in accordance with the bet amount stored in the memory.

According to this arrangement, when the first game results in a predetermined result, it is possible to shift to the second game having a different winning probability from the first game, and the winning probability in the second game after the shifting is increased in accordance with the bet amount bet in the first game. This motivates the players to continue the playing of the first game with a high bet amount, thereby improving the entertainment characteristics.

It is possible to provide a gaming machine offering a common game that is highly entertaining for many players, and a game control method of the gaming machine.

BRIEF DESCRIPTION OF THE DRAWINGS

FIG. 9 illustrates a lever position determining table.

FIG. 13 illustrates a base game symbol table.

FIG. 14 illustrates a base game qualification time awarding table.

FIG. 15 illustrates a game qualification time management table.

FIG. 16 illustrates a maximum qualification time table.

FIG. 17 illustrates an accumulation calculation table.

FIG. 18 illustrates a basic quick catch bonus payout table.

FIG. 19 illustrates a special quick catch bonus payout table.

FIG. 22 illustrates an independent special game qualification time awarding table.

FIG. 24 illustrates a bonus type table.

FIG. 25 illustrates an independent special game probability table.

FIG. 27 illustrates a mystery bonus start random determination table.

FIG. 28 illustrates a mystery bonus probability table.

FIG. 30 illustrates a common game start random determination table.

FIG. 31 illustrates a common game type random determination table.

FIG. 35 illustrates a first common game probability table.

FIG. 40 illustrates a third common game probability table.

FIG. 41 illustrates a movement pattern table.

FIG. 42 illustrates a display pattern table.

DESCRIPTION OF THE PREFERRED EMBODIMENTS

The following will describe an embodiment of the present invention with reference to figures.

(Outline of Gaming Machine)

A gaming machine includes a plurality of gaming terminals and a center controller data-communicably connected to the gaming terminals. Each gaming terminal runs independently of the other gaming terminals a basic game using symbol columns, and runs a common game in sync with the other gaming terminals.

Figure 1:
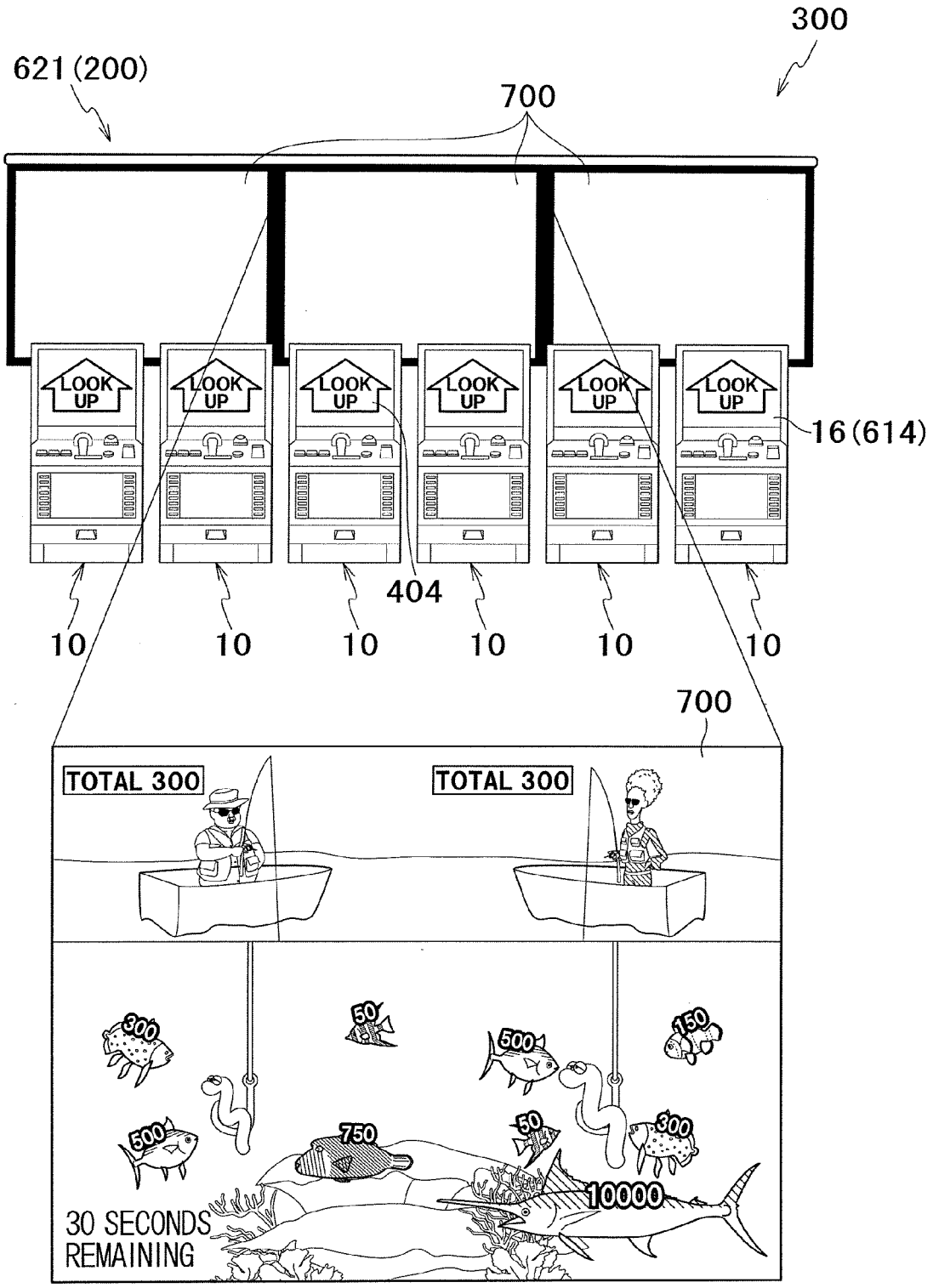
FIG. 1 illustrates the outline of a gaming machine.
Figure 2:
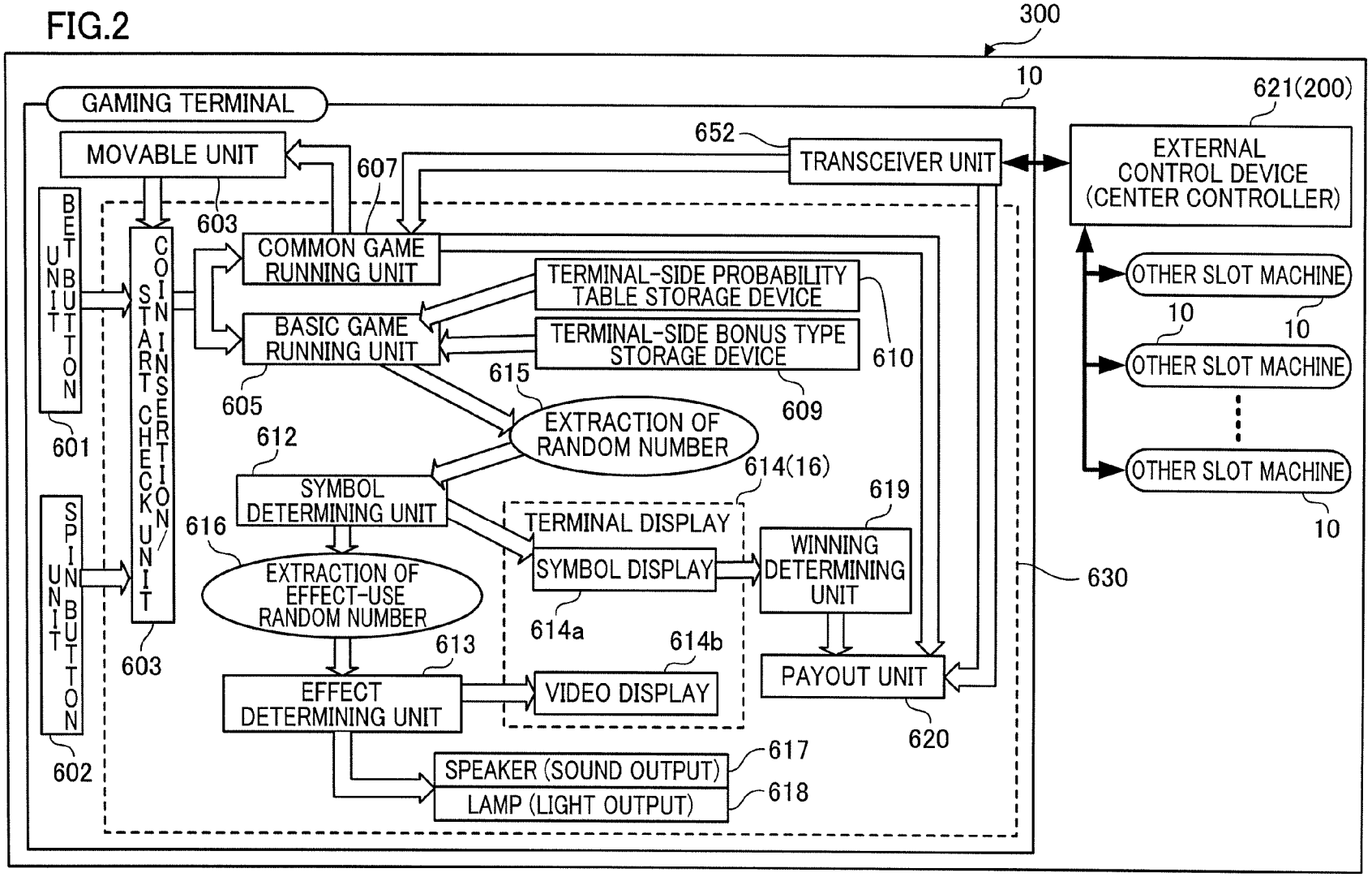
FIG. 2 is a block diagram of a gaming terminal.
Figure 3:
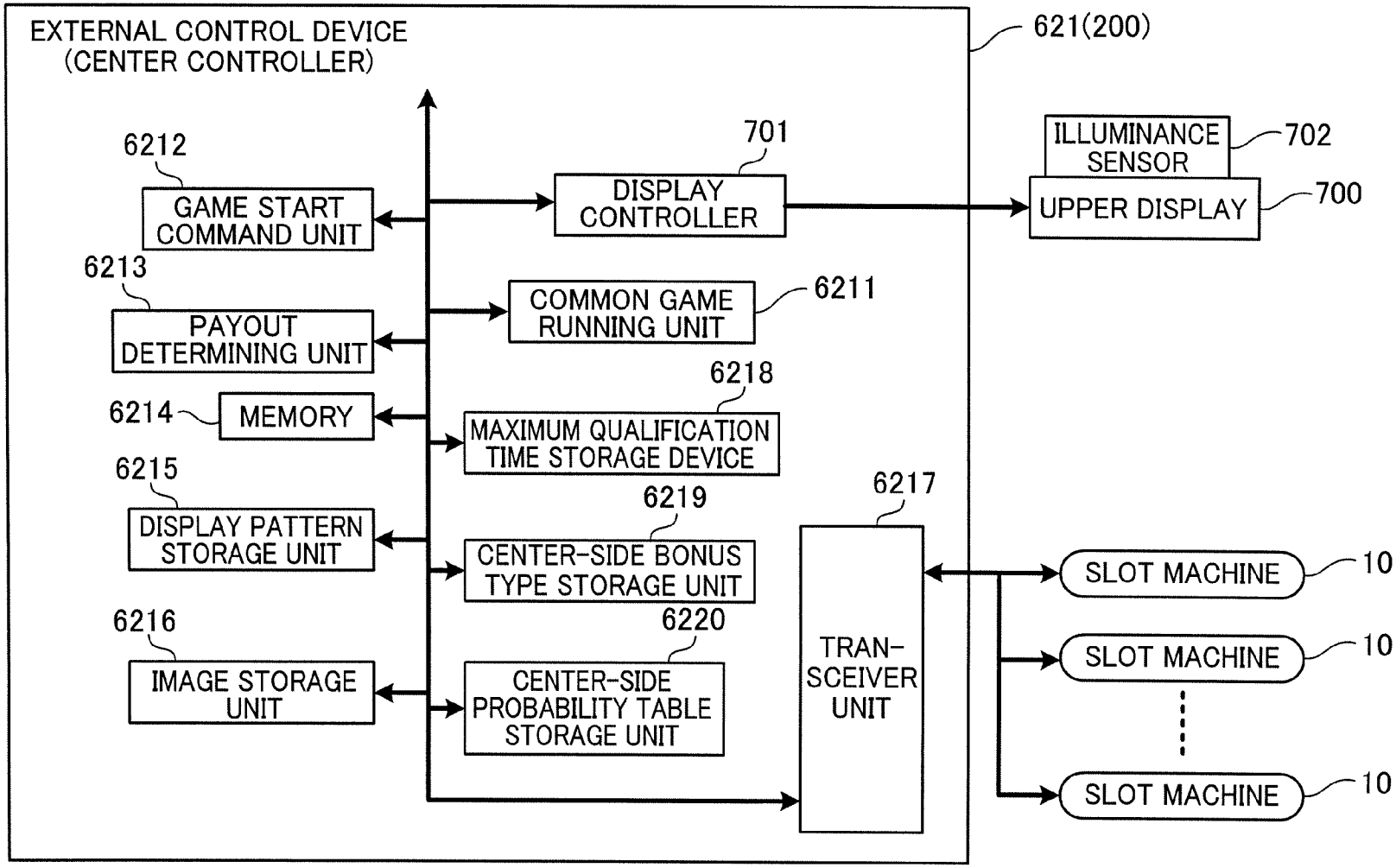
FIG. 3 is block diagram of a center controller.

More specifically, as shown in FIG. 1 to FIG. 3, the gaming machine 300 of the present embodiment has a multi-player type structure, where gaming terminals 10 are connected in a parallel manner and in communication with a center controller 200. The gaming machine 300 is structured so that each gaming terminal 10 is able to individually run a basic game such as a slot game, independently of the other slot machines 10. In the basic game, symbols 501 are rearranged on the terminal display 614 (terminal image display panel 16) of the gaming terminal 10.

(Functional Block of Gaming Machine 300: Gaming Terminal 10)

The gaming machine 300 having the above structure includes gaming terminals 10 and the external controller 621 (such as a center controller 200) data-communicably connected to the gaming terminals 10, as illustrated in FIGS. 1 to 3. The external controller 621 is data-communicably connected to the gaming terminals 10 which are provided in a parallel manner.

The gaming terminal 10 includes a bet button unit 601, a spin button unit 602, a movable unit 603, a terminal display 614, a movement pattern storage device 608, a terminal-side bonus type storage device 609, and a terminal-side probability table storage device 610. The gaming terminal also includes a terminal controller 630 which controls these units and devices. Note that the bet button unit 601, the spin button unit 602, and the movable unit 603 each are a kind of an input device. Further the gaming terminal 10 includes a transceiver unit 652 which enables data communication with the external controller 621.

The bet button unit 601 has a function of accepting a player's operation for entering a bet amount. The spin button unit 602 and the movable unit 603 have a function of receiving a start of a game such as basic game through a player's operation; i.e., start operation. The terminal display 614 has a function of displaying, in the form of a still image, various symbols 501, numerical values, marks, or the like, and displaying moving pictures such as an effect movie.

The movable unit 603 can receive an input from the outside as described above, and can be moved in accordance with a plurality of movement patterns by the terminal controller 630. More specifically, the movable unit 603 includes a lever 6031 that the player can grip, a first motor 6032 which is provided in the lever 6031 to vibrate the lever, a second motor 6033 which is provided in the lever 6031 to bias the lever 6031 in a predetermined rotation direction, and a light emission unit 6034 provided at an upper part of the lever 6031. The movement patterns of the movable unit 603 are stored in the movement pattern storage device 608 to be associated with sets of identification information by which each movement pattern is identified.

The terminal-side bonus type storage device 609 stores bonus types and unit payout amounts of the terminal bonus games, in association with one another. The terminal-side probability table storage device 610 stores a probability table in which combinations of the terminal bonus games are associated with the probabilities of the combinations.

The terminal controller 630 includes: a coin insertion/start-check unit 603; a basic game running unit 605; a common game running unit 653; a random number sampling unit 615; a symbol determining unit 612; an effect-use random number sampling unit 616; an effect determining unit 613; a speaker unit 617; a lamp unit 618; a winning determining unit 619; a payout unit 620.

The coin insertion/start-check unit 603 determines which one of the basic game, the bonus game, the common game, and the like is to be started, and determines whether the determined one of the base game, the bonus game, the common game, and the like is startable, based on signals output from the bet button unit 601, the spin button unit 602, and the movable unit 603, and a signal or the like from the center controller 200.

The basic game running unit 605 has a function of running a basic game on condition that the bet button unit 601 is operated. The basic game running unit 605 determines whether to run a terminal bonus game, based on a combination of rearranged symbols 501 resulted from the base game.

Further, the basic game running unit 605 has a function of outputting the state of the basic game to the center controller 200, via the transceiver unit 652. That is, the basic game running unit 605 outputs the running status information to the center controller 200.

The common game running unit 653 has a function of running the common game, based on a game start command from the center controller 200.

The symbol determining unit 612 has: a function of determining symbols 501 to be rearranged, by using a random number given by the random number sampling unit 615; a function of rearranging selected symbols 501 on the symbol display region 614*a* of the terminal display 614; and a function of outputting information of the symbols 501 rearranged, to the winning determining unit 619.

More specifically, the symbol determining unit 612 has functions of: selecting the symbol column image 500 according to the game (basic game or common game); scroll displaying the symbol column image 500 selected on the terminal display 614; and stopping the scroll display to rearrange the symbols 501 determined.

The effect-use random number sampling unit 616 has functions of, when receiving the effect instruction signal from the symbol determining unit 612, sampling an effect-use random number; and outputting the effect-use random number to the effect determining unit. The effect determining unit has: a function of determining an effect by using the effect-use random number; a function of outputting, to a video display region 614*b* of the terminal display 614, video information in the effect thus determined; and a function of outputting audio information and illumination information of the effect to the speaker unit 617 and the lamp unit 618, respectively.

The winning determining unit 619 has a function of determining whether a winning is achieved when rearrangement information of the symbols 501, which is a display state rearranged on the terminal display 614, is obtained, a function of calculating a payout amount based on a winning combination when it is determined that a winning is achieved, and a function of outputting a payout signal based on the payout amount to the payout unit 620. The payout unit 620 has a function of awarding the player a game value in the form of a coin, a medal, credit, or the like, based on a payout signal from the winning determining unit 619 or the center controller.

The transceiver unit 652 has functions of: outputting the running state of the basic game, points calculated in the common game, or the like to the center controller 200, along with the identification information of each gaming terminal 10; and receiving the game start command from the center controller 200, and the common game symbol column image 500*b*, or the like.

(Functional Block of Gaming Machine 300: External Controller)

The gaming terminal 10 structured as above is connected to the external controller 621. This external controller 621 has a function of remotely operating and monitoring the operation state of each gaming terminal 10 and processes such as changes in various game setting values. Further, the external controller 621 has a function of running the common game in a plurality of gaming terminals 10 simultaneously.

More specifically, as shown in FIG. 3, the external controller 621 includes a common game running unit 6211, a game start command unit 6212, a payout determining unit 6213, a memory 6214, a transceiver unit 6217, a plurality of upper displays 700, display controllers 701, an illuminance sensor 702, a display pattern storage unit 6215, an image storage unit 6216, a center-side bonus type storage unit 6219, and a center-side probability table storage unit 6220.

The common game running unit 6211 has functions of determining whether to start the common game, based on the state of the basic game obtained from the terminal controller 630, and synchronizing the common game run in each of the gaming terminals 10. The game start command unit 6212 has a function of outputting the game start command to the gaming terminal 10. The memory 6214 stores, for each gaming terminal 10, common game qualification times in association with respective payout rates. The transceiver unit 6217 has a function of allowing data exchange among the gaming terminals 10.

The upper displays 700 are provided in a parallel manner, and are controlled by the associated display controllers 701 so that the upper displays 700 form a single common effect display screen. The common effect display screen is arranged to display a plurality of individual images corresponding to the respective gaming terminals 10. Furthermore, the common effect display screen is arranged to display a common game start effect image. The common game start effect image is stored in the image storage unit 6216. The display controller 701 is controlled by the common game running unit 6211. The illuminance sensor 702 detects the brightness of the disturbance light on the upper display 700.

The display pattern storage unit 6215 stores sets of identification information in association with a plurality of display patterns of the individual image. Furthermore, the center-side bonus type storage unit 6219 stores bonus types and unit payout amounts of the common game in association with one another. The center-side probability table storage unit 6220 stores a probability table in which combinations of bonus types are associated with the probabilities of these combinations.

Note that the connection between the gaming terminals 10 and the center controller 200 may be wireless, wired, or a combination of these. Note that a unit of the bet amount may be a national or regional currency such as dollar, yen, and Euro. The unit of the bet amount may also be a game point used only at a hall where the gaming machine 300 is provided, or in the related industry.

The expression "rearrange" means dismissing an arrangement of symbols 501, and once again arranging symbols 501. An "arrangement" in this specification means a state of symbols 501, which can be visually confirmed by a player.

Note that a unit game includes a series of operations performed within a period between a start of receiving a bet to a point where a winning may be resulted. In the present embodiment, a basic game is repeatable in the base game, and contains one each of the following: a bet time where a bet is accepted; a game time where symbols 501 having been stopped are rearranged; and a payout time where a payout process is performed to award a payout. Note that the "basic game" is a game runnable on condition that a game value is bet, which base game awards an amount of game media based on symbols 501 rearranged. In other words, the "basic game" is a unit game which starts on the premise that a game value is consumed. The "unit game" in the present embodiment is so-called slot game which is run in each gaming terminal 10 independently of the other gaming terminals 10.

Note that the gaming machine 300 of the present embodiment is structured so that each gaming terminal 10 is able to run a bonus game (terminal bonus game) independently of the other gaming terminals 10. Another bonus game may be adopted in combination, provided that the player is given a more advantageous gaming state than the basic game. For example, in the bonus game, various states such as a state in which a larger amount of game values than in the basic game is obtainable, a state in which the probability of obtaining a game value is higher than in the basic game, and a state in which the amount of consumed game values is smaller than in the basic game such as a free game may be realized independently or in combination.

A game runnable with a bet of less game values than the basic game is referred to as "free game". Note that "bet of fewer amounts of game values" encompasses a bet of zero game value. The "free game" therefore may be a game runnable without a bet of game value, which awards an amount of game values according to symbols 501 having been rearranged. In other words, the "free game" may be a game which is started without the premise that a game value is consumed. To the contrary, a later-mentioned "basic game" is a game runnable on condition that a game value is bet, which awards an amount of game values according to symbols 501 rearranged. In other words, the "basic game" is a game which starts on the premise that a game value is consumed.

The gaming machine 300 of the present embodiment has a state in which the basic game or the bonus game is runnable, and a state in which the common game is runnable. The basic game and/or the bonus game (terminal bonus game) are also referred to as base game. Thus, in the present embodiment, the basic game includes a base game and/or a bonus game. Further, the common game or the period during which the common game is run is referred to as "event time".

The "game value" is a coin, bill, or electronic information corresponding to them. Note that the game value in the present invention is not particularly limited. Examples of the game value include game media such as medals, tokens, electronic money, tickets, and the like. Further, the ticket is not particularly limited and may be a later-described ticket with a barcode or the like ticket.

Although the present embodiment describes a gaming machine 300 which has a center controller 200 in addition to the gaming terminals 10, the invention is not limited to this. The gaming machine 300 may be arranged so that one or more gaming terminal 10 has the function of the center controller 200 and the gaming terminals 10 are connected with each other to be able to exchange data therebetween.

(Internal Connection Layout of Gaming Machine 300)

Figure 4:
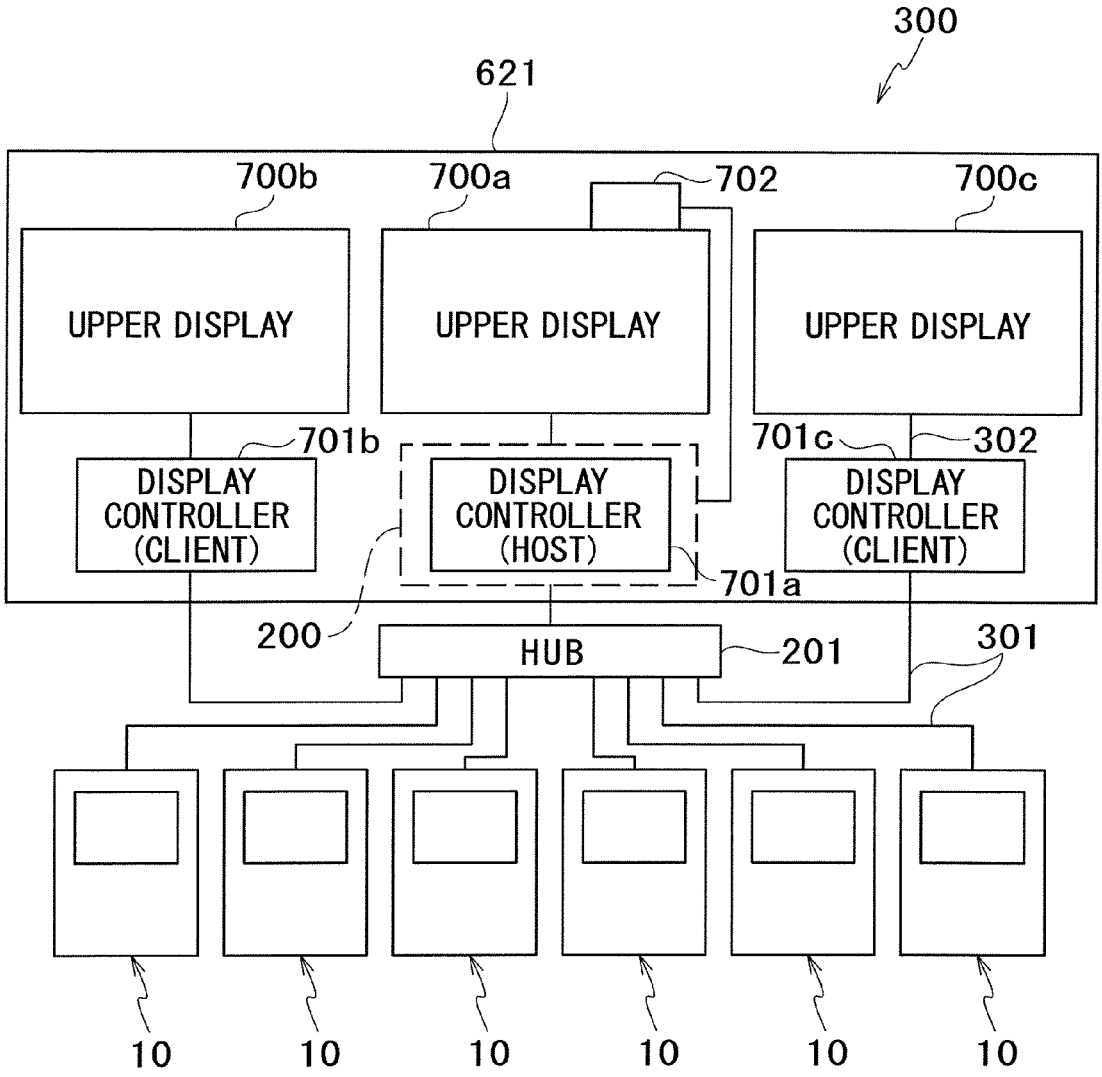
FIG. 4 shows an internal connection layout of the gaming machine.

Now, referring to FIG. 4, the internal connection layout of the gaming machine 300 including the gaming terminals 10 will be described. FIG. 4 shows the gaming machine 300 including the gaming terminals 10 according to First Embodiment of the present invention.

The gaming machine 300 includes six gaming terminals and an external controller 621. The external controller 621 includes three upper displays 700 (700*a*, 700*b*, and 700*c*) and three display controllers 701 (701*a*, 701*b*, and 701*c*). The display controller 701*a* is a component of the center controller 200 and hosts the other display controllers 701*b* and 701*c*. In other words, the display controllers 701*b* and 701*c* are clients of the display controller 701*a*. The display controllers 701*a*, 701*b*, and 701*c* are connected with the respective upper displays 700*a*, 700*b*, and 700*c* via monitor cables 302, so as to function as system controllers controlling the respective upper displays 700.

In addition to the above, the gaming machine 300 is provided with a hub 201. Upstream of the hub 201, the display controller 701*a* (center controller 200) and an unillustrated progressive controller 340 are connected via a LAN cable 301. On the other hand, downstream of the hub 201, the gaming terminals 10 and the display controllers 701*b* and 701*c* are connected via the LAN cable 301. That is to say, the center controller 200 is connected with the gaming terminals 10 to be able to conduct data communications therebetween, and the center controller 200 (display controller 701*a*) is connected to be able to control the display controllers 701*b* and 701*c*. This makes it possible to control the display controllers 701*a*, 701*b*, and 701*c* to cause the upper displays 700 to display images as a single common effect display screen.

In addition to the above, the upper display 700*a* is provided with an illuminance sensor 702 to detect the brightness of disturbance light applied to the upper display 700*a*. The illuminance sensor 702 transmits a brightness signal always or at regular intervals to the center controller 200. This brightness signal indicates the brightness of the disturbance light applied onto the upper display 700*a*. Receiving the brightness signal, the center controller 200 determines whether the currently-set brightness is appropriate by conducting comparison with a predetermined standard. If inappropriate, the center controller 200 controls the display controllers 701*a*, 701*b*, and 701*c* to change the brightness to a suitable level.

(Mechanical Structure of Gaming Machine 300)

Next, the following describes a specific example of mechanical and electrical structures of the gaming machine 300 thus structured.

Figure 5:
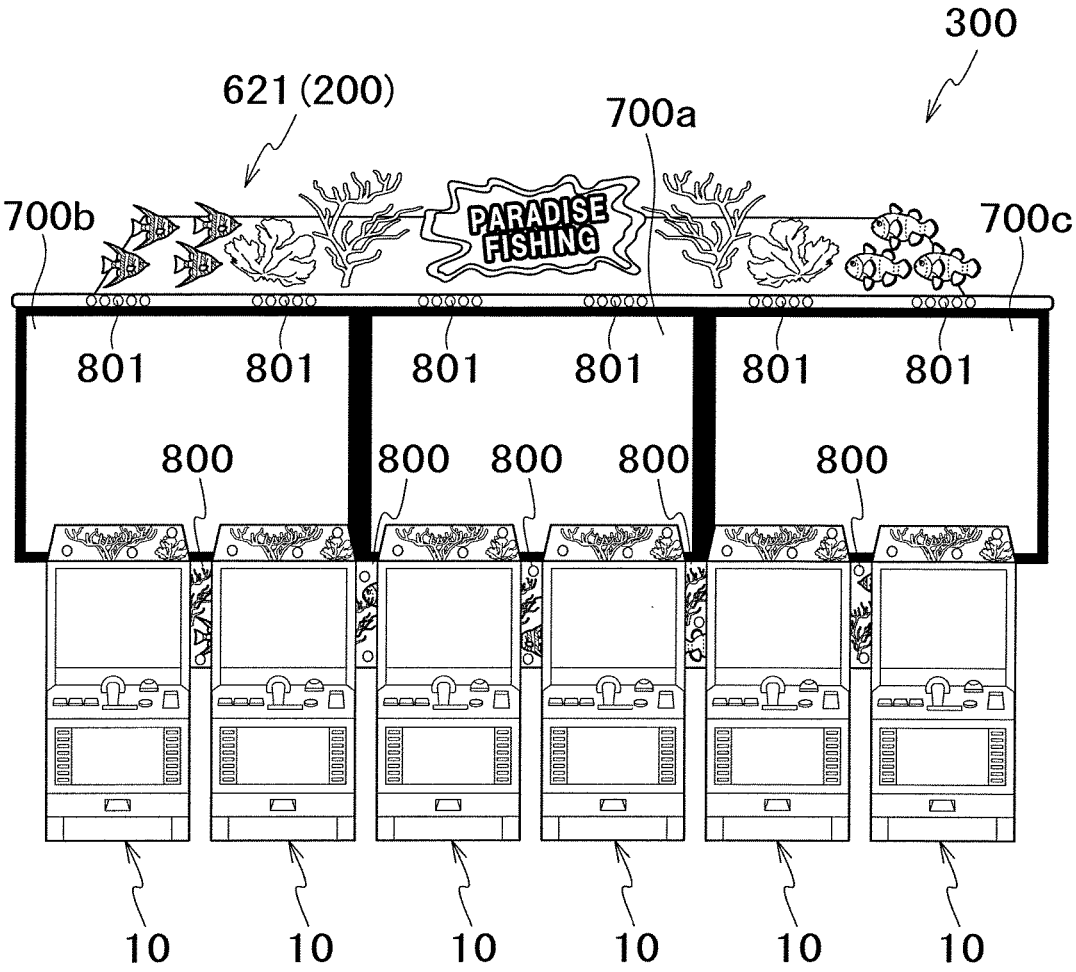
FIG. 5 is a front elevation of the entirety of the gaming machine.

As shown in FIG. 5, the gaming machine 300 includes six gaming terminals 10 which are provided in a parallel manner and each independently runs a basic game, an external controller 621 (center controller 200) which is connected with the gaming terminals 10 to be able to communicate therewith and runs a common game, and an unillustrated progressive controller 340. The external controller 621 has three parallel upper displays 700*a*, 700*b*, and 700*c* forming a single common effect display screen, independently from the gaming terminals 10.

Between neighboring gaming terminals 10, an inter-terminal panel 800 is provided. Each inter-terminal panel 800 has at least one LED to light the panel itself. The inter-terminal panel 800 is decorated with pictures indicating the theme of the games playable by the gaming machine 300, giving integrity to the gaming terminals 10. This makes the entirety of the gaming machine 300 look larger than the actual size.

In addition to the above, the upper displays 700 are provided with LED units 801 corresponding to the respective gaming terminals 10. More specifically, the LED units 801 are provided at the upper parts of the frame of each upper display 700 to be immediately above the respective gaming terminals 10. That is to say, the LED units 801 are provided to enclose an upper part of the upper displays 700. For example, when a later-described independent special game starts at the corresponding gaming terminal 10, the LED unit 801 produces an effect such as flickering for the corresponding gaming terminal 10. This makes it possible to notify which gaming terminal 10 wins an independent special game.

In addition to the above, above the external controller 621 and above each gaming terminal 10, decoration panels decorated with pictures indicating the theme of the games playable by the gaming machine 300 are provided. It is noted that, except FIG. 5, the inter-terminal panel 800, the LED units 801, and the decoration panels are omitted from the figures.

Figure 6:
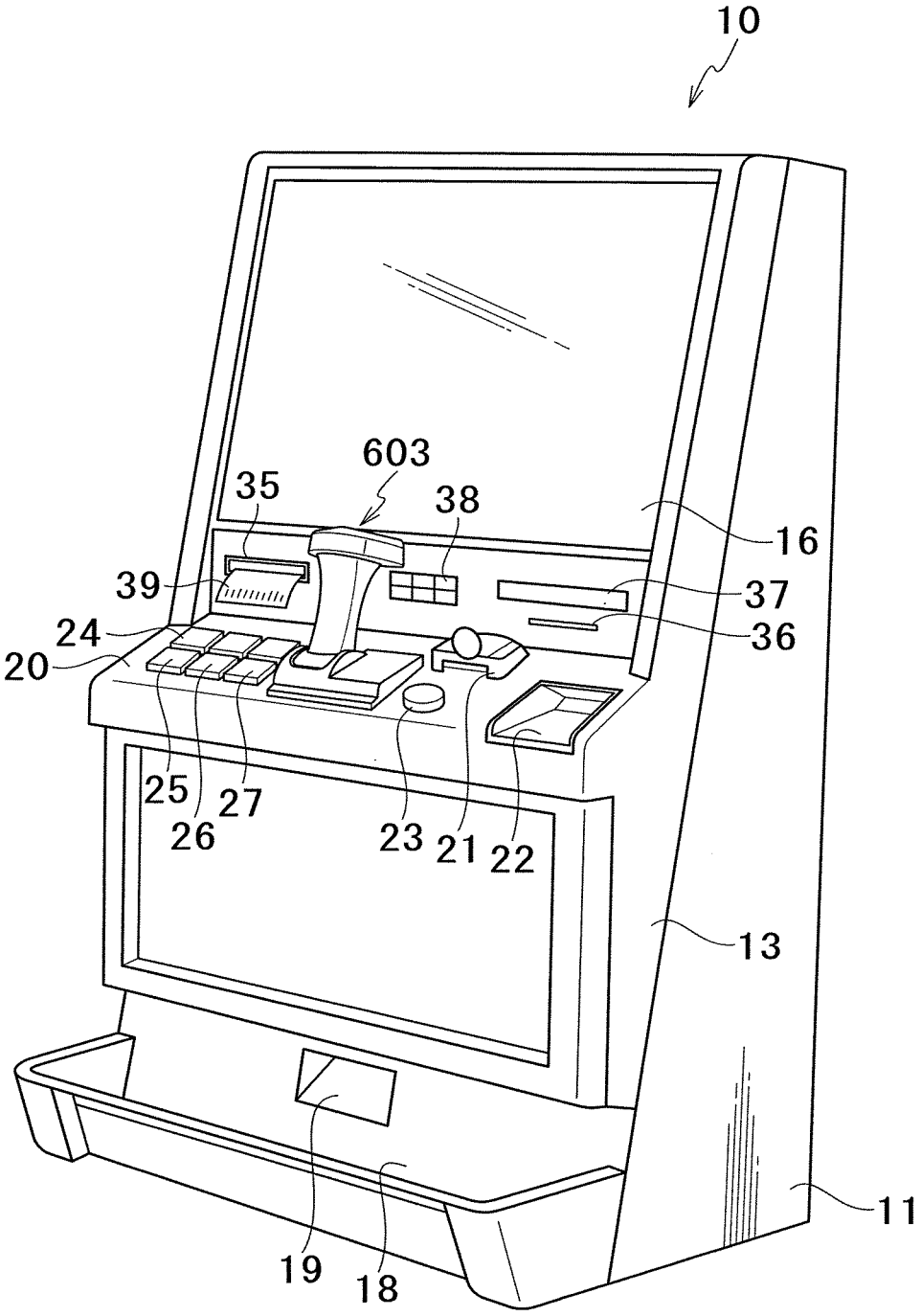
FIG. 6 is a perspective view of the gaming terminal.

As shown in FIG. 6, the gaming terminal 10 includes a cabinet 11 and a main door 13 provided on the front surface of the cabinet 11. The main door 13 has a terminal image display panel 16 (terminal display for displaying game results). The terminal image display panel 16 has a transparent liquid crystal panel for displaying various kinds of information. The terminal image display panel 16 displays display windows 150 (display video reels 151 to 155) for scroll-displaying and arranging a plurality of symbols 501 (see FIG. 12). Further, the terminal image display panel 16 displays various information and effect images related to a game.

The present embodiment deals with a case where the terminal image display panel 16 electrically displays symbols 501 arranged in five columns and three rows. However, the present invention is not limited to this.

Note that the terminal image display panel 16 may have a credit amount display unit and a payout amount display unit. The credit amount display unit displays a total value (hereinafter also referred to as total credit value) which a gaming terminal 10 ca payout to a player. When symbols stopped along a payline form a winning combination, the payout amount display unit displays the number of coins to be paid out.

Below the terminal image display panel 16 provided are a control panel 20, a coin receiving slot 21, and a bill validator 22. The control panel 20 is provided with buttons 23 to 27 and a control lever 603 as a movable unit. These buttons 23 to 27 and the control lever 603 allows the player to input instructions concerning the progress of a game. Through the coin receiving slot 21, a coin is received in the cabinet 11.

The control panel 20 has: a spin button 23, a change button 24, a cashout button 25, a 1-bet button 26 (switch for receiving bets), and a maximum bet button 27. The spin button 23 is for inputting an instruction to start symbol scrolling. The change button 24 is used to ask a staff person in the gaming facility for exchange of money. The cashout button 25 is for inputting an instruction to payout coins corresponding to the total credit value into the coin tray 18.

The 1-bet button 26 is used for betting one coin out of those corresponding to the total credit value. The maximum bet button 27 is used for betting, out of those corresponding to the total credit value, a upper limit of coins (e.g., 50 coins) which can be bet in one game.

The bill validator 22 validates whether a bill is genuine or not and receives the genuine bill into the cabinet 11. Note that the bill validator 22 is capable of reading a barcode attached to a later-mentioned barcoded ticket 39. When the bill validator 22 reads the barcoded ticket 39, it outputs to the main CPU 41*a* read signal representing information having read from the barcode.

On the lower front surface of the main door 13, that is, below the control panel 20, a belly glass 34 is provided. On the belly glass 34, a character of the gaming terminal 10, or the like is drawn.

Below the terminal image display panel 16 are provided a ticket printer 35, a card reader 36, a data displayer 37, and a keypad 38. The ticket printer 35 prints on a ticket a barcode and outputs the ticket as a barcoded ticket 39. A barcode is encoded data containing a credit amount, date and time, an identification number of the gaming terminal 10, or the like. A player can play a game in another gaming terminal 10 using the barcoded ticket 39 having the barcode, or can exchange the barcoded ticket 39 having the barcode with a bill or the like at a change booth of the gaming facility.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

Figure 7:
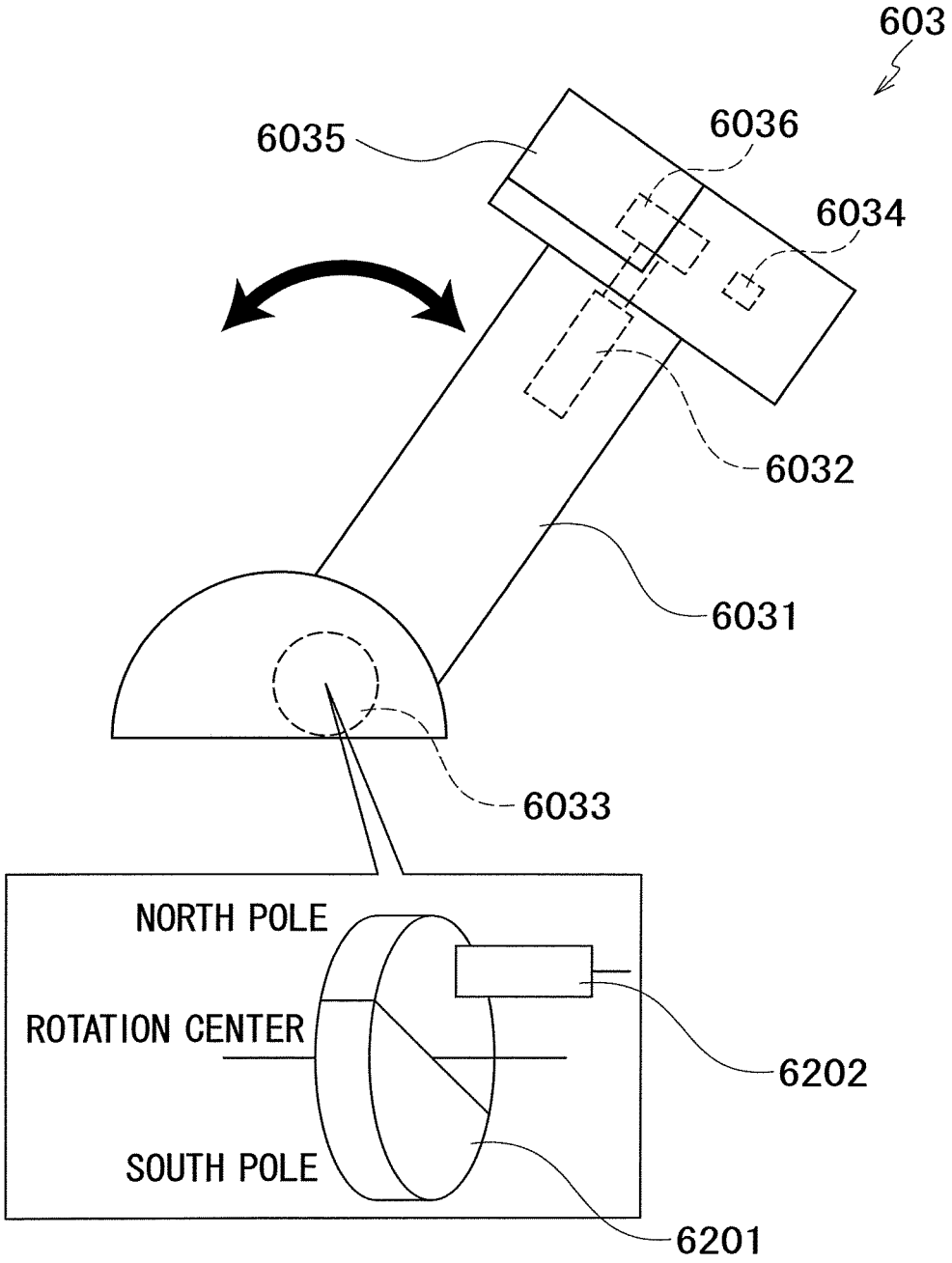
FIG. 7 is a schematic drawing of a control lever.
Figure 8:
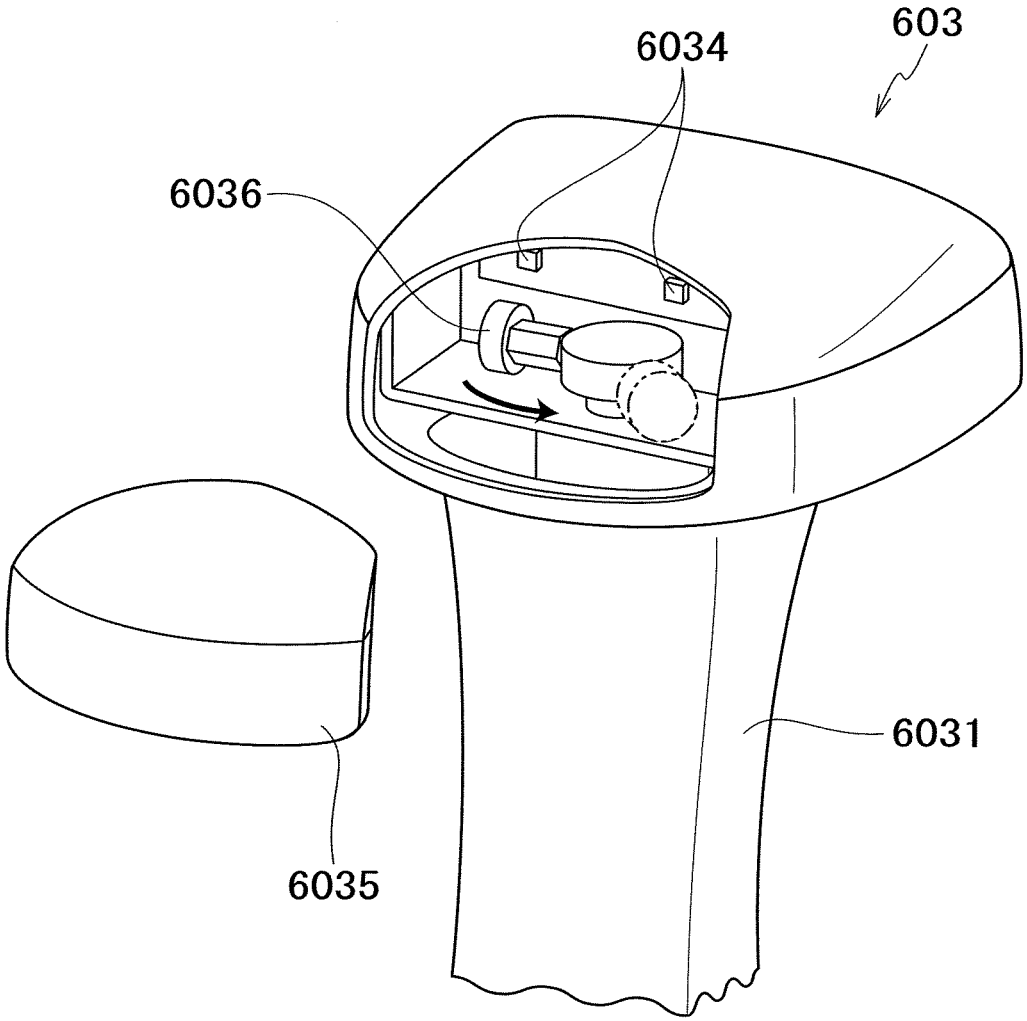
FIG. 8 is a partial exploded perspective view showing the control lever.

Now, referring to FIG. 7 and FIG. 8, the control lever 603 will be described. FIG. 7 is a schematic drawing showing the control lever 603 crosswise. As shown in FIG. 7, the control lever 603 includes a lever body (lever) 6031 that the player can grip, a vibration motor (first motor) 6032 which is provided in the lever body 6031 to vibrate the lever, a rotation motor (second motor) 6033 which is provided in the lever body 6031 to bias the lever 6031 in a predetermined rotation direction, and an LED (light emission unit) 6034 provided at an upper part of the lever body 6031.

The lever body 6031 is substantially T-shaped in cross section, and has at an upper part a light emitting portion in which the LED 6034 is stored and a gripped portion to be gripped by the player. The light emitting portion of the lever body 6031 is provided with a light-transmissive cover 6035 which allows light from the LED 6034 to pass through. At an upper part of the gripped portion, the vibration motor 6032 is stored. This vibration motor 6032 vibrates under the control of an unillustrated driver. Furthermore, the control lever 603 is arranged to be rotatable in forward and backward directions in the elevation view of the gaming terminal 10 (i.e. the directions indicated by the arrows in FIG. 7). The control lever 603 is provided with the rotation motor 6033 at a part inside the cabinet 11 below the gripped portion. The rotation motor 6033 provides torque in a rotation direction to the control lever 603 in a rotatable state, by an unillustrated driver.

In addition to the above, at the light emitting portion of the control lever 603, a pendulum component 6036 is provided to be coaxial with the vibration motor 6032 and rotate with the vibration motor 6032. FIG. 8 is a partial exploded perspective view showing the control lever 603. As shown in FIG. 8, the pendulum component 6036 is formed to partly protrude in a radial direction. The pendulum component 6036 is positioned to block at least a part of light emitted from the LED 6034 to the light-transmissive cover 6035. With this, rotating with the vibration motor 6032, the pendulum component 6036 changes the light emitted from the LED 6034 and running out through the light-transmissive cover 6035 in synchronization with the vibration motor 6032. In other words, as the protrusion of the pendulum component 6036 blocks or do not block the light from the LED 6034, the light viewed from the outside through the light-transmissive cover 6035 is changed.

As shown in FIG. 7, the control lever 603 is connected to a magnet 6201. The magnet 6201 rotates with the control lever 603 because it is connected to the rotation axis of the control lever 603. With this, the magnet 6201 changes an external magnetic field in accordance with the rotation of the control lever 603. Furthermore, as shown in FIG. 7, a magnetic force detecting mechanism 6202 is fixed to the vicinity of the magnet 6201. This magnetic force detecting mechanism 6202 includes a magnetic force sensor which outputs a magnetic force detection signal indicating the output intensity of the magnetic force and a sensor fixing mechanism which fixes the magnetic force sensor at a predetermined position. The magnetic force detecting mechanism 6202 is arranged to detect the magnetic force of the magnetic field generated by the magnet 6201 and changing in accordance with the rotation of the control lever 603.

(Lever Position Determining Table)

FIG. 9 shows a lever position determining table used for associating the lever positions with detected magnetic forces. The lever position determining table has a lever position field and a detected magnetic force field. Each time the gaming terminal 10 is activated, the table is updated in a later-described RAM 43. More specifically, the lever position field stores lever positions indicating the angles of the control lever 603. The detected magnetic force field stores the magnetic forces detected by the magnetic force detecting mechanism 6202, when the control lever 603 is at the respective lever positions.

More specifically, when the gaming terminal 10 is activated, the control lever 603 is rotated by the rotation motor 6033 from the starting point to the ending point, while the magnetic force detecting mechanism 6202 detects the magnetic forces at the respective positions. As such, the magnetic forces of the control lever 603 at the respective positions are detected, and the lever position determining table in which the positions are associated with the magnetic forces at the respective positions is updated. For example, in the case of FIG. 9, the detected magnetic force at the starting point is "ND78", whereas the detected magnetic force at the ending point is "ND126". Therefore, in the movable range of the control lever 603, the magnetic force varies within the range of "ND78" to "ND126". In other words, it is possible to specify the position (angle) of the control lever 603 by reading out a detected magnetic force.

(Electric Configuration of Gaming Machine 300)

Figure 10:
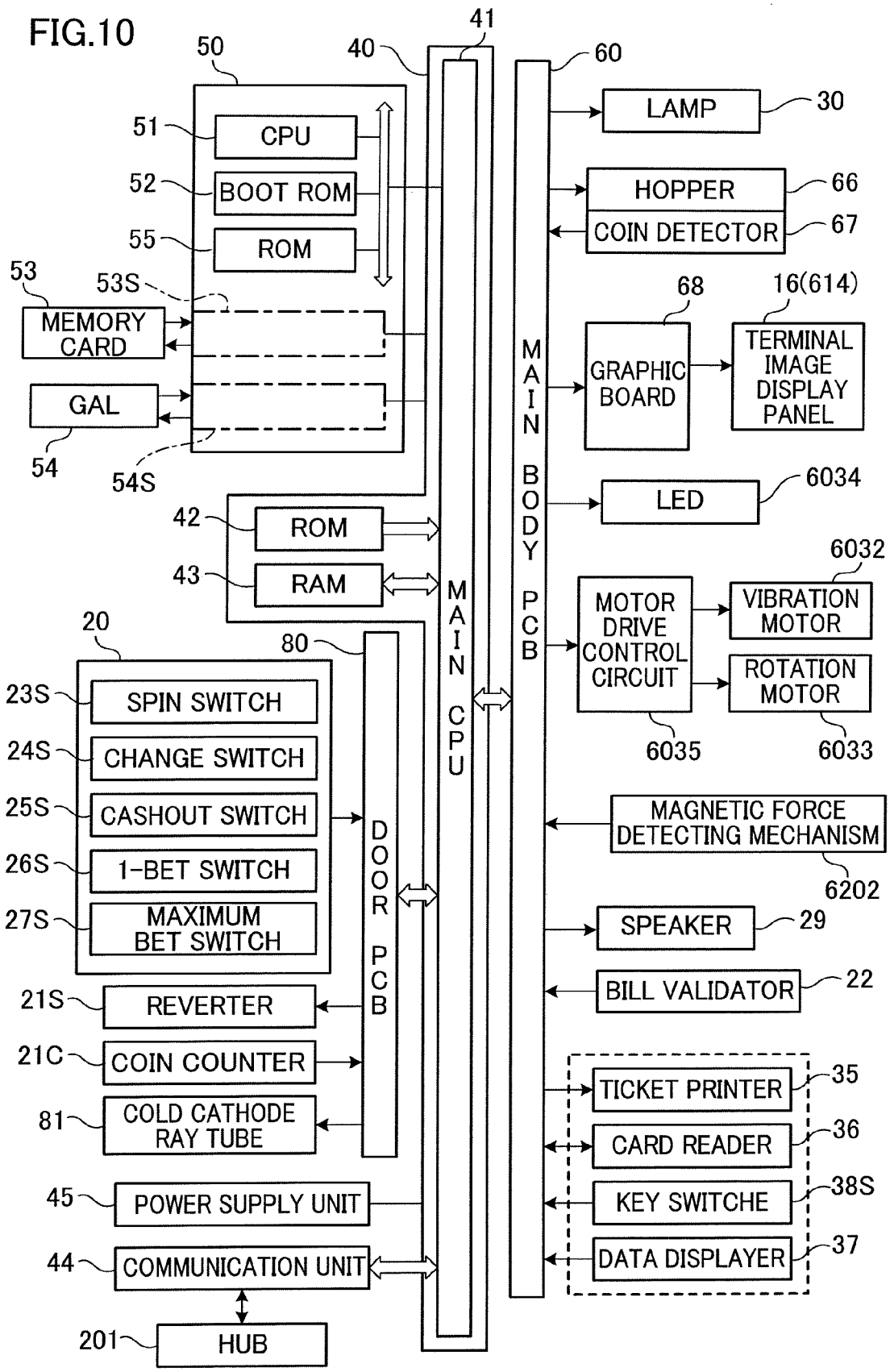
FIG. 10 is a block diagram of a control circuit of the terminal controller.
Figure 11:
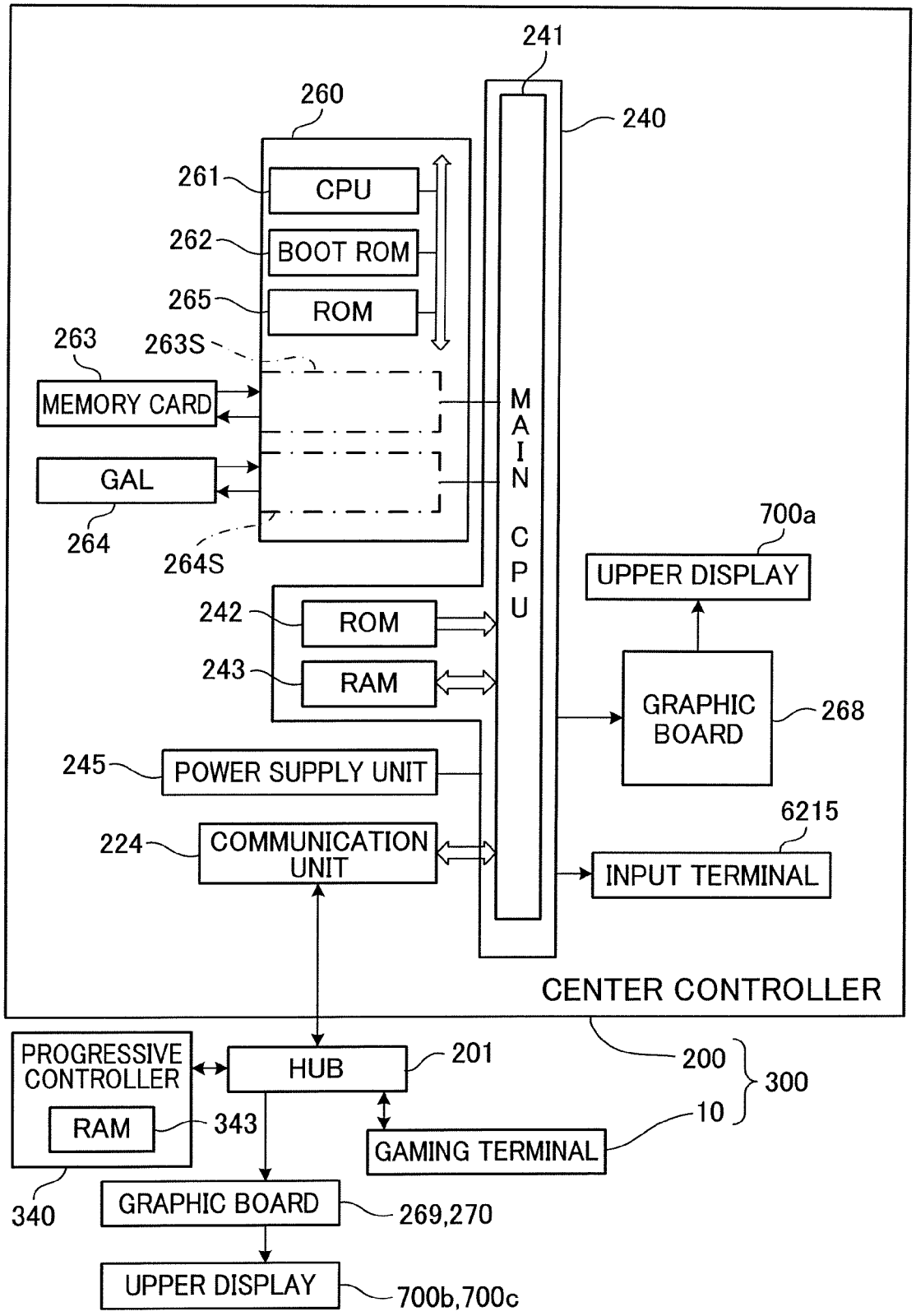
FIG. 11 is a block diagram of a control circuit of the center controller.

FIGS. 10 and 11 are block diagrams each illustrating an electric configuration of the entire gaming machine 300.

(Electric Configuration of Gaming Terminal 10)

FIG. 10 is a block diagram illustrating an electric configuration of each of the gaming terminals 10. As illustrated in FIG. 10, the cabinet 11 includes a control unit having a terminal controller 630. The control unit includes a motherboard 40, a main body PCB (Printed Circuit Board) 60, a gaming board 50, a door PCB 80, various switches, sensors, or the like, as shown in FIG. 10.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the display windows 150. This stop symbol determining program contains sets of symbol weighting data respectively corresponding to various payout ratios (e.g., 80%, 84%, 88%). Each set of the symbol weighting data indicates, for each of the video reels 151 to 155, a code number of each symbol and at least one random number allotted to the code number. The numerical value is a value within a predetermined range of 0 to 256 for example.

The payout ratio is determined based on payout ratio setting data output from the GAL 54. Based on a set of the symbol weighting data corresponding to the payout ratio determined, a symbol to be stopped is determined.

The memory card 53 stores therein various types of data for use in the game programs and the game system programs. For example, the memory card 53 stores a table listing combinations of a symbol 501 to be displayed on the video reels 151 to 155 and an associated range of random numbers. This data is transferred to the RAM 43 of the motherboard 40, at the time of running a game program.

The card slot 53S is structured so as to allow the memory card 53 to be attached/detached to/from the card slot 53S. This card slot 53S is connected to the motherboard 40 through an IDE bus. Thus, a type and contents of a game run at the gaming terminal 10 can be changed by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a common game. Each of the game programs includes image data and audio data output during the game.

The GAL 54 has input ports and output ports. When the GAL 54 receives data via an input port, it outputs data corresponding to the input data from its output port. This data from the output port is the payout ratio setting data described above.

IC socket 54S is structured so as to allow the GAL 54 to be attached/detached to/from the IC socket 54S. The IC socket 54S is connected to the motherboard 40, via a PCI bus. Thus, the payout ratio setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 630), a ROM (Read Only Memory) 42, a RAM (Random Access Memory) 43, and a communication unit 44.

The main CPU 41 serves as a terminal controller 630 and has a function of controlling the entire gaming terminal 10. In particular, the main CPU 41 controls the following operations: an operation of outputting an instruction signal instructing variable-displaying of symbols 501 to the graphic board 68, which is performed in response to pressing of the spin button 23 after betting of credit; an operation of determining symbols 501 to be stopped after the variable-displaying of symbols 501; and an operation of stopping the symbols 501 thus determined in the video reels 151 to 155.

In other words, the main CPU 41 serves as an arrangement controller which arranges symbols to form a new symbol matrix through scrolling of symbols displayed on the terminal image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication unit 44 is provided to communicate with a host computer or the like equipped in the gaming facility, through a communication line. The communication unit 44 is also for communicating with the center controller 200 and the progressive controller 340 through a hub 201 and a communication line. Further, a main body PCB (Printed Circuit Board) 60 and a door PCB 80 are connected to the motherboard 40, through USB (Universal Serial Bus). Further, the motherboard 40 is connected to a power supply unit 45. The power supply unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by control signals from the main CPU 41. Based on a signal input to the main CPU 41, the main CPU 41 runs the game program and the game system program stored in the RAM 43, to perform a calculation process. Then, the CPU 41 stores the result of the arithmetic process in the RAM 43, or transmits a control signal to the various devices and units to control them based on the result.

The main body PCB 60 is connected with the lamp 30, a hopper 66, a coin detector 67, the graphic board 68, the speaker 29, the bill validator 22, the ticket printer 35, the card reader 36, a key switch 38S, and the data displayer 37.

The lamp 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin detector 67 is provided inside the coin outlet 19, and outputs a signal to be input to the main CPU 41 upon sensing that a predetermined number of coins have been delivered from the coin outlet 19.

The graphic board 68 controls image displaying of the terminal image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on a bill and takes only those recognized as genuine into the cabinet 11. When taking in a genuine bill, the bill validator 22 outputs an input signal indicating the value of the bill to the main CPU 41. The main CPU 41 stores into the RAM 43 a credit amount corresponding to the value of the bill indicated by the signal.

Based on a control signal from the main CPU 41, the ticket printer 35 prints on a ticket a barcode and outputs the ticket as a barcoded ticket 39. The barcode is encoded data containing the credit amount stored in the RAM 43, date and time, and the identification number of the gaming terminal 10.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the keypad 38.

The door PCB 80 is connected to the control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-bet switch 26S associated with the 1-bet button 26; and a maximum bet switch 27S associated with the maximum bet button 27. Each of the switches 235 to 27S outputs an input signal to the main CPU 41 when corresponding one of the buttons 23 to 27 is operated by a player.

The coin counter 21C is provided within the coin receiving slot 21, and identifies whether the coin inserted into the coin receiving slot 21 by the player is genuine. A coin except the genuine coin is discharged from the coin outlet 19. In addition, the coin counter 21C outputs an input signal to the main CPU 41 upon detection of a genuine coin.

The reverter 21S operates based on a control signal from the main CPU 41, and delivers coins that are recognized as genuine by the coin counter 21C into a not-shown cash box or hopper 66 in the gaming terminal 10. In other words, when the hopper 66 is full of the coins, the genuine coin is distributed into the cash box by the reverter 21S. On the other hand, when the hopper 66 is not yet full of the coins, the genuine coin is distributed into the hopper 66. The cold cathode tube 81 functions as a backlight mounted to rear sides of the terminal image display panel 16 and the upper image display panel 33. This cold cathode tube 81 turns on according to a control signal from the main CPU 41.

In addition to the above, the main Body PCB 60 is connected to a motor drive control circuit 6035. The motor drive control circuit 6035 controls the rotation of the vibration motor 6032 and the rotation motor 6033. The main Body PCB 60 is connected to the LED 6034. The main Body PCB 60 controls light emission from the LED 6034. Furthermore, the main Body PCB 60 is connected to the magnetic force detecting mechanism 6202. This magnetic force detecting mechanism 6202 detects, as described above, a magnetic force indicating a position of the lever body 6031 of the control lever 603 and sends a magnetic force signal to the main Body PCB 60.

(Electric Configuration of Center Controller 200)

FIG. 11 is a block diagram illustrating an electric configuration of the center controller 200. The center controller 200 is provided therein with a control unit. As illustrated in FIG. 11, the control unit includes a RAM 243 (memory for storing a bet amount), a motherboard 240, a gaming board 260, an actuator, or the like. The center controller 200 is connected, through a hub 201, graphic boards 269 and 270, each gaming terminal 10, and a progressive controller 340 including a RAM 343.

The gaming board 260 has the same structure as that of the gaming board 50. The motherboard 240 has the same structure as that of the motherboard 40. The communication unit 244 communicates with the terminal controller 630 through a communication line.

The graphic board 268 has the same structure as that of the graphic board 68, except in that the graphic board 268 controls displaying of the upper display 700*a* based on a control signal from the main CPU 241. In other words, the graphic board 268 functions as the display controller 701*a*. Furthermore, the graphic board 268 outputs a control signal to the graphic boards 269 and 270 controlling the upper displays 700*b* and 700*c*, via the communication unit 224, the hub 201, and the communication line. In other words, the graphic boards 269 and 270 function as the display controllers 701*b* and 701*c*.

(Basic Game)

Now, a basic game independently run in each gaming terminal 10 will be described. In the present embodiment, the basic game (first game) awards a payout based on a combination of symbols 501 rearranged on the video reels 151 to 155 of the terminal image display panel 16. Games that are awarded when a predetermined condition is satisfied in the basic game are a bonus game, a bait bonus, a quick catch bonus game (second game), and a common game (third game). The bonus game, the bait bonus, and the quick catch bonus game are run in each gaming terminal 10 independently of other gaming terminals 10. On the other hand, the common game is run by synchronized gaming terminals each having sufficient game qualification time, and awards a payout to a gaming terminal based on a game result. The bait bonus is a game in which a fixed payout is awarded at a constant probability. While the common game is described as a third game, the third game includes not only a later-described progressive bonus game but also effects in the progressive bonus game.

(Symbols, Combinations, and the Like)

Figure 12:
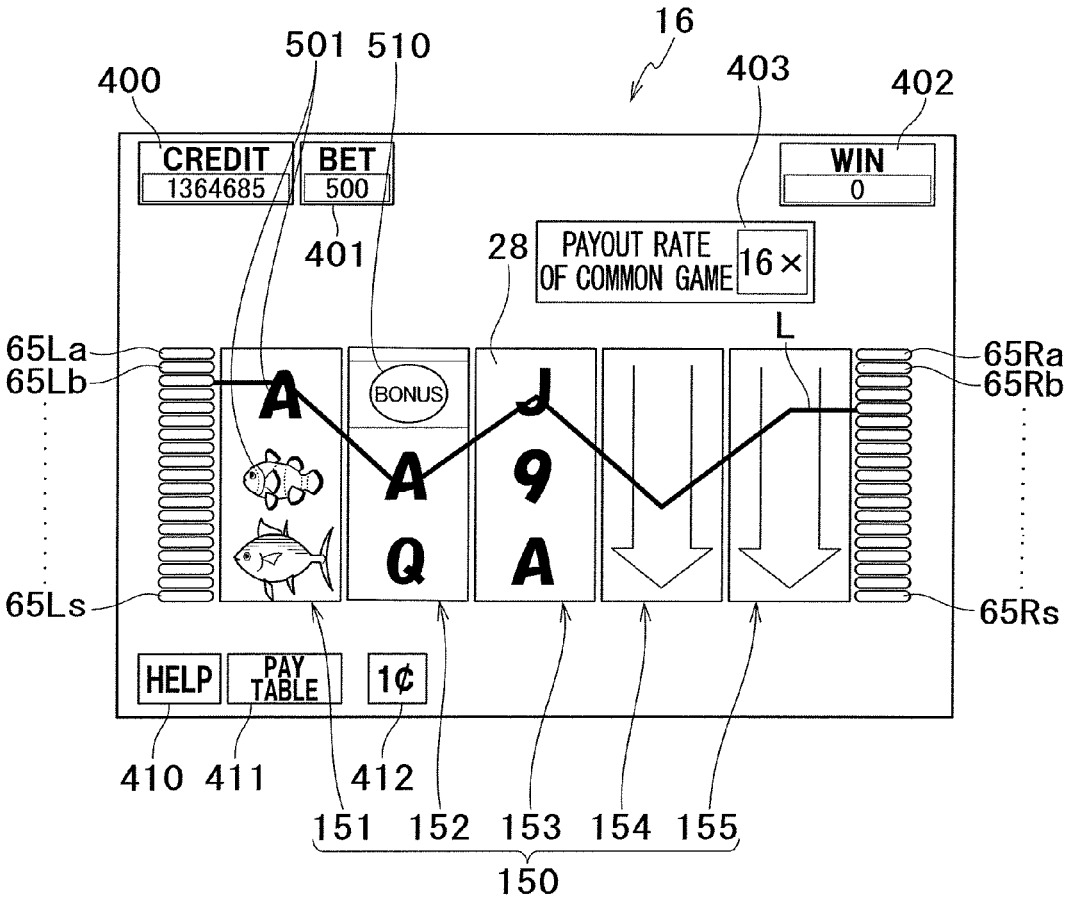
FIG. 12 shows an example of a display screen of a basic game.

The symbols 501, which are displayed on video reels 151 to 155 of the terminal image display panel 16 on which a basic game is displayed, form a symbol column. As shown in FIG. 12, the terminal image display panel 16 displays a display window 150 which is constituted by video reels 151 to 155. The display window 150 is constituted by 15 display blocks 28 of 5 columns and 3 rows. Each of the video reels 151 to 155 is therefore constituted by three display blocks 28. Each of the video reels 151 to 155 rearranges the symbols 501 in such a way that three display blocks 28 are moved (scrolled) downward while changing the speed and the vertically moved symbols 501 are then stopped.

At the left and right edges of the display window 150, payline occurrence columns are provided in a symmetrical manner on the left and right. The left payline occurrence column on the left side when viewed from the player has, as shown in FIG. 12, 19 payline occurrence parts 65L (65La, 65Lb, 65Lc, 65Ld, 65Le, 65Lf, 65Lg, 65Lh, 65Li, 65Lj, 65Lk, 65L1, 65Lm, 65Ln, 65Lo, 65Lp, 65Lq, 65Lr, and 65Ls).

The right payline occurrence column on the right side when viewed from the player has 19 payline occurrence parts 65R (65Ra, 65Rb, 65Rc, 65Rd, 65Re, 65Rf, 65Rg, 65Rh, 65Ri, 65Rj, 65Rk, 65R1, 65Rm, 65Rn, 65Ro, 65Rp, 65Rq, 65Rr, and 65Rs).

The left payline occurrence parts 65L form pairs with the respective right payline occurrence parts 65R. From the left payline occurrence parts 65L to the right payline occurrence parts paired with the left payline occurrence parts 65L, paylines L are defined in advance. Note that, although FIG. 12 only shows one payline L for the sake of simplicity, there are ten paylines L in the present embodiment.

A payline L is activated when left and right payline occurrence parts 65L and 65R are connected with each other. In other cases, the paylines are inactive. The number of activated paylines L is determined based on a bet amount. When the bet amount is maximum, i.e., MAXBET, the upper limit of, i.e. 10 paylines are activated. An activated payline L allows the symbols 501 to establish various types of winning combinations. Details of the winning combinations will be described later.

The present embodiment presupposes that the gaming terminal 10 is a so-called video slot machine. The gaming terminal 10 of the present invention, however, may use so-called mechanical reels as some of the video reels 151 to 155.

As shown in FIG. 13, one of code numbers 0 to 19 or more is assigned to each of the symbols 501 constituting each symbol column. Each symbol column is a combination of symbols 501 which are "specific symbol 510", "A", "Q", "Angelfish", "Clownfish", "Tuna", and "Coelacanth".

Three successive symbols 501 in each of the symbol columns are, as shown in FIG. 12, respectively displayed (arranged) on an upper stage, a central stage, and a lower stage of each of the display region of each of the video reels 151 to 155, to form a symbol matrix of five columns and three rows on the display windows 150. When at least the start button 23 is pressed or the control lever 603 is pressed or moved to start a game, the symbols 501 forming a symbol matrix start scrolling. This scrolling of the symbols 501 stops (rearrangement) after a predetermined period elapses from the beginning of the scrolling (rearrangement).

Various kinds of winning combinations are set in advance for each symbol 501. The term "winning combination" indicates that a winning is established. A winning combination is a combination of stopped symbols 501 on the payline L which puts the player in an advantageous state. Examples of an advantageous state include: a state where coins according to a winning combination is paid out, a state where the number of coins to be paid out is added to a credit, a state where a bonus game is started.

A winning combinations in the present embodiment is established when a predetermined number or more of the symbols 501 of at least one type, namely "A", "Q", "J", "K", "BAT", "Angelfish", "Clownfish", "Tuna", or "Coelacanth", are rearranged on an activated payline L. When a predetermined type of symbols 501 is set as scatter symbols, a winning combination is established when a predetermined number or more of scattered symbols are rearranged, no matter whether a payline L is active.

For example, in a basic game, when "BAT" symbols 501 forms a winning combination on a payline L, coins (values) calculated by multiplying the basic payout amount of "BAT" by the bet amount.

(Symbol Table)

FIG. 13 shows a symbol table which is used for determining which symbols 501 are targets of rearrangement in a basic game. In the symbol table, symbols 501 on the display blocks 28 in each symbol column are associated with code numbers, and 20 numerical ranges defined by dividing a numerical range of 0 to 65535 by 20 are associated with the respective code numbers.

The numerical range of 0 to 65535 may be equally or unequally divided. When unequally divided, it is possible to adjust the probabilities of wining for the respective types of the symbols 501 by determining the ranges of the random numbers. In this regard, the range corresponding to the specific symbol 510 may be arranged to be narrower than the ranges of the other types of the symbols 501. In this case, results of games can be easily adjusted in accordance of the progress of the games, by arranging valuable types of the symbols 501 to be less likely to be won.

For example, when a random number randomly selected for the first column is "10000", the symbol "J" having the code number 3 associated with the random number range including the selected random number is chosen as the target of rearrangement on the video reel 151 of the first column. On the other hand, when, for example, a random number for the fourth column is "40000", the specific symbol 510 having the code number 12 associated with the random number range including the selected random number is chosen as the target of rearrangement on the video reel 151 of the fourth column.

(Basic Game: Bonus Game Screen)

FIG. 12 shows an example of a basic game screen which is a display screen in case of basic game on the terminal image display panel 16.

More specifically, the basic game screen has a display window 150 which is provided at the central portion and has 5 columns of video reels 151 to 155 and payline occurrence parts 65L and 65R which is symmetrically provided to the left and right of the display window 150. On the basic game screen shown in FIG. 12, the video reels 151, 152, and 153 of the first to third columns are stopped whereas the video reels 154 and 155 of the fourth and fifth columns are scrolling.

At the upper parts of the terminal image display panel 16, a credit amount display unit 400 and a bet amount display unit 401 are provided on the left whereas a payout display unit 402 is provided on the right.

The credit amount display unit 400 displays credit amounts. The bet amount display unit 401 displays a bet amount on the currently-running unit game. The payout display unit 402 display the number of coins to be paid out when a winning combination is established.

In the meanwhile, below the display window 150, a help button 410, a pay-table button 411, and a unit-of-betting display unit 412 are provided. These sections 410, 411, and 412 are provided in this order from left to right for the player.

The help button 410 is pushed by the player so that a help mode is executed. The help mode is a mode for providing information to solve player's questions concerning games. The pay-table button 411 is pushed by the player so that a payout display mode for displaying the details of a payout is executed. The payout display mode is a mode for displaying an explanation screen explaining a relation between a winning combination and a payout rate for the player.

The unit-of-betting display unit 412 displays a current bet unit (payout unit). The unit-of-betting display unit 412 therefore allows the player to recognize that, for example, the unit of betting is one cent.

Above the display window 150 is provided a payout rate display unit 403. The payout rate display unit 403 is displayed when the player is qualified to participate in a common game, and is not displayed when the player is not qualified. That is to say, when a common game starts, the player can participate in the common game if the payout rate display unit 403 is displayed. T payout rate display unit 403 displays a payout rate by which a unit payout amount obtained in a common game is multiplied.

Now, the payout rate indicating that the player is qualified will be described. A qualification is awarded to a gaming terminal 10 as a time during which the player is allowed to participate in a common game (i.e., game qualification time), in response to betting on a basic game. Regarding the awarded game qualification time, a payout rate corresponding to each unit time (1 second in the present embodiment) is determined in advance in the base game qualification time awarding table.

(Base Game Qualification Time Awarding Table)

FIG. 14 shows a base game qualification time awarding table which is referred to when a common game qualification time is awarded in a basic game. The base game qualification time awarding table is stored in the RAM 243 of the center controller 200. In the base game qualification time awarding table, game qualification time awarded in a basic game and payout rates are determined for each of the number of paylines L activated in accordance with a bet amount.

For example, when the number of activated paylines L corresponding to the betting on a basic game is one, six seconds are awarded as the common game qualification time. The payout rate is therefore one for six seconds of the game qualification time. For example, when the number of activated paylines L corresponding to the betting on a base game is five, five seconds are awarded as the game qualification time. The payout rate is therefore five for five seconds of the game qualification time. As such, the number of activated paylines increases as the bet amount increases in a basic game, and an awarded game qualification time and a payout rate also increase. It is noted that the maximum payout rate in the present embodiment is ten.

(Game Qualification Time Management Table)

The game qualification times of the respective gaming terminals 10 are managed by a game qualification time management table which is temporarily stored in the RAM 243. FIG. 15 shows a game qualification time management table which is updated when a game qualification time is awarded. In the game qualification time management table, an awarded game qualification time and a payout rate are accumulatively stored for each gaming terminal 10.

For example, the game qualification time of the gaming terminal 10*a* is six seconds for the payout rate of one, 12 seconds for the payout rate of two, 18 seconds for the payout rate of three, and six seconds for the payout rate of four. When the gaming terminal 10*a* with this arrangement participates in a common game and a unit payout amount is awarded, the payout is calculated by multiplying the unit payout amount by the highest payout rate, i.e. four. The payout rate display unit 403 of the gaming terminal 10*a* therefore displays "4x" which indicates that the payout rate is four.

It is noted that, from the game qualification time corresponding to the highest payout rate, a unit time is subtracted each time a predetermined time (one second in the present embodiment) elapses. Therefore, when no common game qualification time is awarded to the gaming terminal 10*a* within the first six seconds corresponding to the payout rate of four, the maximum payout rate becomes three.

(Maximum Qualification Time Table)

In addition to the above, the upper limit of the game qualification time that the gaming terminal 10 can accumulatively store is defined in the maximum qualification time table in advance. The maximum qualification time table is stored in the RAM 243 of the center controller 200. As shown in FIG. 16, in the maximum qualification time table, a payout rate N is associated with the upper limit of the accumulation of the game qualification time of the payout rate or higher.

In other words, the total game qualification time is set to be 40 seconds or shorter. The upper limit is not limited to this. For example, the upper limit may be 60 seconds or may be differently set for respective payout rates.

(Accumulation Calculation Table)

When a game qualification time is awarded, with reference to the above-described maximum qualification time table, a calculation for updating the game qualification time management table is carried out by using the accumulation calculation table. The accumulation calculation table is stored in the RAM 243 of the center controller 200. As shown in FIG. 17, the accumulation calculation table stores the following matters for each payout rate. That is to say, "before-awarded common game qualification time" of the game qualification time management table, "to-be-awarded game qualification time" of the base game qualification time awarding table in accordance with an activated payline, "awarded game qualification time" calculated by adding the before-awarded game qualification time to the to-be-awarded game qualification time, "accumulation of awarded game qualification time" of all payout rates, "accumulation upper limit of qualification time" of payout rate set in the maximum qualification time table, "value exceeding the accumulation upper limit of qualification time", and "value calculated by subtracting the value exceeding the accumulation upper limit of qualification time" calculated by subtracting the value exceeding the accumulation upper limit of qualification time from the accumulation of awarded game qualification time of all payout rates.

For example, when a bet is made so that the before-awarded common game qualification time is 0 second for the payout rate of five or more, six seconds for the payout rate of four, 16 seconds for the payout rate of three, 14 seconds for the payout rate of two, and two seconds for the payout rate of one, and the number of paylines L is three, in the common game qualification time five seconds are added to the time for the payout rate of three. In this case, the awarded game qualification time is arranged so that six seconds for the payout rate of four, 21 seconds for three, 14 seconds for two, and two seconds for one. As a result, the accumulation of the qualification times of N or higher is arranged so that six seconds for the payout rate of four or higher, 27 seconds for three or higher, 41 seconds for two or higher, and 43 seconds for one or higher.

However, the maximum qualification time table defines the upper limit of the accumulation of the game qualification time as 40 seconds. In case of exceeding this upper limit, a value exceeding the upper limit is calculated as "value exceeding the accumulation upper limit of qualification time" corresponding to the payout rate. For example, the qualification time of the payout rate of two or more is 41 seconds, and this exceeds the upper limit of 40 seconds by one second. Therefore "value exceeding the accumulation upper limit of qualification time" is one second. The accumulated qualification time of the payout rate of one or more is 43 seconds and this exceeds the upper limit of 40 seconds by three seconds. However, because "awarded game qualification time" corresponding to the payout rate of one or more is only two seconds, "value exceeding the accumulation upper limit of qualification time" in this case is two seconds.

Thereafter, "value calculated by subtracting the value exceeding the accumulation upper limit of qualification time" calculated by subtracting "value exceeding the accumulation upper limit of qualification time" from "accumulation of awarded game qualification time" is stored. For example, "value calculated by subtracting the value exceeding the accumulation upper limit of qualification time" is 0 second for the payout rate of five or more, six seconds for the payout rate of four, 21 seconds for the payout rate of three, 13 seconds for the payout rate of two, and 0 second for the payout rate of one. The game qualification time management table is updated with the calculation results above.

(Basic Quick Catch Bonus Payout Table and Special Quick Catch Bonus Payout Table)

Now, the basic quick catch bonus payout table and the special quick catch bonus payout table shown in FIG. 18 and FIG. 19 will be described. A quick catch bonus game occurs at a probability of 1/80, when, as a result of a basic game run in the gaming terminal 10, no specific symbol 510 stops in the display blocks 28 of the video reel 153 and no bait bonus is awarded. As detailed later, when winning this quick catch bonus game, a benefit is awarded as a result of random selection with reference to the basic quick catch bonus payout table or the special quick catch bonus payout table. The basic quick catch bonus payout table and the special quick catch bonus payout table are stored in the RAM 243 of the center controller 200.

In the basic quick catch bonus payout table, a winning probability corresponding to the type of the benefit is determined in advance for each number of paylines L activated based on a bet amount. For example, when the number of paylines activated by one bet is one, game qualification time corresponding to one bet is awarded at a winning probability of 311/18038. More specifically, with reference to a base game qualification time awarding table shown in FIG. 14, the player is awarded the game qualification time of five seconds corresponding to the payout rate of one, which corresponds to one activated payline. In the meanwhile, when the number of paylines activated by five bets is five, game qualification time corresponding to five bets is awarded at a winning probability of 311/18038. More specifically, with reference to the base game qualification time awarding table of FIG. 14, the player is awarded the game qualification time of five seconds corresponding to the payout rate of five, which corresponds to five activated paylines.

Now, the special quick catch bonus payout table will be described. A winning probability in the special quick catch bonus payout table is calculated by adding, to a winning probability in the basic quick catch bonus payout table, a value calculated by multiplying a predetermined value (which is 80/18038 in the present embodiment but may be suitably changed according to design choice) by the above-described value exceeding the accumulation upper limit of qualification time. In other words, the special quick catch bonus payout table is a payout table which is updated according to need based on the value exceeding the accumulation upper limit of qualification time which is calculated when the game qualification time exceeds the upper limit.

To provide details, an example of the special quick catch bonus payout table will be described with reference to FIG. 19. The accumulation calculation table of FIG. 17 will be referred to in this example, too. For example, the accumulation calculation table stores "one second" as the value exceeding the accumulation upper limit of qualification time corresponding to the payout rate of two. In this case, a value calculated by multiplying, by 80/18038, "one second" which is the value exceeding the accumulation upper limit of qualification time corresponding to the payout rate of two is added to a winning probability corresponding to the item "game qualification time corresponding to two bets". As a result, a winning probability corresponding "game qualification time corresponding to two bets" and "one payline is activated" is "0+80/18038", "80" is stored in the item of the winning probability, a winning probability corresponding to "game qualification time corresponding to two bets" and "two paylines are activated" is "311/18038+80/18038" and "391" is stored in the item of the winning probability, a winning probability corresponding to the "game qualification time corresponding to two bets" and "three paylines are activated" is "0+80/18038" and "80" is stored in the item of the winning probability, a winning probability corresponding to the "game qualification time corresponding to two bets" and "five paylines are activated" is "0+80/18038" and "80" is stored in the item of the winning probability, and a winning probability corresponding to the "game qualification time corresponding to two bets" and "ten paylines are activated" is "0+80/18038" and "80" is stored in the item of the winning probability.

Furthermore, in the accumulation calculation table, "two seconds" is stored as a value exceeding the accumulation upper limit of qualification time payout rate corresponding to the payout rate of one. In this case, a value calculated by multiplying, by 80/18038, "two seconds" which is the value exceeding the accumulation upper limit of qualification time corresponding to the payout rate of one is added to a winning probability corresponding to the item "game qualification time corresponding to one bet". As a result, a winning probability corresponding "game qualification time corresponding to one bet" and "one payline is activated" is "311/18038+160/18038", "471" is stored in the item of the winning probability, a winning probability corresponding to "game qualification time corresponding to one bet" and "two paylines are activated" is "0+160/18038" and "160" is stored in the item of the winning probability, a winning probability corresponding to the "game qualification time corresponding to one bet" and "three paylines are activated" is "0+160/18038" and "160" is stored in the item of the winning probability, a winning probability corresponding to the "game qualification time corresponding to one bet" and "five paylines are activated" is "0+160/18038" and "160" is stored in the item of the winning probability, and a winning probability corresponding to the "game qualification time corresponding to one bet" and "ten paylines is activated" is "0+160/18038" and "160" is stored in the item of the winning probability.

(Basic Game: Bonus Game Screen)

Figure 20:
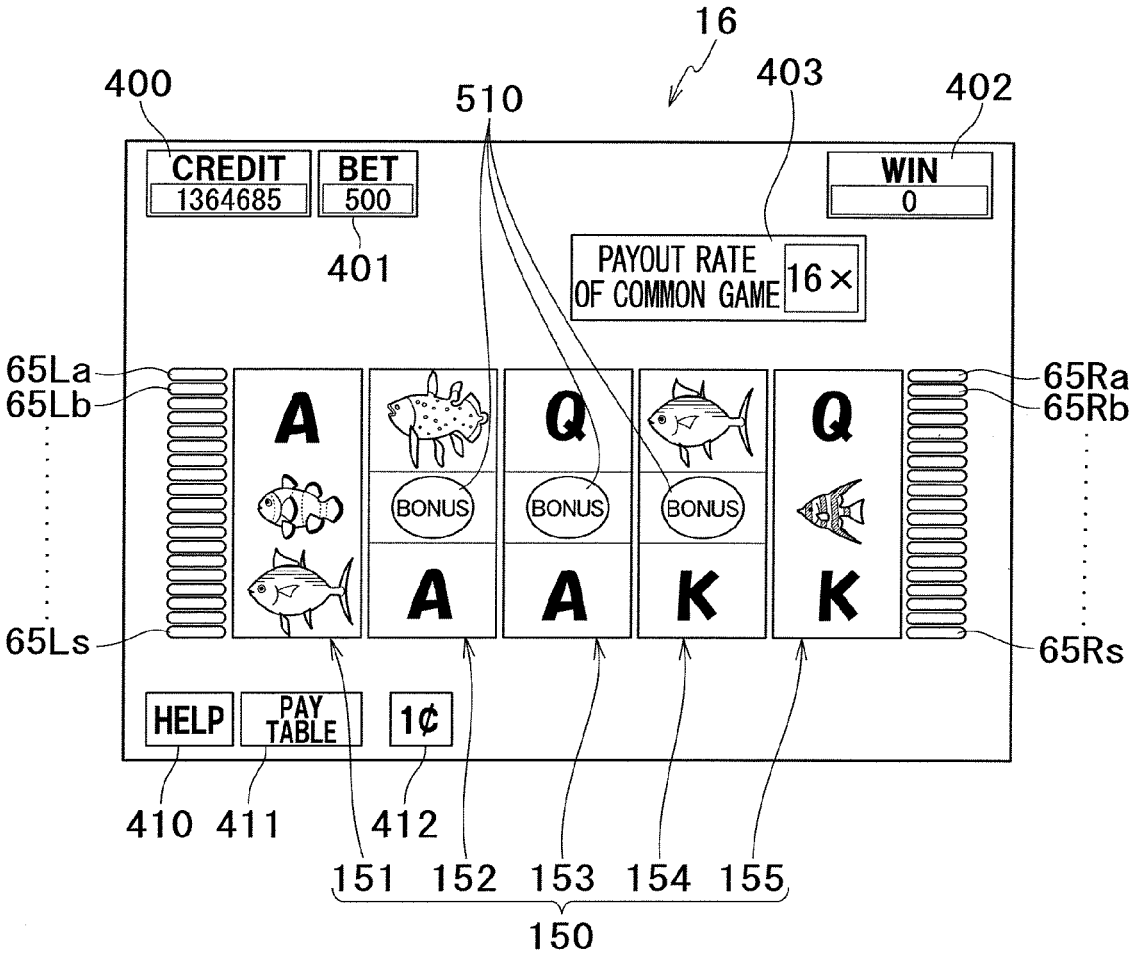
FIG. 20 shows an example of a display screen of a basic game.

FIG. 20 shows an example of a basic game screen on the terminal image display panel 16, when the start of an independent special game which is a bonus game is determined. In the basic game screen shown in FIG. 20, all of the video reels 151 to 155 in the first to fifth columns are stopped, and three symbols 501 of "specific symbol 510" are stopped at the central stages of the video reels 152 to 154 of the second to fourth columns. This triggers the start of an independent special game which is independently run by the gaming terminal 10. The stop mode of the specific symbols 510 triggering an independent special game is not limited to this. The trigger may be a predetermined number or more of "specific symbols 510" on one of the paylines L. Furthermore, the "specific symbols 510" may not be stopped on a payline. For example, a game may be triggered on condition that a predetermined number or more of specific symbols 510 are provided on any display blocks 28, based on the scatter symbol method.

Figure 21:
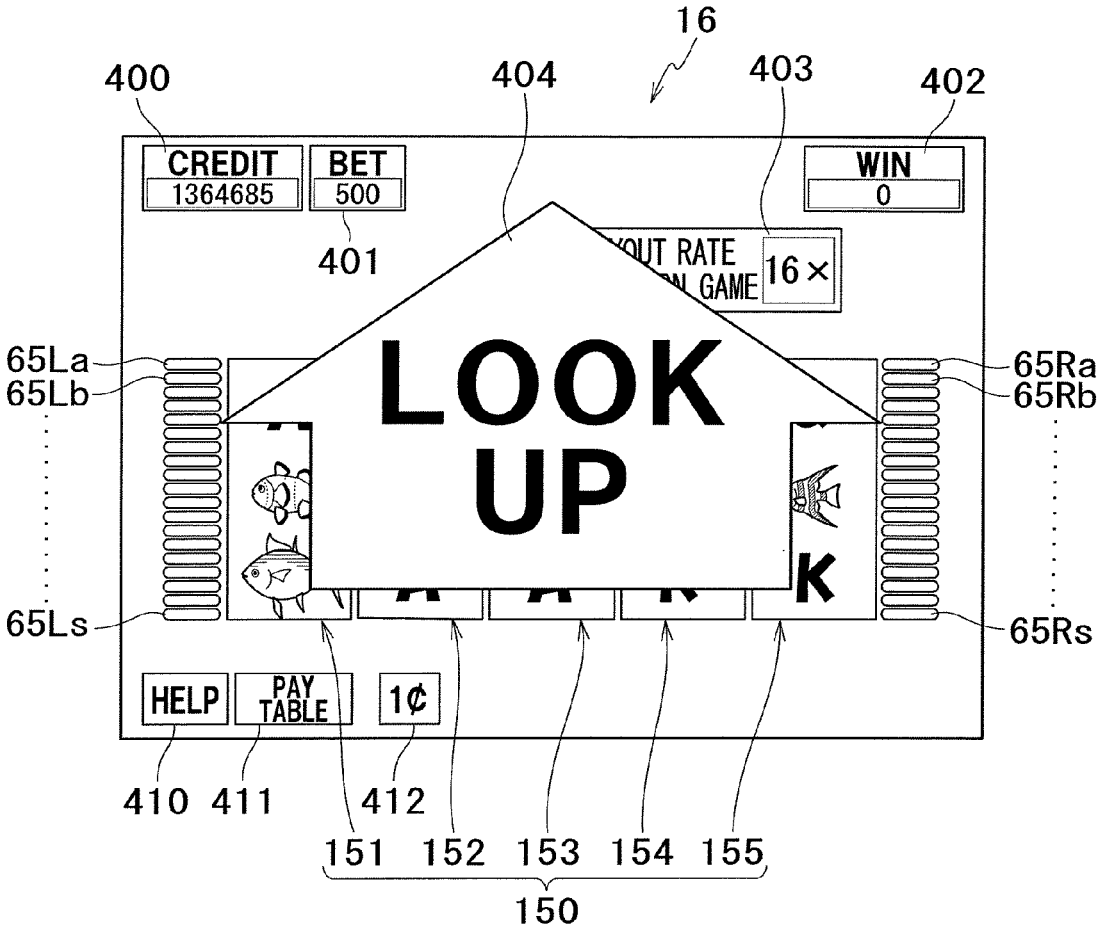
FIG. 21 illustrates a display state of a terminal image display panel and an upper display.

FIG. 21 illustrates the display states on the terminal image display panel 16 and the upper display 700 during the independent special game. During the independent special game, the terminal image display panel 16 displays a lookup display unit 404. As shown in FIG. 19, the lookup display unit 404 is displayed at the central part of the terminal image display panel 16, notifying the player that the terminal image display panel 16 is not used in the independent special game and the player is instructed to see the upper display 700.

In the present embodiment, the game qualification time is awarded as soon as the independent special game is started. The game qualification time awarded at the start of the independent special game is different from those defined in the base game qualification time awarding table (FIG. 14), the table used in this case is an independent special game qualification time awarding table shown in FIG. 22. According to the independent special game qualification time awarding table, the awarded common game qualification time is shortened but the payout rate is increased, as the number of activated paylines L is increased.

Figure 23:
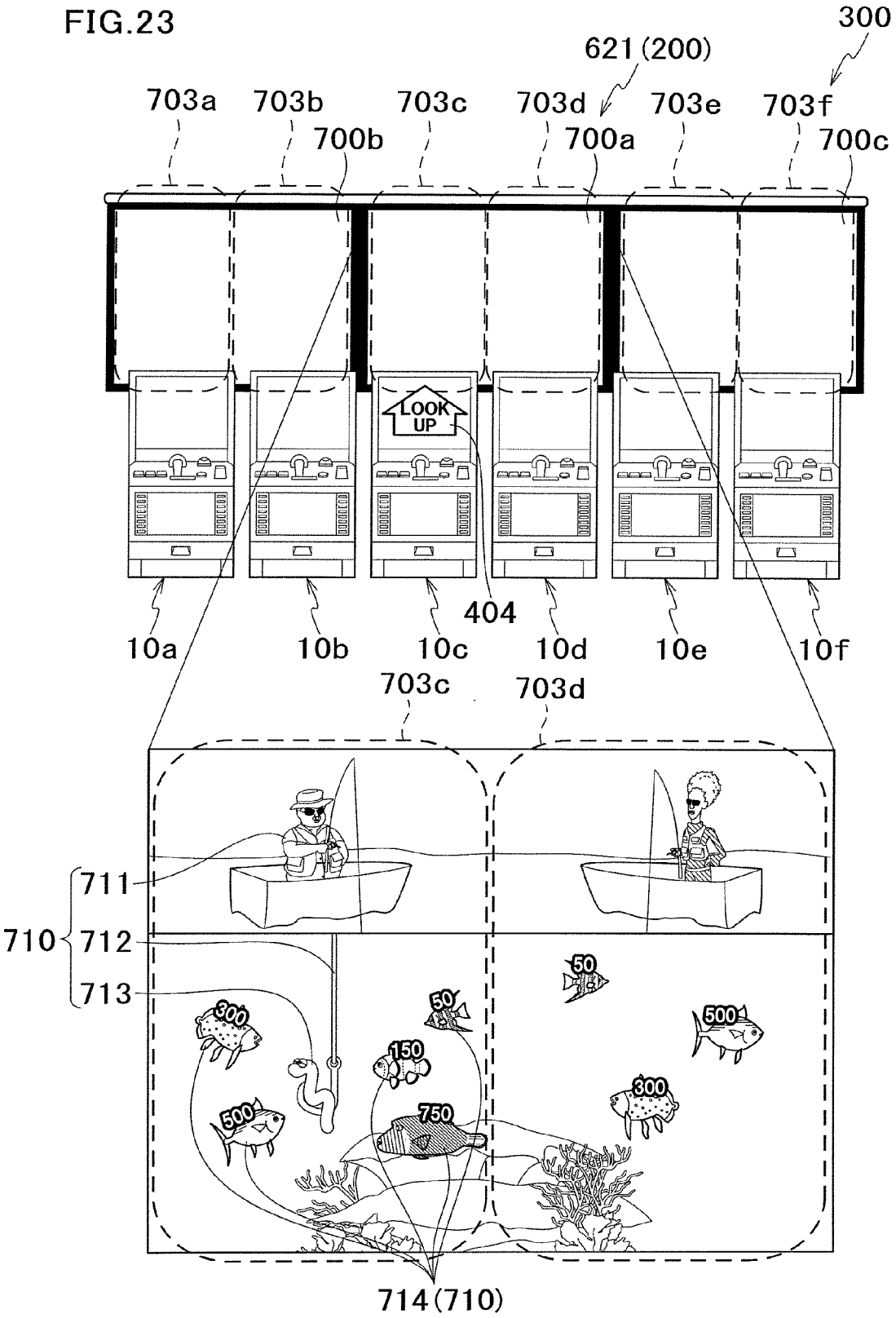
FIG. 23 illustrates a display state on the upper display during an independent special game.

FIG. 23 illustrates a display state on the upper display during an independent special game. The upper display 700 constituted by three upper displays 700*a*, 700*b*, and 700*c* is arranged to display a single common effect display screen. The common effect display screen is constituted by gaming terminal area 703*a* to 703*f* corresponding to the six gaming terminals 10*a* to 10*f*, respectively.

In FIG. 23, the gaming terminal 10*c* is running an independent special game, and the terminal image display panel 16 of the gaming terminal 10*c* is displaying the lookup display unit 404. In the independent special game, the gaming terminal area 703*c* corresponding to the gaming terminal 10*c* displays an individual image 710 for the independent special game.

More specifically, the individual image 710 includes a fisherman image 711, a fishhook image 712, a fishing bait image 713, and a fish image 714. The fisherman image 711 is displayed at an upper part of each of the gaming terminal areas 702*a* to 700*f*. The fisherman image 711 is different in each gaming terminal 10, to make it possible to understand how the gaming terminals 10 correspond to the respective gaming terminal areas 703*a* to 703 on the common effect display screen.

The fishhook image 712 is displayed substantially at the center of each of the gaming terminal areas 703*a* to 703*f* running an independent special game. The fishhook image 712 is displayed with a display pattern in accordance with the changes in the control lever 603. The fishing bait image 713 is displayed at the lower end portion of the fishhook image 712. The fishing bait image 713 is enlarged when a bonus corresponding to a predetermined unit payout amount (3000 in the present embodiment) or higher is won in an independent special game.

The fish image 714 corresponds to a bonus awarded in a bonus game. The fish image 714 indicates, by the size of the fish, a unit payout amount in a bonus game, and also the unit payout amount is indicated by a number. In the gaming terminal area 703 in which an independent special game is run, a plurality of fish images 714 are displayed and these fish images 714 approach the fishing bait image 713 or swim beside the fishing bait image 713.

(Bonus Type Table)

Now, referring to a bonus type table shown in FIG. 24, bonuses corresponding to fish images 714 will be described. The bonus type table stores bonus types, unit payout amounts, and ranks in association with one another. It is noted that the bonus type table is stored in both the RAM 43 of the gaming terminal 10 and the RAM 243 of the center controller 200.

For example, "Blue Marlin" corresponds to the unit payout amount of 10000 and is ranked at number one. Therefore, when the Blue Marlin is displayed on the gaming terminal area 703 as a fish image 714, the number "10000" is displayed with the fish image. Furthermore, when the unit payout amount is not lower than the predetermined amount (3000), the fishing bait image 713 is enlarged when the Blue Marlin is won.

(Independent Special Game Probability Table)

The payout amount of the independent special game is determined based on an independent special game probability table shown in FIG. 25. Though not illustrated, plural types of independent special game probability tables are stored, and which table is used is determined based on the number of paylines L activated at the start of the independent special game. In the independent special game probability table, random number ranges defined by dividing the numerical range of 0 to 65535 are associated with winning bonus types. In the winning bonus type, at least one bonus is stored. For example, when a random number is 250, the winning bonus types to be awarded are Wahoo, Black Seabass, and Halibut.

Figure 26:
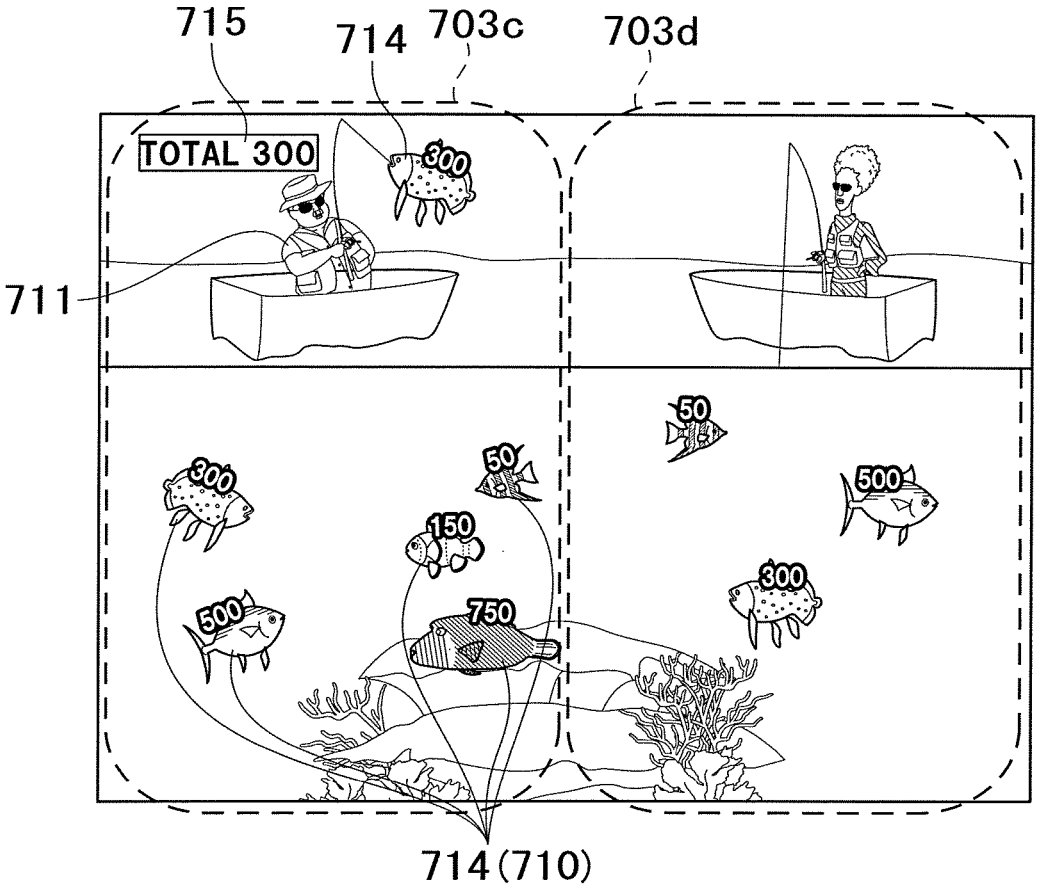
FIG. 26 shows an example of a display screen of an independent special game.

FIG. 26 shows an example of a winning screen displayed in an independent special game. On the winning screen, a display pattern in which a fisherman image 711 catches a fish image 714 is displayed. On the winning screen, moreover, a total display unit 715 is displayed at an upper part of the gaming terminal area 703. The total display unit 715 displays a total sum of bonuses having been won. The number displayed on the total display unit 715 in the end is the total amount of bonuses to be awarded. It is noted that the caught fish images 714 are displayed with sizes corresponding to the ranks defined in the bonus type table shown in FIG. 24. More specifically, a bonus type having a high rank is associated with a large unit payout amount, and the size of the caught fish image 714 is large.

In addition to the above, a mystery bonus is executed as a bonus game. The mystery bonus is not generated on condition that a predetermined number or more of specific symbols 510 are stopped as in the independent special game. The mystery bonus randomly starts when the specific symbol 510 is not stopped at the video reel 153 of the third column.

The random determination of the start of the mystery bonus is conducted based on a mystery bonus start random determination table shown in FIG. 25. In the mystery bonus start random determination table, random number ranges corresponding to "occurrence of mystery bonus", "effect only", and "non-occurrence of mystery bonus" are determined for each number of activated paylines L.

For example, when the number of paylines L is three and the determined random number is "2", an effect of mystery bonus is conducted and the mystery bonus is awarded as a payout. When the number of paylines L is three and the determined random number is "5", only an effect of mystery bonus is conducted. When the number of paylines L is three and the determined random number is "15", nothing is conducted and the basic game is continued.

When the mystery bonus occurs, a bonus to be won is determined with reference to a mystery bonus probability table shown in FIG. 28. Though not illustrated, plural types of mystery bonus probability tables are stored, and the table to be used is determined in accordance with the number of paylines L activated when the mystery bonus starts. In the mystery bonus probability table, random number ranges defined by dividing a numerical range of 0 to 5000 are associated with winning bonus types. In the winning bonus type, one or more bonus is stored.

Figure 29:
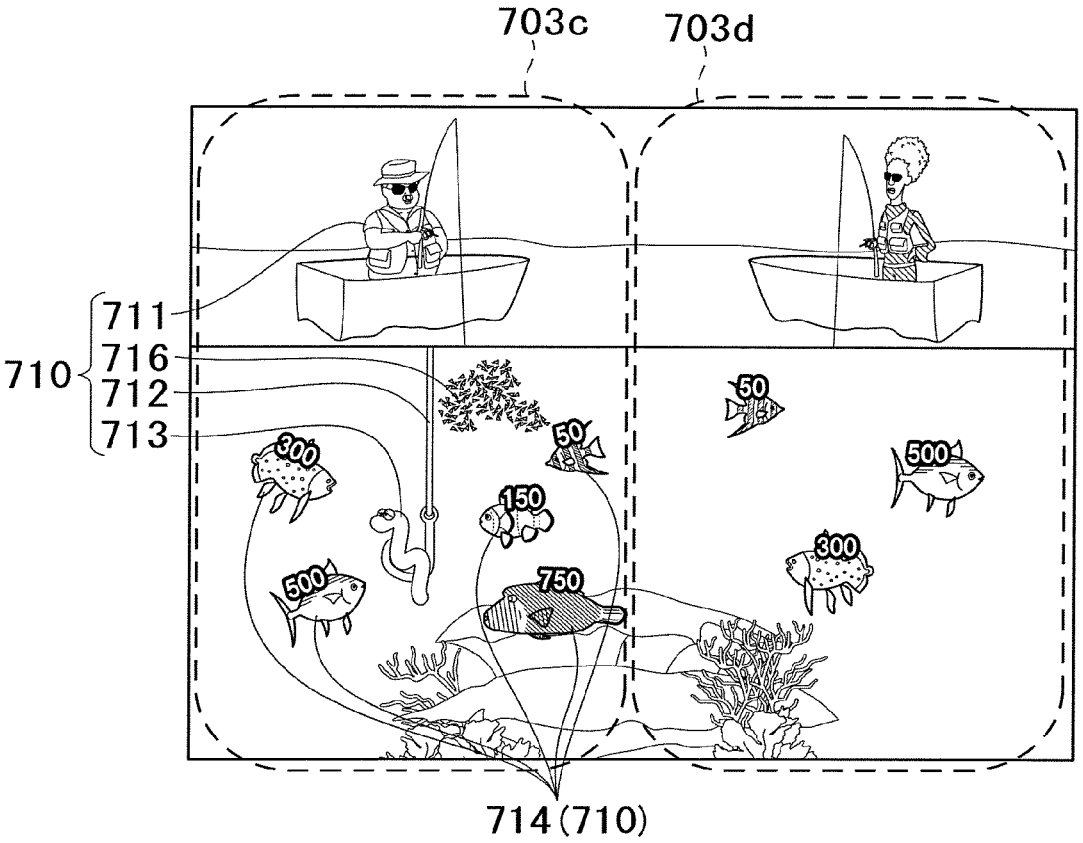
FIG. 29 shows an example of a display screen of a mystery bonus.

Whether the mystery bonus is started is determined with reference to the mystery bonus start random determination table and "occurrence" or "only effect" is selected, a mystery bonus effect screen shown in FIG. 29 is displayed. On the mystery bonus effect screen, a ground bait image 716 falling from an upper part to a lower part is displayed in the gaming terminal area 703 corresponding to the gaming terminal 10 which has been selected to display an effect screen. At the same time, in a similar manner as the independent special game, the terminal image display panel 16 displays a lookup display unit 404 shown in FIG. 21. Thereafter, if "occurrence" has been selected, a winning screen shown in FIG. 26 is displayed and the mystery bonus is finished.

Note that, when the condition to start a common game is established while the above-described independent special game and mystery bonus are being executed, the common game starts after the effect display, awarding of payout or the like of the independent special game and the mystery bonus are finished.

(Common Game)

Now, a common game run by a plurality of gaming terminals 10 in synchronization with one another will be described. In regard to a common game, random determination as to whether to start a common game is conducted at predetermined intervals (one second in the present embodiment), with reference to a common game start random determination table shown in FIG. 30.

(Common Game Start Random Determination Table)

As shown in FIG. 28, the common game start random determination table defines random number ranges corresponding to "occurrence of common game", "effect only", and "non-occurrence of common game", respectively. For example, when the determined random number is "1", a common game starts after an effect of the start of the common game. When the determined random number is "3", only the effect of the start of the common game is executed. When the determined random number is "15", nothing is conducted and the basic game is continued.

When the common game starts, which one of common games is to be run is determined with reference to a common game type random determination table shown in FIG. 31. More specifically, one of the following common games is randomly selected: a first common game; a second common game; a third common game; first common game+third common game; second common game+third common game; and progressive game.

(Common Game: Common Game Start Effect Image)

Figure 32:
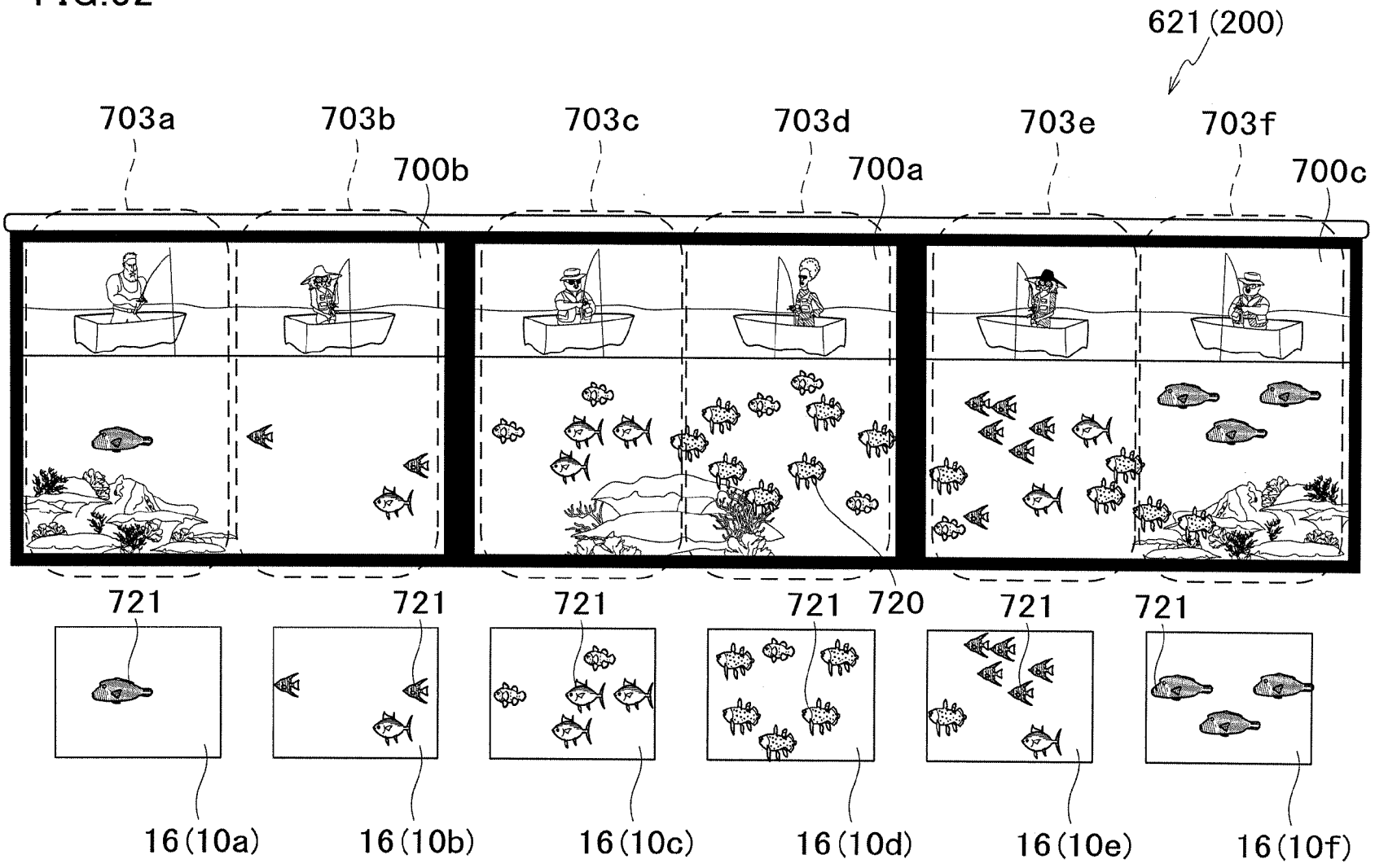
FIG. 32 illustrates an example of a common game start effect image.

After which one of the common games is to be run is determined, a common game start effect image corresponding to that common game is displayed. The common game start effect image is stored in the RAM 243 of the center controller 200. As shown in FIG. 32, the same common game start effect image is displayed on the upper display 700 and the terminal image display panel 16 of each of the six gaming terminals 10.

FIG. 32 shows the display states on the upper display 700 and the terminal image display panel 16 when the first common game starts. More specifically, the upper display 700 displays a game start effect image in which a fish school image 720 showing many fishes of plural types passing from left to right is displayed. On the upper display 700, furthermore, a fish school image 721 identical with those displayed on the respective gaming terminal areas 703*a* to 703*f* is displayed on the terminal image display panel 16 of each of the gaming terminals 10*a* to 10*f*.

For example, the game start effect image is divided to sets of data corresponding to the six gaming terminal areas 703, respectively. The center controller 200 distributes these sets of data to the respective gaming terminals 10, thereby allowing the upper display 700 and the terminal image display panels 16 to display the game start effect image in the same manner.

(Common Game: First Common Game Screen)

Now, each common game will be described. FIG. 31 illustrates the display state on the upper display 700 during the first common game. The upper display 700 constituted by three upper displays 700*a*, 700*b*, and 700*c* is arranged to display a single common effect display screen. The common effect display screen is constituted by gaming terminal area 703*a* to 703*f* corresponding to the six gaming terminals 10*a* to 10*f*, respectively.

Figure 33:
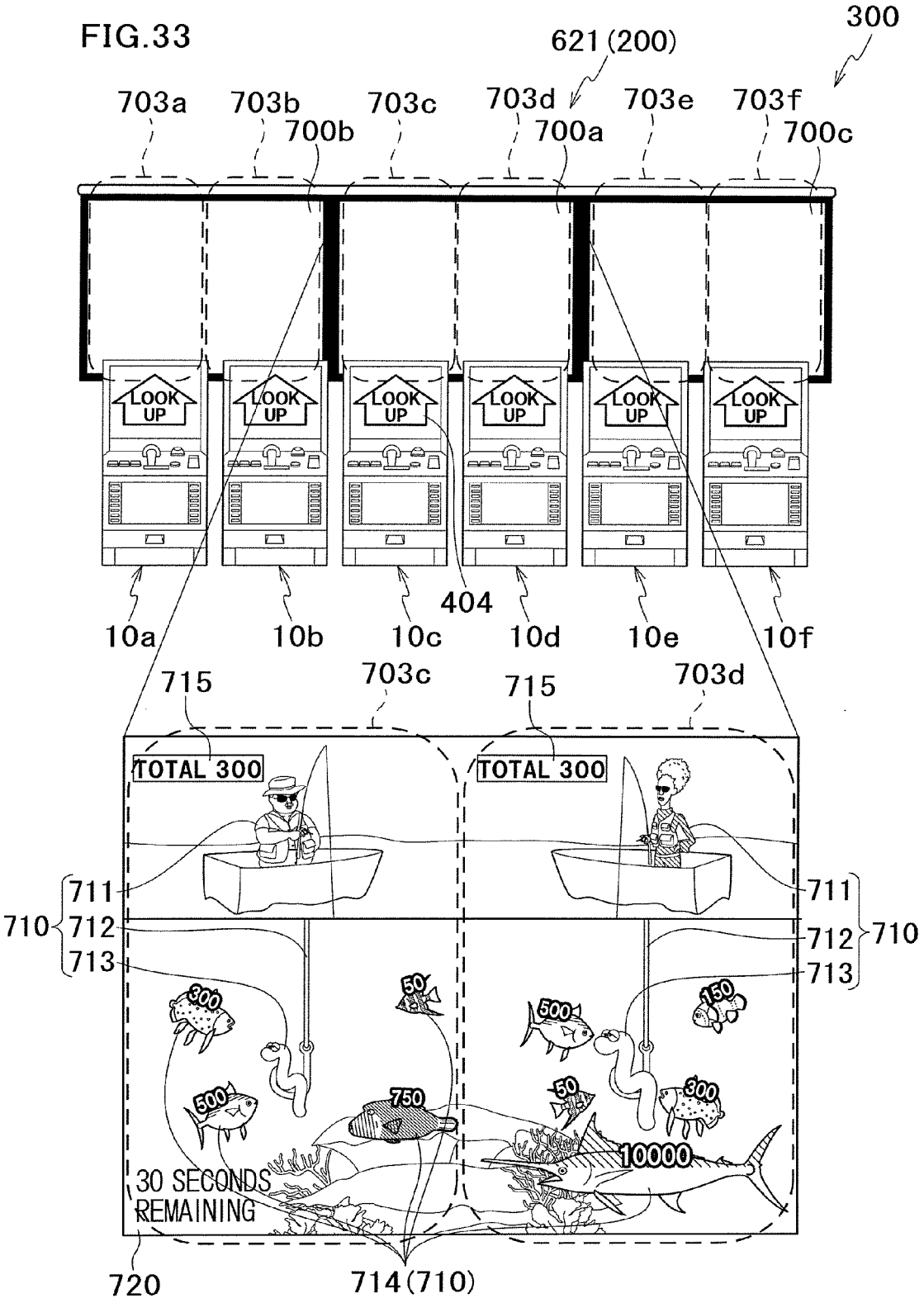
FIG. 33 shows an example of a display screen of a first common game.

In FIG. 33, all gaming terminals 10 are running the common game, and the terminal image display panels 16 of all gaming terminals 10 display the lookup display unit 404. In the first common game, the gaming terminal area 703 corresponding to each gaming terminal 10 participating in the first common game displays the lookup display unit 404 in a similar manner as the individual image 710 for the independent special game. More specifically, the gaming terminal area 703 corresponding to each gaming terminal 10 participating in the common game displays an individual image 710 including a fisherman image 711, a fishhook image 712, a fishing bait image 713, a fish image 714, and a total display unit 715.

The fishing bait image 713 is enlarged when a bonus corresponding to a predetermined unit payout amount (3000 in the present embodiment) or higher is won in an independent special game, as in the independent special game. For example, in FIG. 33, the bait image 713 in the gaming terminal area 703*d* is enlarged because the gaming terminal 10*d* has won a unit payout amount of 10000.

The first common game screen further displays a count display unit 720. This count display unit 720 displays a remaining time of the first common game. When the time indicated by the count display unit 720 reaches 0, a payout calculated by multiplying the payout amount shown in the total display unit 715 by the payout rate at the start of the first common game is awarded.

Figure 34:
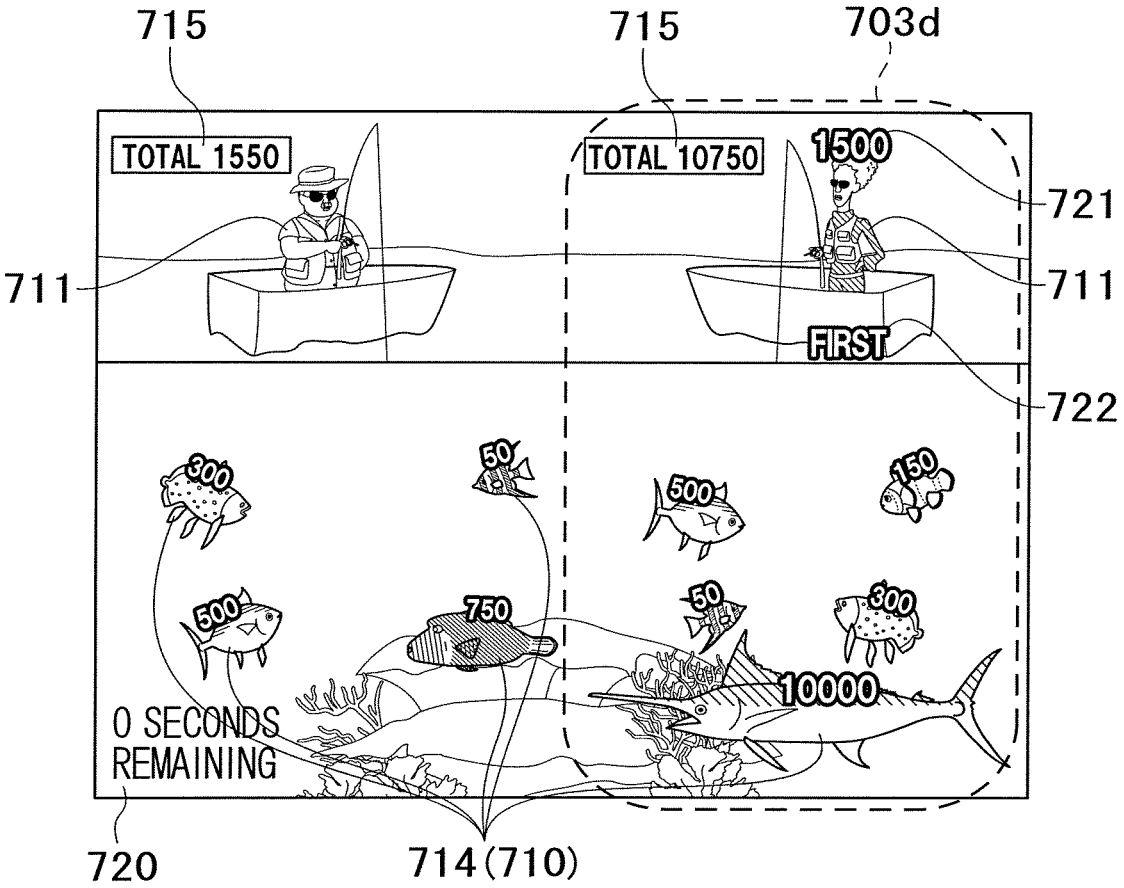
FIG. 34 shows an example of a display screen of a first common game.

When the time indicated by the count display unit 720 reaches 0, furthermore, the rank of the gaming terminal 10 is determined based on the sum total of the unit payout amounts of the awarded bonuses. The first to third ranks are determined in the present embodiment, and a payout corresponding to the rank is awarded to each of the first-ranked, second-ranked, and third-ranked gaming terminals 10. FIG. 34 displays a first common game ranking determination screen in which the gaming terminal 10*d* is ranked first as having the total unit payout amounts of 10750. In the first common game ranking determination screen, a ranking image 722 indicating the rank is displayed below the fisherman image 711, whereas a payout amount image 721 indicating the payout corresponding to the rank is displayed above the fisherman image 711.

(First Common Game Probability Table)

The determination of the payout amount of the first common game is carried out with reference to a first common game probability table shown in FIG. 33. Though not illustrated, a plurality of first common game probability tables are stored, and the number thereof is arranged to be identical with the number of gaming terminals 10. A different first common game probability table is associated with each gaming terminal 10. In the first common game probability table, random number ranges defined by dividing a numerical range of 0 to 65535 are associated with winning bonus types. In the winning bonus type, at least three bonuses are stored. For example, when the determined random number is 30, the winning bonus types to be awarded are Yellow Fin Tuna, Wahoo, Halibut, and Halibut.

The winning screen of the first common game is identical with the winning screen displayed on the gaming terminal area 703*c* shown in FIG. 26 and is displayed on the gaming terminal area 703 corresponding to each gaming terminal 10 participating in the first common game. That is to say, when a random number selected from the first common game probability table shown in FIG. 35 is 30, winning screens of catching a Yellow Fin Tuna, a Wahoo, a Halibut, and a Halibut are serially displayed.

(Common Game: Second Common Game Screen)

Figure 36:
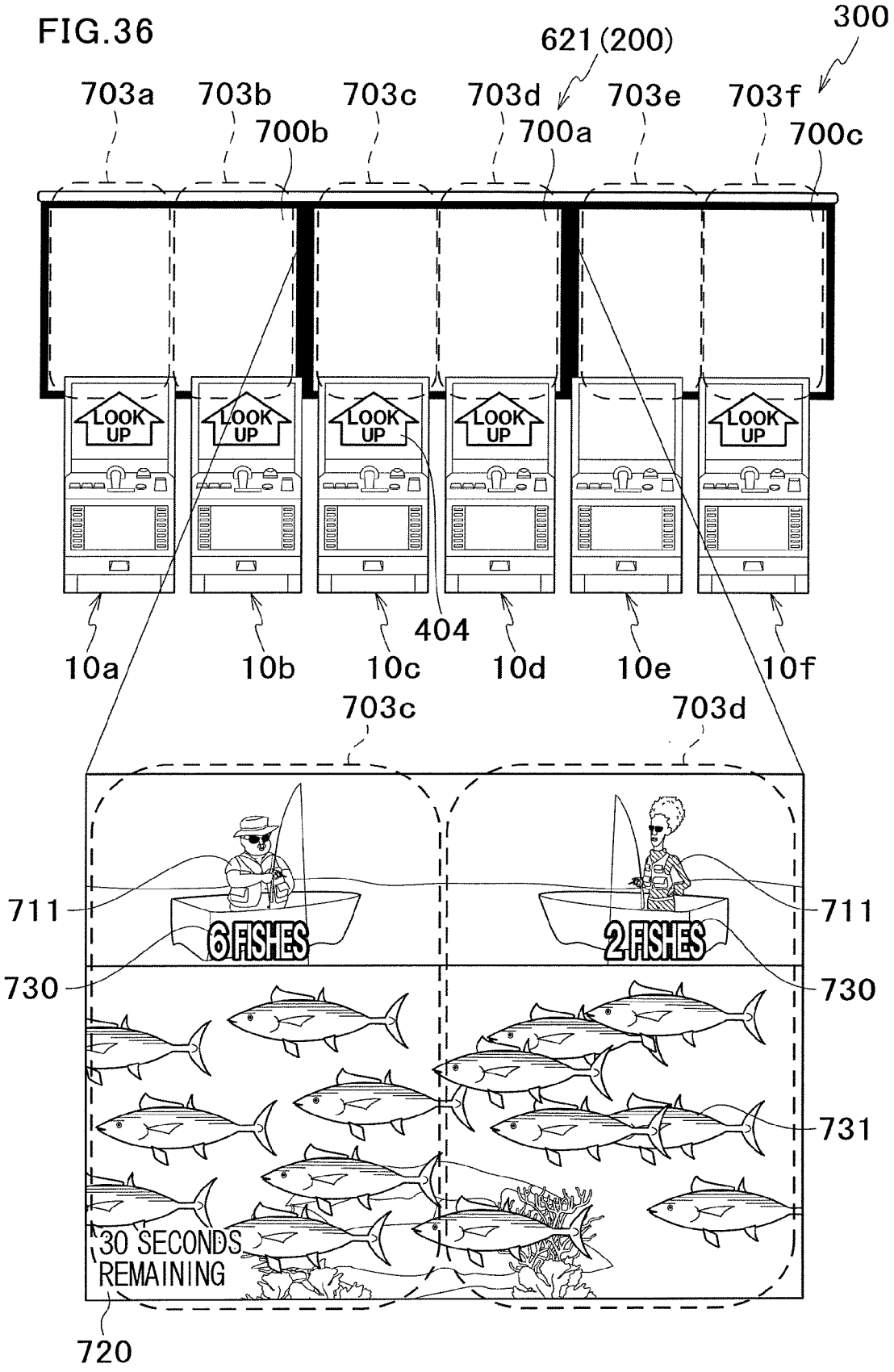
FIG. 36 shows an example of a display screen of a second common game.

FIG. 36 illustrates the display state on the upper display 700 during the second common game. In FIG. 36, the gaming terminals 10 except the gaming terminal 10*e* are running the common game, and the terminal image display panel 16 of the gaming terminals 10 except that of the gaming terminal 10*e* displays the lookup display unit 404. In the second common game, a fisherman image 711 and a count display unit 720 similar to those in the first common game are displayed, and also a fish school image 731 is displayed on the gaming terminal areas 702 corresponding to all gaming terminals 10.

Figure 37:
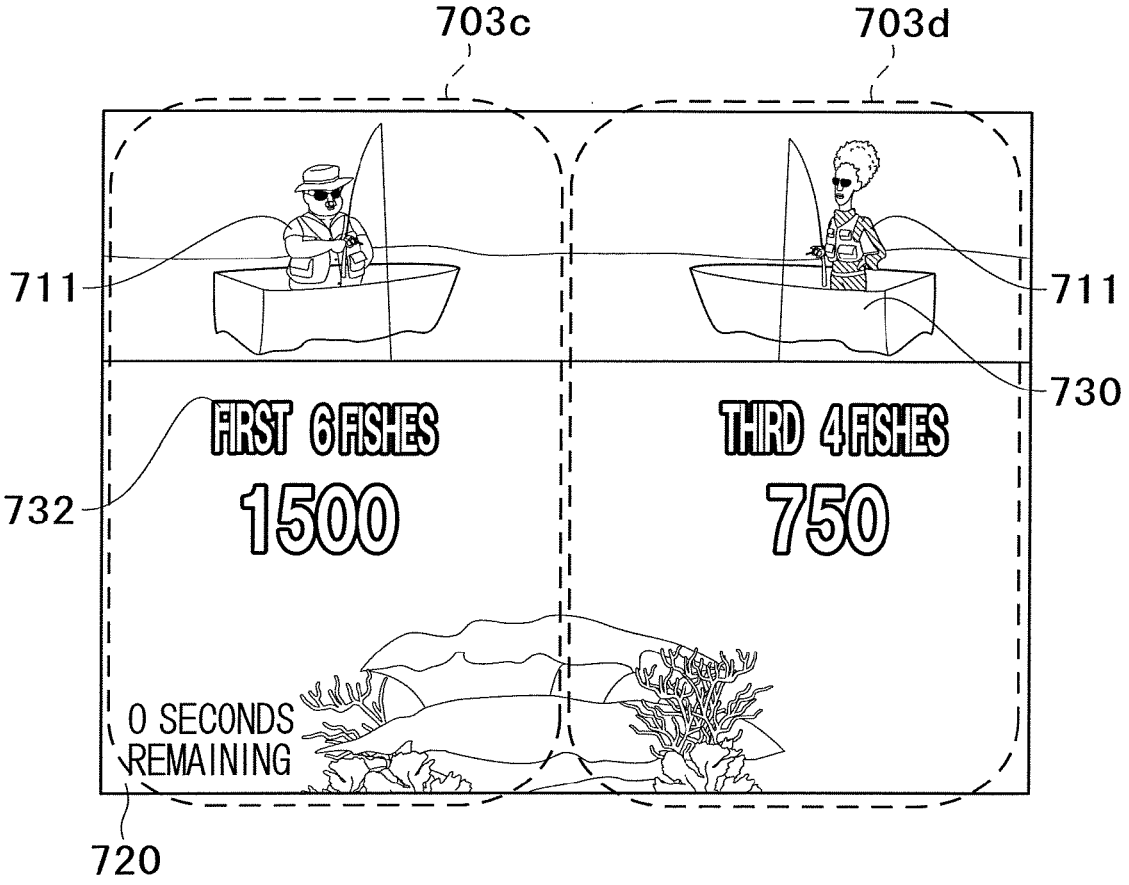
FIG. 37 shows an example of a display screen of a second common game.

When the time indicated by the count display unit 720 reaches 0, furthermore, the rank of the gaming terminal 10 is determined based on the sum total of the awarded winnings. In the second common game, the center controller 200 conducts winning determination with a predetermined winning probability for a predetermined number of times for each gaming terminal 10, and the number of these winnings is determined as the number of obtained winnings. The first to third ranks are determined in the present embodiment, and a payout corresponding to the rank is awarded to each of the first-ranked, second-ranked, and third-ranked gaming terminals 10. FIG. 37 shows a second common game ranking determination screen. In the case of FIG. 37, the gaming terminal 10*c* is ranked first with six winnings in total. The gaming terminal 10*d* is ranked third with four winnings in total. On the second common game ranking determination screen, a ranking image 732 indicating the rank, the number of obtained winnings, and an obtained payout amount is displayed below the fisherman image 711.

(Common Game: Third Common Game Screen)

Figure 38:
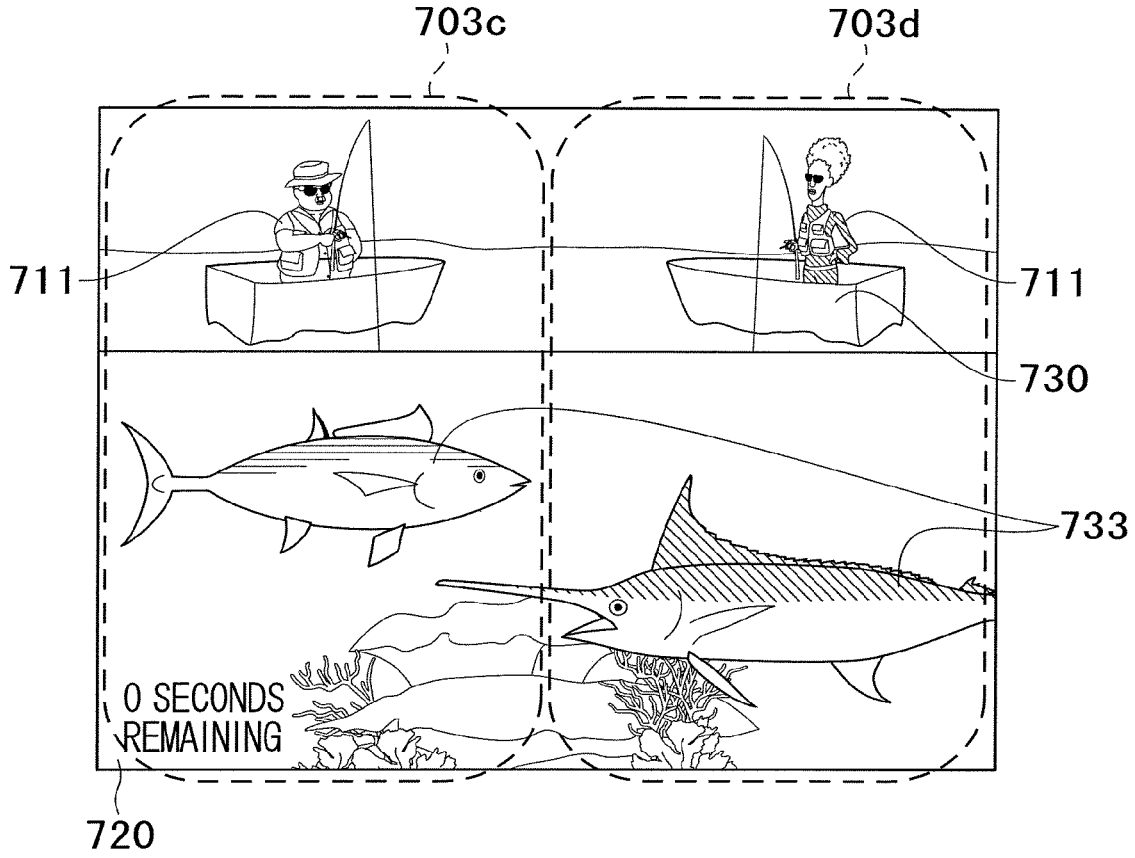
FIG. 38 shows an example of a display screen of a third common game.

When the third common game is run after the first common game or the second common game, a third common game start effect screen shown in FIG. 38 is displayed. As shown in FIG. 38, the third common game start effect screen displays a large fish image 733. Thereafter, the third common game starts.

Figure 39:
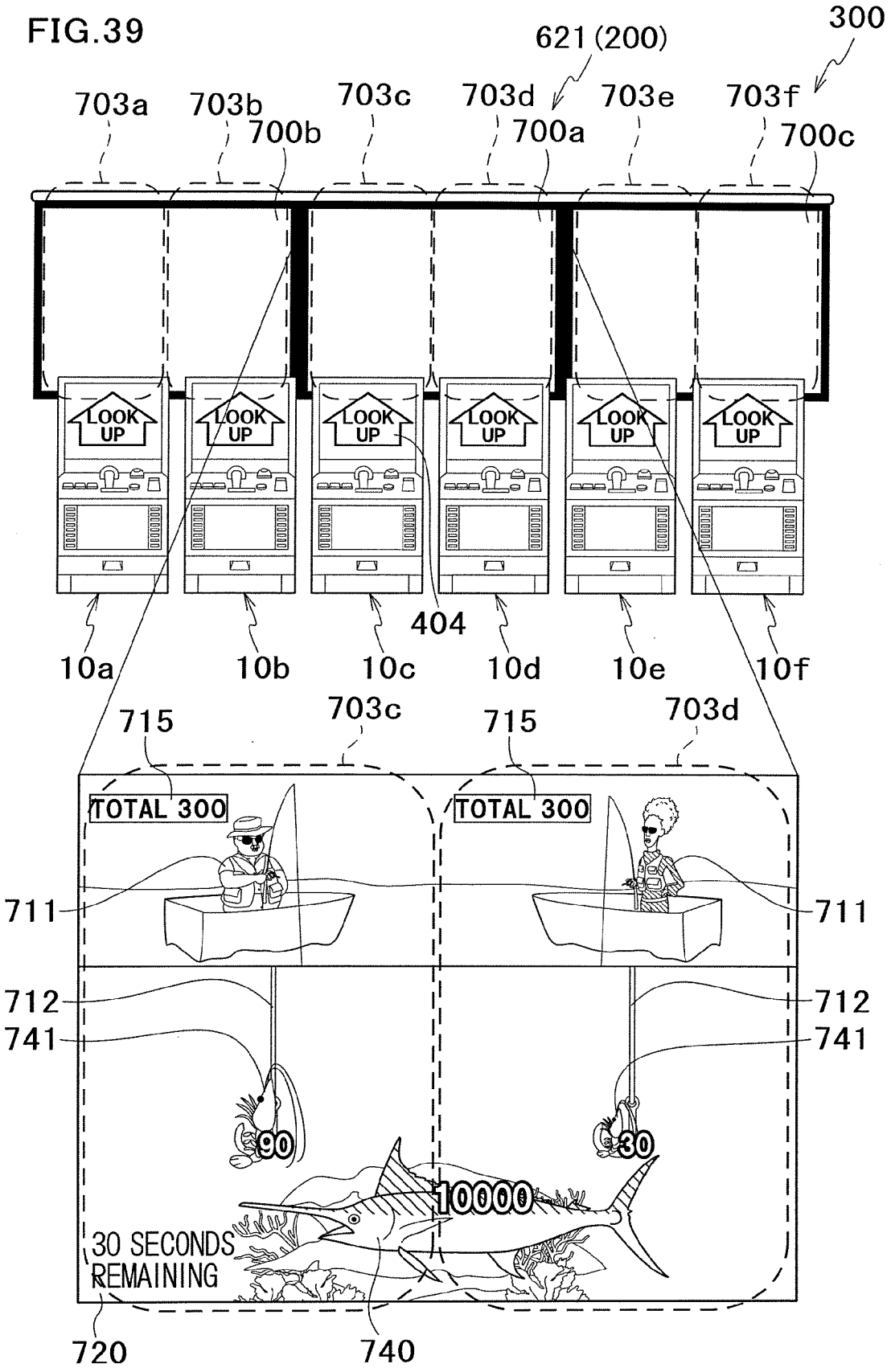
FIG. 39 shows an example of a display screen of a third common game.

FIG. 39 illustrates the display state on the upper display 700 during the third common game. In FIG. 39, all gaming terminals 10 are running the common game, and the terminal image display panels 16 of all gaming terminals 10 display the lookup display unit 404. In the third common game, the gaming terminal area 703 corresponding to each gaming terminal 10 participating in the third common game displays the lookup display unit 404 in a similar manner as the individual image 710 for the independent special game. More specifically, gaming terminal area 703 corresponding to each gaming terminal 10 participating in the common game displays an individual image 710 including a fisherman image 711, a fishhook image 712, a large fish image 740, a prawn image 741, and a total display unit 715.

The prawn image 741 is displayed instead of the fishing bait image 713 of the first common game, and shows a numerical value image corresponding to the size of the prawn image 741. In the present embodiment, the prawn image 741 is associated with one of the numerical values of "90", "60", and "30". When no winning is obtained in the third common game, a unit payout amount to be awarded is equal to the numerical value shown on the prawn image 741.

Furthermore, in the third common game is displayed a large fish image 740. The number of the large fish images 740 displayed in all gaming terminal areas 703 is smaller than the number of gaming terminals 10. In the gaming terminal area 703 corresponding to each gaming terminal 10 having obtained a winning, a winning image shown in FIG. 26 is displayed.

(Third Common Game Probability Table)

The determination of the payout amount of the third common game is carried out with reference to a third common game probability table shown in FIG. 40. Though not illustrated, a plurality of third common game probability tables are stored, and the number thereof is arranged to be identical with the number of gaming terminals 10. A different third common game probability table is associated with each gaming terminal 10. In the third common game probability table, random number ranges defined by dividing a numerical range of 0 to 65535 are associated with winning bonus types. In the winning bonus type, one or more bonus is stored. For example, when the determined random number is 10, the winning bonus type to be awarded is Blue Marlin. However, when a bonus that a terminal 10 wins has already been awarded to another gaming terminal 10, no payout is awarded even if the terminal wins the bonus.

As described above, when the third common game is run after the first common game or the second common game, i.e., when the first common game or the second common game evolves into the third common game, bonus payouts of the both games are obtainable.

(Cooperation of Control Lever 603 and Individual Image 710)

In the bonus game and common game above, the movement pattern of the control lever 603 and the display pattern of the individual image 710 are cooperated with each other. The movement pattern of the control lever 603 is stored in a movement pattern table which is in the RAM of the gaming terminal 10. In the meanwhile, the display pattern of the individual image 710 is stored in a display pattern table which is in the RAM 243 of the center controller 200. As shown in FIG. 41 and FIG. 42, a movement pattern and a display pattern are associated with a single set of identification information. As a set of identification information is selected in accordance with the situation, the control lever 603 is moved based on the movement pattern associated with the selected set of identification information and the individual image 710 is displayed based on the display pattern associated with the selected set of identification information.

(Operation of Gaming Machine 300: Boot Process)

The following describes a boot process routine which takes place in the gaming machine 300. Upon powering on the gaming machine 300, a boot process routine illustrated in FIG. 43 starts in: the motherboard 240 and gaming board 260 in the center controller 200, and in the motherboard 40 and the gaming board 50 in the terminal controller 630. The memory cards 53 and 263 are assumed to be inserted into the card slots 535 and 263S of the gaming boards 50 and 260, respectively. Further, the GAL 54 and 264 are assumed to be attached to the IC socket 54S and 264S, respectively.

First, turning on the power switch of (powering on) the power supply units 45 and 245 boots the motherboards 40 and 240, and the gaming boards 50 and 260. Booting the motherboards 40 and 240 and the gaming boards 50 and 260 starts separate processes in parallel. Specifically, in the gaming boards 50 and 260, the CPUs 51 and 261 read out preliminary authentication programs stored in the boot ROMs 52 and 262, respectively. Then, preliminary authentication is performed according to the read out programs so as to confirm and verify that no falsification is made to authentication programs, before reading them in the motherboards 40 and 240, respectively (S21). Meanwhile, the main CPUs 41 and 241 of the motherboards 40 and 240 run BIOS stored in the ROMs 42 and 242 to load into the RAMs 43 and 243 compressed data built in the BIOS, respectively (S22). Then, the main CPUs 41 and 241 run a procedure of the BIOS according to the data loaded into the RAMs 43 and 243 so as to diagnose and initialize various peripheral devices (S23).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S24). During this step, the main CPUs 41 and 241 each derives a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the main CPUs 41 and 241 each reads out four bytes of data constituting the game program and the game system program at one time. Next, the main CPUs 41 and 241 authenticate the game program and the game system program read out to confirm and verify that these programs are not falsified, using the authentication program stored in RAMs 43 and 243 (S25).

When the authentication properly ends, the main CPUs 41 and 241 write and store the authenticated game programs and game system programs in RAMs 43 and 243 (S26).

Next, the main CPUs 41 and 241 access, via the PCI buses, to the GALs 54 and 264 attached to the IC sockets 54S and 264S, and read out payout ratio setting data from the GALs 54 and 264, respectively. The payout ratio setting data read out is then written and stored in the RAMs 43 and 243 (S27).

Next, the main CPUs 41 and 241 read out, via the PCI buses, country identification information stored in the ROMs 55 and 265 of the gaming boards 50 and 260, respectively. The country identification information read out is then stored in the RAMs 43 and 243 (S28).

Figure 44:
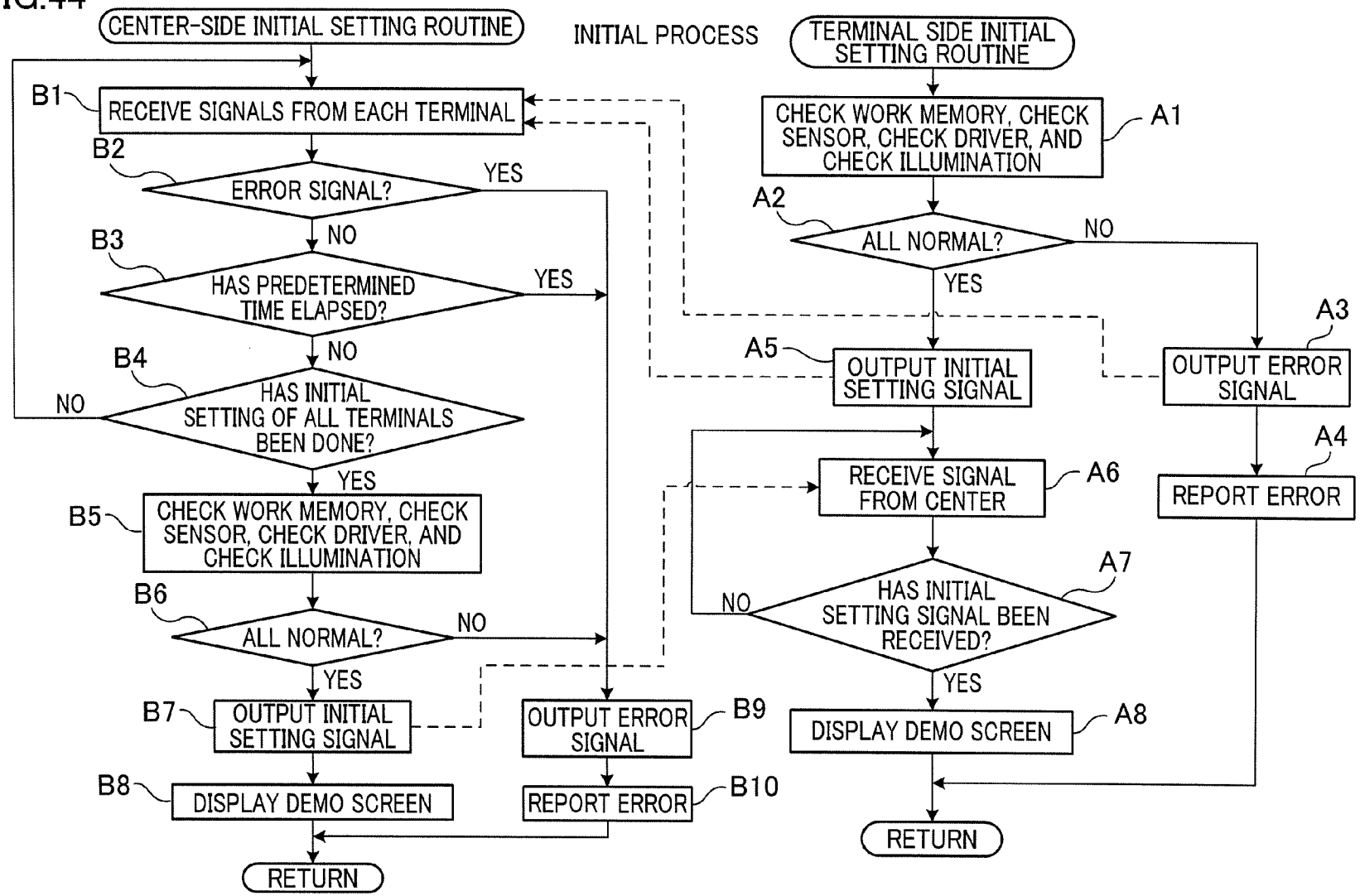
FIG. 44 is a flowchart of an initial process.

After this, the main CPUs 41 and 241 each perform an initial process of FIG. 44.

(Operation of Gaming Machine 300: Initial Process)

Figure 43:
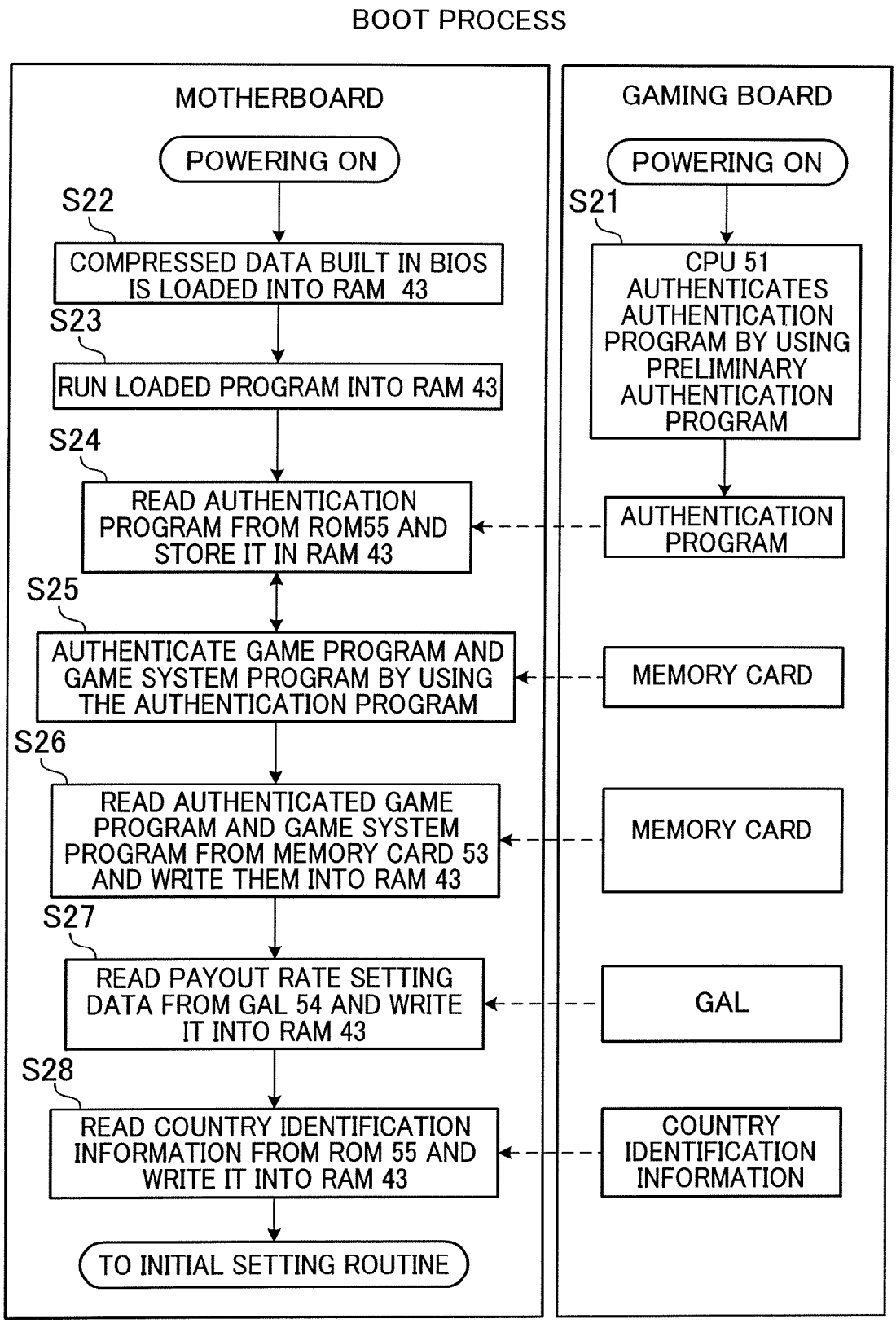
FIG. 43 is a flowchart of a boot process.

The following describes an initial process which takes place in the gaming machine 300. When the boot process of FIG. 41 is completed, the center controller 200 reads out from the RAM 243 a center-side initial setting routine shown in FIG. 44 and executes the routine. Meanwhile, when the boot process of FIG. 43 is completed, the gaming terminal 10 reads out from the RAM 43 a terminal side initial setting routine shown in FIG. 44 and executes the routine. The center-side and terminal side initial setting routines are executed in parallel.

First, the main CPU 41 of each of the gaming terminals 10 checks operations of work memories such as the RAM 43, various sensors, various driving mechanisms, and various decorative illuminations (A1). For example, to check the operation of the driving mechanism, a process is executed such that the control lever 603 is rotated from the start position to the end position while the detected magnetic forces at the respective positions are detected, and then the lever position determining table in the RAM 43 is updated. Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, the supply of an initial setting signal from the center controller 200 is waited for (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of an unillustrated host computer or the like (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 10 (B4). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243 or the like, various sensors, various driving mechanisms, and various decorative illuminations (B5). Then, the main CPU 41 determines if all the check results are normal (A2). If the main CPU 241 determines the check results contain an error (B6: NO), the main CPU 241 executes B9.

On the other hand in B6, if the main CPU 241 determines that all the check results are normal (B6: YES), the main CPU 241 outputs an initial setting signal to all the gaming terminals 10 (B7), and causes the shared display 102 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal image display panel 16 to display a demo-screen (A7). The main CPU 41 then ends the routine.

(Operation of Gaming Terminal 10: Terminal-Side Basic Game Process Routine)

Figure 45:
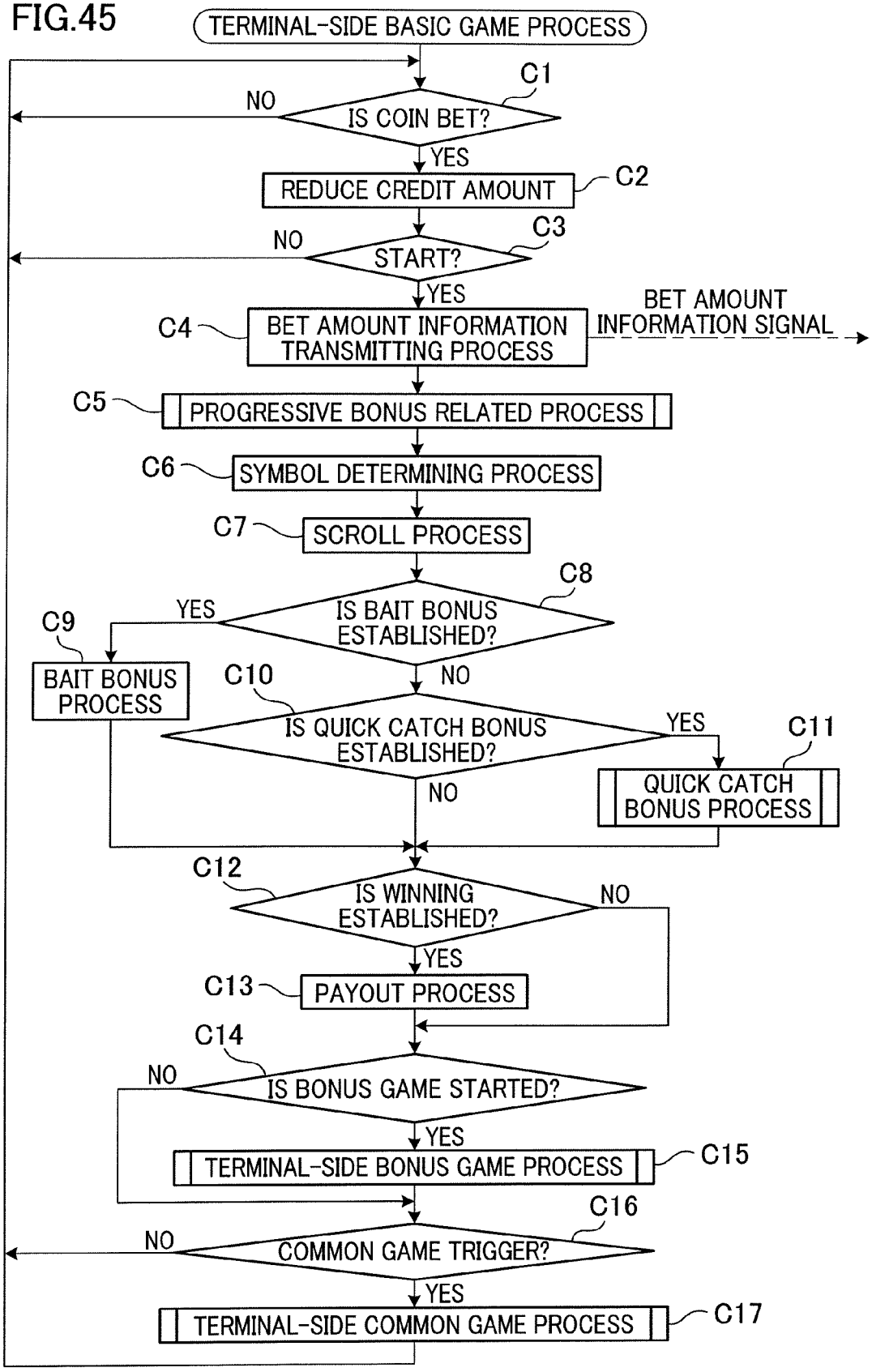
FIG. 45 is a flowchart of a terminal-side basic game process.

After the terminal side initial setting routine of FIG. 44, the main CPU 41 of the gaming terminal 10 performs a terminal-side basic game process routine of FIG. 45. Through this terminal-side basic game process routine executed by the main CPU 41, a basic game is run.

As shown in FIG. 45, in the gaming terminal process routine, it is determined whether a coin is bet (C1). In this step, it is determined whether a signal from the 1-bet switch 26S entered by pressing of the 1-bet button 26 is received. Meanwhile, it is determined whether a signal from the maximum bet switch 27S entered by pressing of the maximum bet button 27 is received. If no coin is bet (C1: NO), C1 is repeated until a coin is bet.

On the other hand, if a coin is bet (C1: YES), the credit amount stored in the RAM 43 is reduced according to the number of coins bet (C2). When the number of coins bet surpasses the credit amount stored in the RAM 43, later-described C3 is conducted without the reduction of the credit amount. When the number of coins bet exceeds the upper limit of coins bettable for one basic game (50 pieces in this embodiment), the process goes to a later-described step C3 without the reduction of the credit amount.

Then, it is determined whether a spin button 23 or a control lever 603 is pressed for the start (C3). If not started (C3: NO), the process returns to C1. Here, if not started (for example, a command to end the game is input before the start), the reduction of the credit amount in C2 is canceled.

On the other hand, if started (C3: YES), a bet amount information transmitting process is executed (C4). In other words, a bet amount information signal indicating the game value bet is transmitted to the center controller 200. Note that, although the present embodiment is arranged so that the information of the number of paylines L activated in response to betting is transmitted, the disclosure is not limited to this.

Figure 51:
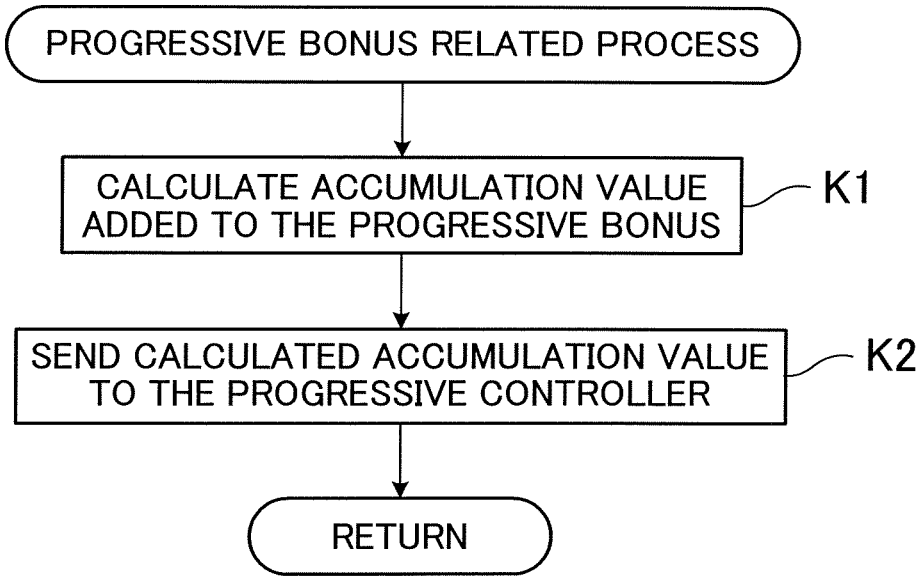
FIG. 51 is a flowchart of a progressive bonus related process.

Thereafter, a progressive bonus related process which will be described later with reference to FIG. 51 is conducted (C5). In this process, a value added to a progressive bonus amount paid out when winning a progressive bonus game is calculated and sent to the progressive controller 340.

Next executed is a symbol determining process (C6). That is, the stop symbol determining program stored in the RAM 43 is run to determine symbols 501 to be arranged in the display windows 150. Through this, a symbol combination to be formed along the payline L is determined.

Then, the scrolling process is executed to scroll display symbols 501 on the terminal image display panel 16 (C7). The scrolling process is a process in which the symbols 501 determined in C6 are stopped (rearranged) in the display windows 150 after scrolling of symbols 501 in a direction indicated by an arrow.

Thereafter, whether a bait bonus is established is determined (C8). More specifically, internal random determination is independently carried out after the scroll process, and whether to win the bait bonus is determined at a probability of 1/80. When winning the bait bonus (C8: YES), a bait bonus process is carried out to award a fixed payout (20 coins) (C9).

On the other hand, if not winning the bait bonus (C8: NO), whether a quick catch bonus is established is determined (C10). More specifically, if the bait bonus is not won and no specific symbol 510 stops at the display blocks 28 of the video reel 153 as a result of the scroll process in C7, internal random determination is carried out to determine whether a quick catch bonus game awarded at a probability of 1/80 has been awarded is determined. If the quick catch bonus is established (C10: YES), a later-described quick catch bonus process is carried out (C11).

On the other hand, if the quick catch bonus is not established (C10: NO), whether a winning is resulted by a combination of symbols 501 rearranged on the display window 150 is determined after the bait bonus process or after the quick catch bonus process (C12). When it is determined that a winning is resulted (C12: YES), a payout process is executed (C13). More specifically, when a winning is resulted, the number of coins according to the combination is calculated.

On the other hand, if it is determined that no winning is resulted (C12: NO) or after the payout process, the main CPU 41 determines whether to start a bonus game (C14). More specifically, the main CPU 41 starts a bonus game when a predetermined number or more specific symbols 510 are rearranged on a payline L or no specific symbol 510 is rearranged at the video reels 153 of the third column but a mystery bonus is won as a result of random selection.

On the other hand, when the bonus game is started (C14: YES), a terminal-side bonus game process is executed (C15). This terminal-side bonus game process will be described later with reference to FIG. 48.

On the other hand, if the bonus game is not started (C14: NO) or after the end of the terminal-side bonus game process, whether a common game trigger is established is determined (C16). More specifically, the main CPU 41 determines whether a common game start effect image display command has been received from the center controller 200. If the common game trigger is not established (C16: NO), the process of C1 is executed.

On the other hand, when the common game trigger is established (C16: YES), a terminal-side common game process is executed (C17). The terminal-side common game process will be described later with reference to FIG. 49. Then the process of C1 is executed.

Note that, the process of determining whether the quick catch bonus is established (C10) may be carried out when it is determined not to start a bonus game (C14: NO) in the determination of whether to start a bonus game (C14) and it is determined that a bait bonus is not established (C8: NO) in the determination of whether the bait bonus is established (C8).

(Operation of Center Controller 200: Center-Controller-Side Process)

Figure 46:
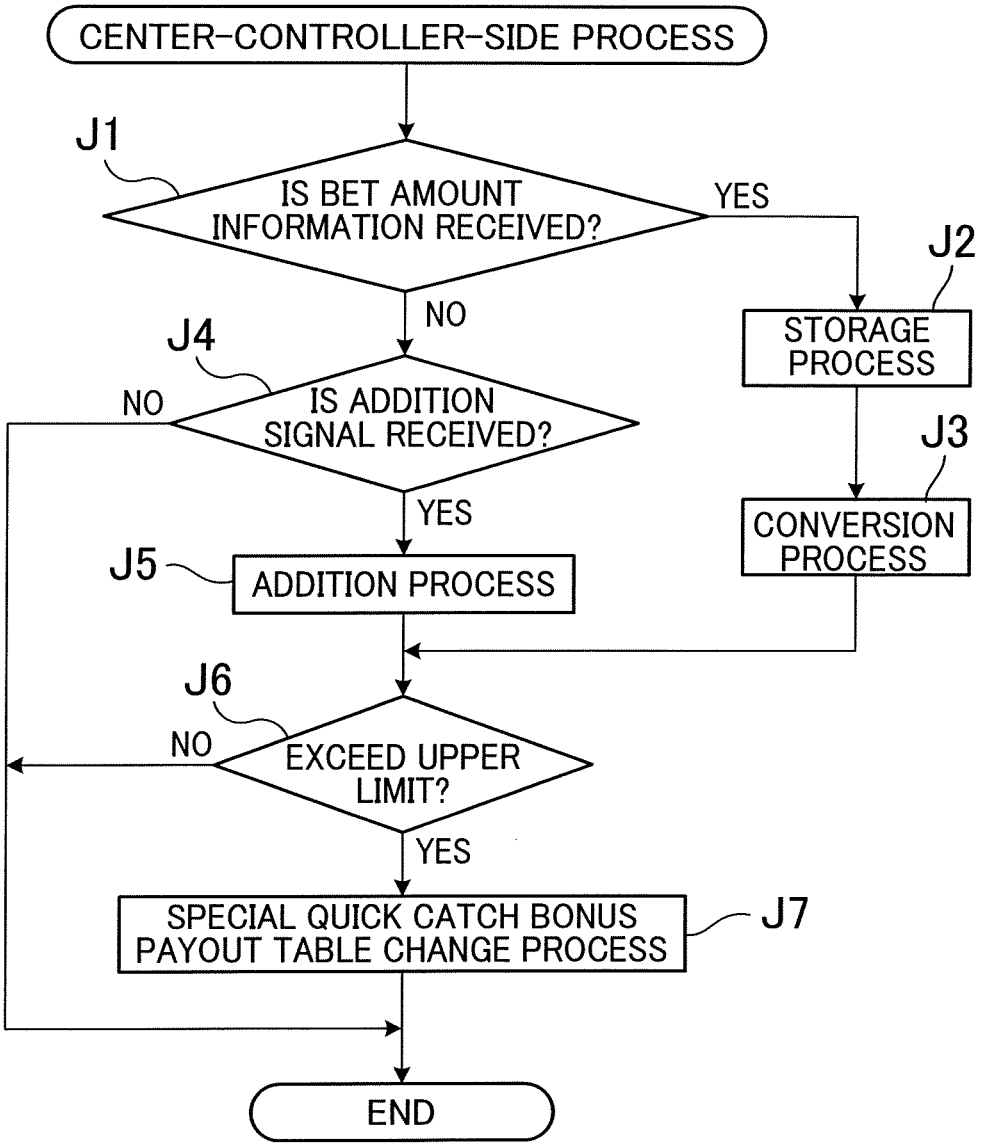
FIG. 46 is a flowchart of a center-controller-side process.

The main CPU 241 of the center controller 200 executes, after the execution of the center-side initial setting routine is completed, a common game process routine shown in FIG. 46.

To begin with, whether a bet amount information signal which is sent in the bet amount information sending process of the terminal-side basic game process of C4 in each gaming terminal 10 has been received is determined (J1). When the bet amount information signal has been received (J1: YES), a storage process is conducted (J2). More specifically, which gaming terminal 10 has sent the signal is specified, and information regarding the number of paylines L activated in accordance with the bet amount is stored in the RAM 243 for each gaming terminal 10.

After the end of the storage process in J2, a conversion process is carried out (J3). In this process, with reference to the base game qualification time awarding table (FIG. 14) stored in the RAM 243, game qualification time is awarded according to the number of paylines L activated in accordance with the bet amount and the payout rate. Thereafter, in the game qualification time management table (see FIG. 15), the awarded game qualification time and the payout rate are accumulatively stored for each gaming terminal 10. That is to say, based on the number of paylines L activated in accordance with the bet amount stored in the RAM 243, game qualification time to be awarded and a payout rate in each unit time of the game qualification time are determined, and, for each gaming terminal 10, the game qualification time of each payout rate is associated with the payout rate and the game qualification time is accumulatively stored in the game qualification time management table. The game qualification time management table stored in the RAM 243 is equivalent to a timer.

On the other hand, if no bet amount information signal is received (J1: NO), whether to receive an addition signal is determined (J4). If no addition signal is received (J4: NO), the process is terminated. On the other hand, if the addition signal is received (J4: YES), an addition process (J5) is executed. In this process, which gaming terminal 10 has sent the signal is specified, and the game qualification time included in the received addition signal and associated with the payout rate is accumulatively stored in the game qualification time management table for each gaming terminal 10.

Subsequently, after the conversion process of J3 or after the addition process of J5, whether the game qualification time accumulatively stored in the game qualification time management table for each gaming terminal 10 exceeds the upper limit of the accumulation of the game qualification time, which is determined in the maximum qualification time table, is determined (J6). More specifically, with reference to the above-described accumulation calculation table, whether the value exceeding the accumulation upper limit of qualification time corresponding to the payout rate includes a value more than 0 as a result of updating is determined. If there is no value exceeding the upper limit (J6: NO), the process is terminated.

If there is a value exceeding the upper limit (J6: YES), a special quick catch bonus payout table change process is executed (J7). In this process, a payout table to be referred to in a later-described quick catch bonus process is changed from the basic quick catch bonus payout table or the like to a special quick catch bonus payout table. The winning probability in this special quick catch bonus payout table is calculated by adding, to the winning probability in the basic quick catch bonus payout table a value calculated by multiplying the above-described "value exceeding the accumulation upper limit of qualification time" by a predetermined value (which is 80/18038 in the present embodiment but may be suitably changed according to design choice). This winning probability calculated in this way is updated according to need. Then the process is terminated.

(Quick Catch Bonus Process)

Figure 47:
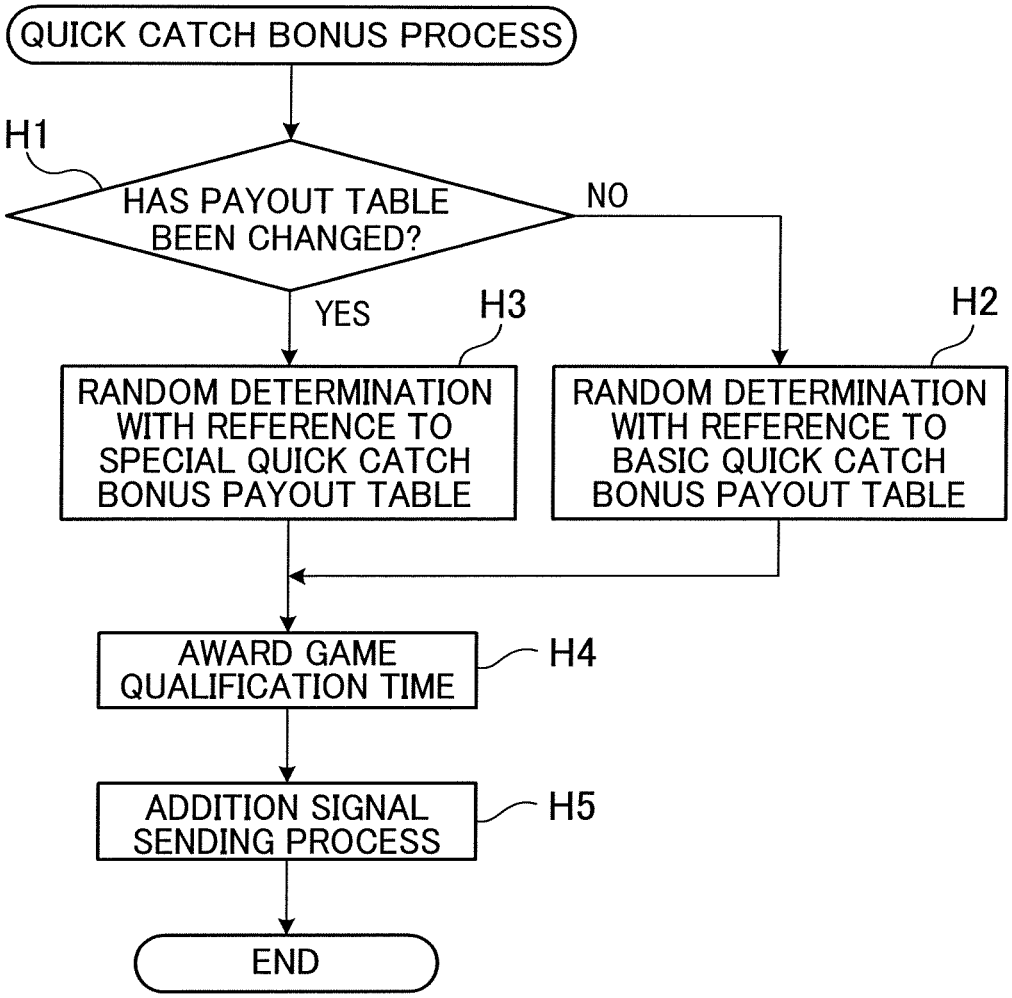
FIG. 47 is a flowchart of a quick catch bonus process.

The main CPU 41 of the gaming terminal 10 executes the quick catch bonus process shown in FIG. 47 in C11 of the terminal-side basic game process shown in FIG. 45.

To begin with, in the special quick catch bonus payout table change process of J7 in the center-controller-side process, whether the payout table has been changed is determined (H1). If the payout table has not been changed (H1: NO), internal random determination is carried out with reference to the above-described basic quick catch bonus payout table (H2). On the other hand, if the payout table has been changed (H1: YES), internal random determination is carried out with reference to the above-described special quick catch bonus payout table (H3).

If winning is resulted in the internal random determination in H2 or H3, game qualification time is awarded (H4). In the case of the internal random determination in H2 with reference to the basic quick catch bonus payout table, when one payline is activated by one bet, game qualification time corresponding to one bet is awarded at a winning probability of 311/18038. More specifically, with reference to the base game qualification time awarding table shown in FIG. 14, game qualification time to be awarded, which corresponds to the payout rate of one corresponding to one activated payline, is determined as five seconds. In the meanwhile, when five paylines are activated in response to five bets, game qualification time corresponding to five bets is awarded at a winning probability of 311/18038. More specifically, with reference to the base game qualification time awarding table of FIG. 14, game qualification time to be awarded, which corresponds to the payout rate of five corresponding to five activated paylines, is determined as five seconds.

Thereafter, an addition signal sending process is executed (H5). In this process, the awarded game qualification time corresponding to the payout rate is sent to the center controller 200 as an addition signal.

(Operation of Gaming Terminal 10: Terminal-Side Bonus Game Process Routine)

Figure 48:
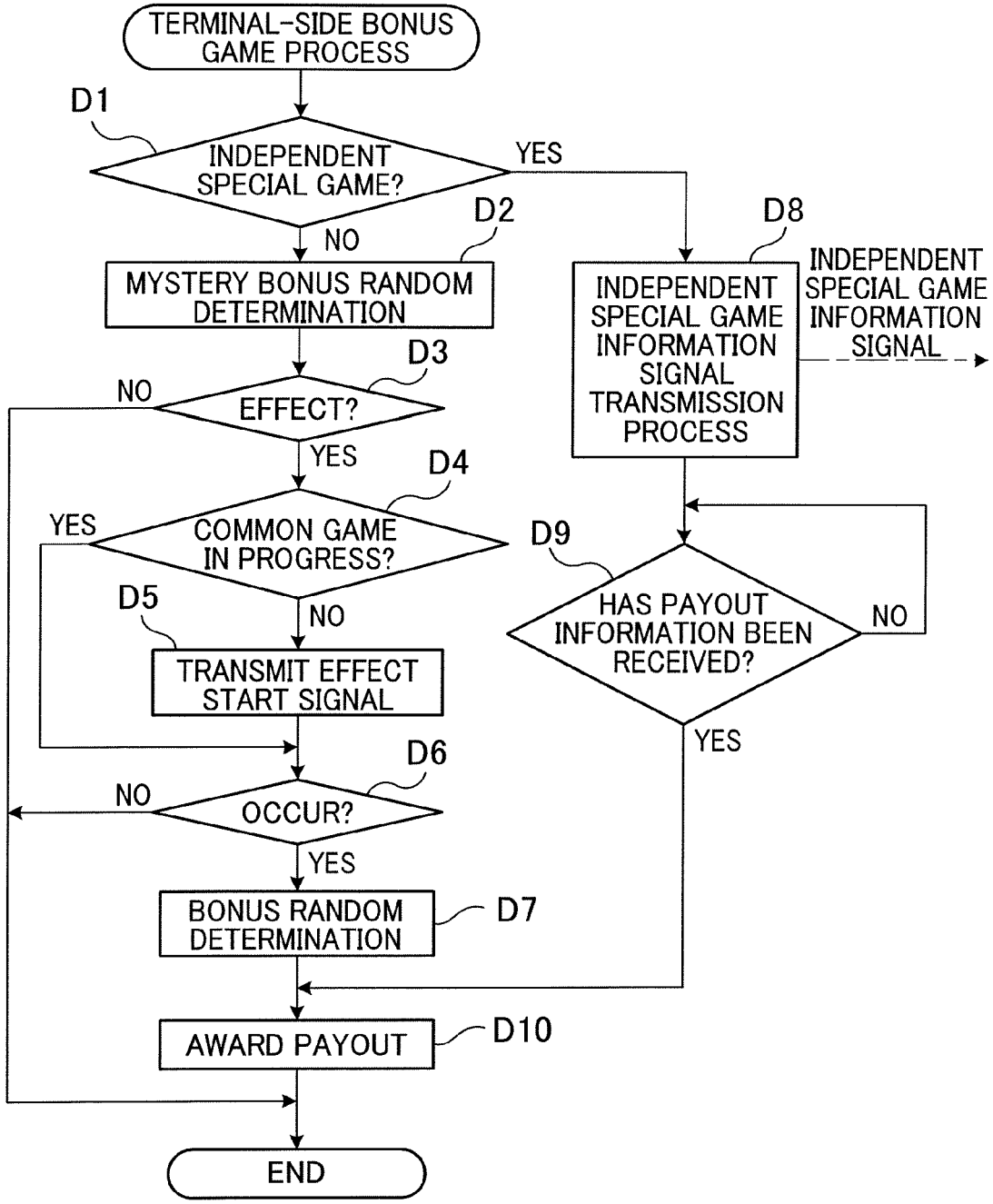
FIG. 48 is a flowchart of a terminal-side bonus game process.

The main CPU 41 of the gaming terminal 10 executes, in the terminal-side basic game process (C15) shown in FIG. 45, a terminal-side bonus game process routine shown in FIG. 48.

As shown in FIG. 48, the main CPU 41 determines whether the bonus game is an independent special game (D1). If the bonus game is not the independent special game (D1: NO), i.e., when the bonus game is a mystery bonus, the main CPU 41 executes a mystery bonus random determination (D2). More specifically, the main CPU 41 determines, with reference tot mystery bonus start random determination table shown in FIG. 27, to which one of the ranges, "occurrence", "effect only", and "non-occurrence" the determined random number corresponds.

Now, the main CPU 41 determines whether to conduct an effect (D3). More specifically, the main CPU 41 determines to conduct an effect when the result of the mystery bonus random determination is "occurrence" or "effect only". If no effect is conducted (D3: NO), i.e., when the result of the mystery bonus random determination is "non-occurrence", the routine finishes.

On the other hand, if an effect is conducted (D3: YES), the main CPU 41 determines whether a common game is being run (D4). If no common game is being run (D4: NO), an effect start signal is transmitted to the center controller 200 (D5). Note that, receiving the effect start signal transmitted in the step D5, the center controller 200 conducts the effect shown in FIG. 29. If it is determined in the step D4 that a common game is being run (D4: YES) or after the transmission of the effect start signal, whether a mystery bonus is generated is determined (D6). More specifically, the mystery bonus is generated when the result of the mystery bonus random determination is "occurrence".

If no mystery bonus is generated (D6: NO), the routine finishes. On the other hand, if the mystery bonus is generated (D6: YES), the main CPU 41 conducts a bonus random determination (D7). More specifically, with reference to the mystery bonus probability table shown in FIG. 28, to which range of the winning bonus types the determined random number corresponds is determined. Thereafter, a payout according to the bonus that has been won is awarded (D10), and the routine finishes.

On the other hand, if it is determined in the step D1 that the bonus game is an independent special game (D1: YES), the main CPU 41 transmits an independent special game information signal instructing to start an independent special game is transmitted to the center controller 200 (D8). In response to this, a lookup display unit 404 shown in FIG. 21 is displayed on the terminal image display panel 16. Though not illustrated, when the center controller 200 receives the independent special game information signal, whether a common game is being run is determined. If it is determined that no common game is being run, the center controller 200 conducts the effect shown in FIG. 23 and FIG. 26, turns on the LED unit 801 corresponding to the gaming terminal 10 that has transmitted the independent special game information signal, carries out only a random determination of a payout based on the independent special game probability table show in FIG. 25, and transmits payout information. On the other hand, when a common game is being run, the center controller 200 conducts only a random determination and transmits payout information.

Thereafter, whether payout information has been received from the center controller 200 is determined (D9). If no payout information has been received (D9: NO), the process is on standby and the step D9 is repeated. When the payout information has been received from the center controller 200 (D9: YES), a payout is awarded based on the payout information (D10) and the routine finishes.

(Operation of Gaming Terminal 10: Terminal-Side Common Game Process Routine)

Figure 49:
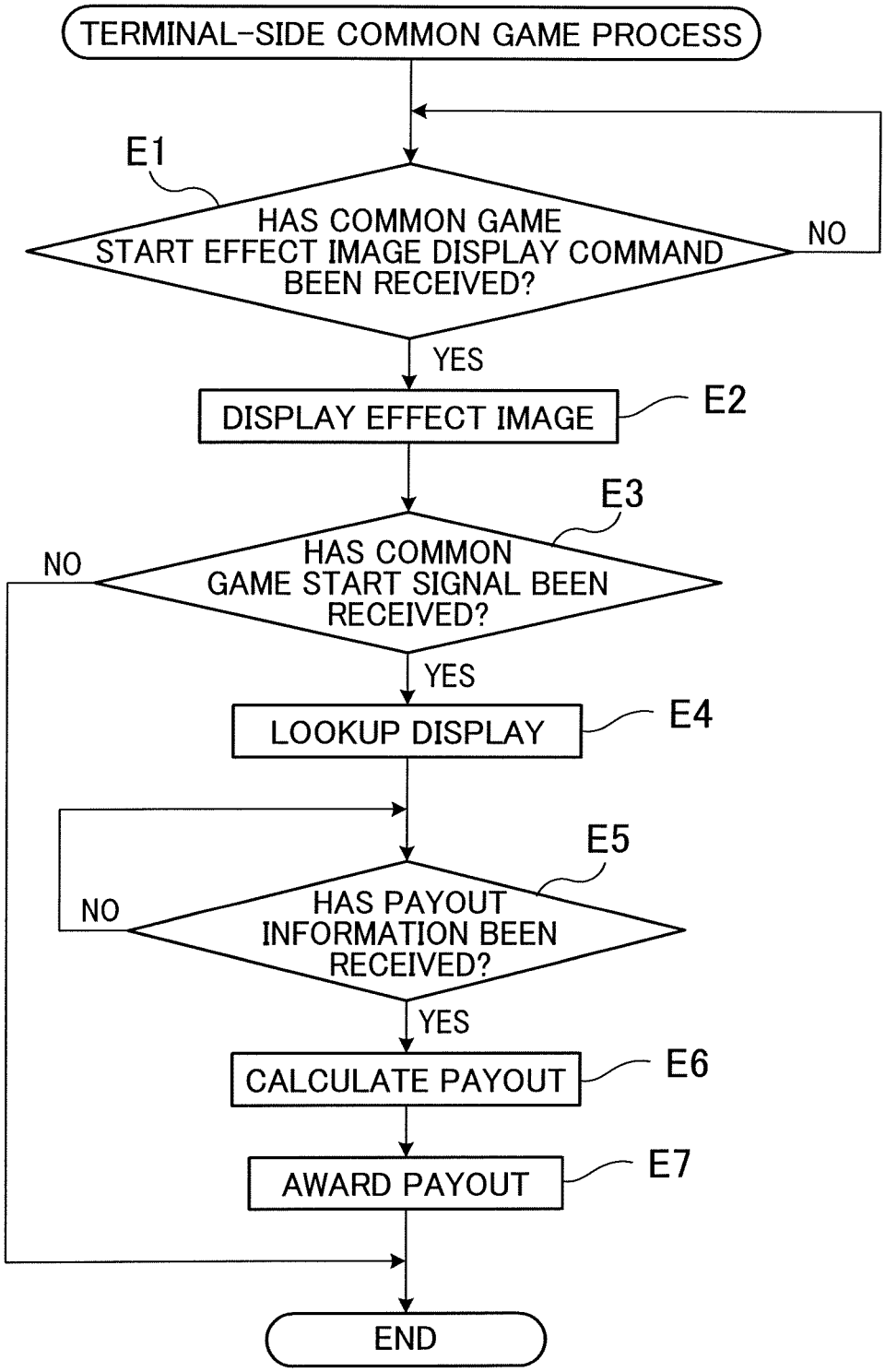
FIG. 49 is a flowchart or a terminal-side common game process.

The main CPU 41 of the gaming terminal 10 executes, in the terminal-side basic game process (C17) shown in FIG. 45, a terminal-side common game process routine shown in FIG. 49.

As shown in FIG. 49, the main CPU 41 determines whether a common game start effect image display command has been received from the center controller 200 (E1). Thereafter, based on the received common game start effect image display command, a common game start effect image shown in FIG. 32 is displayed (E2). Then whether a common game start signal has been received is determined (E3). If no common game start signal has been received (E3: NO), the routine finishes.

On the other hand, if the common game start signal has been received (E3: YES), the lookup display shown in FIG. 21 is carried out (E4). Though not illustrated, when the common game start effect image display command includes an instruction to conduct only an effect, the routine finishes after the step E2.

Subsequently, the main CPU 41 determines whether payout information has been received from the center controller 200 (E5). If no payout information has been received, the routine is on standby (E5: NO). If the payout information has been received (E5: YES), the total sum of obtained unit payout amounts is multiplied by the payout rate, so as to calculate a payout to be awarded (E6). Then the calculated payout is awarded (E7) and the routine finishes.

(Operation of Center Controller 200: Common Game Random Determination Process Routine)

Figure 50:
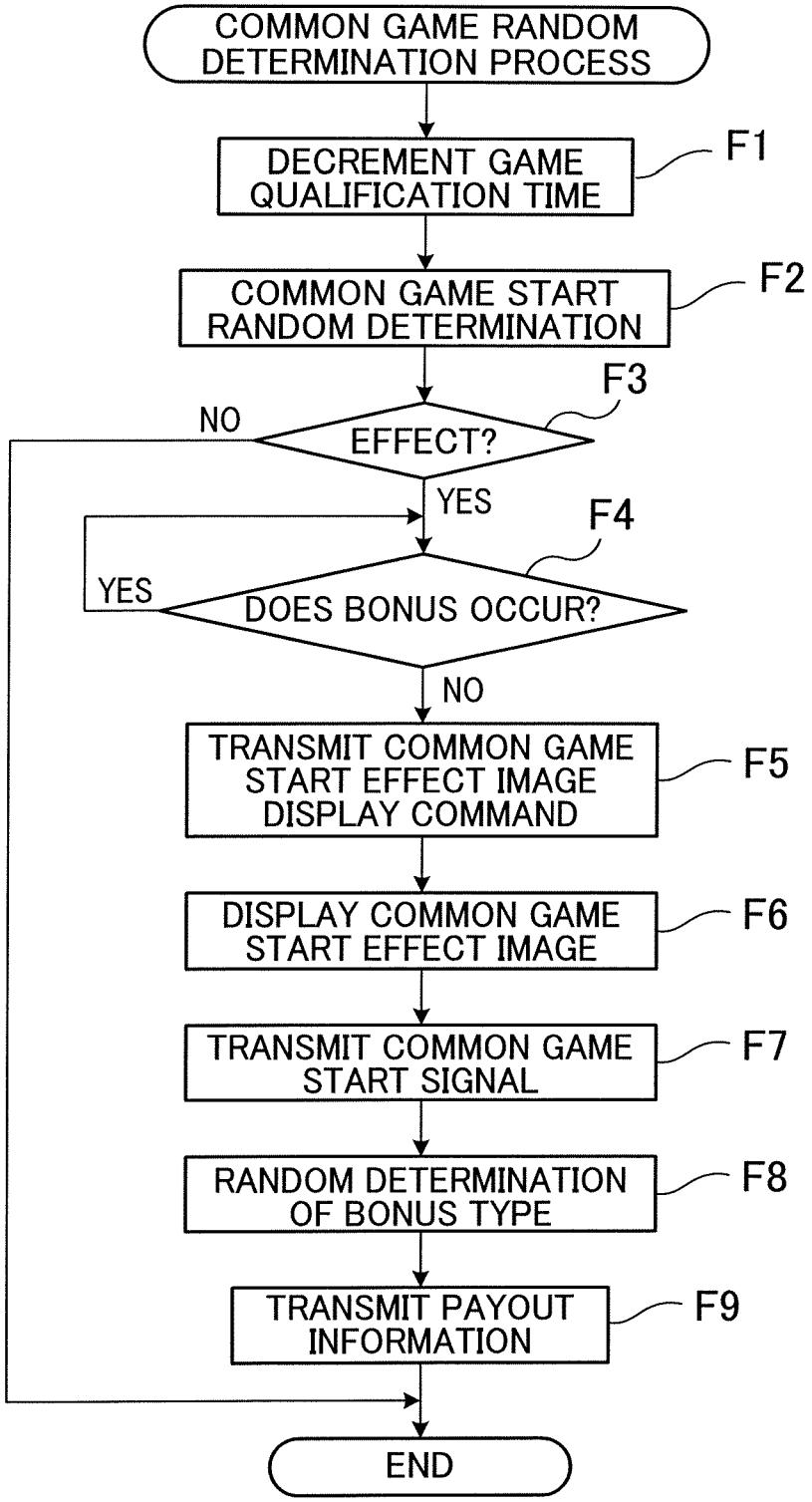
FIG. 50 is a flowchart of a common game random determination process.

After completing the center-side initial setting routine shown in FIG. 44, the main CPU 241 of the center controller 200 executes a common game random determination process routine shown in FIG. 50. Although not illustrated, the common game random determination process routine is executed at predetermined time intervals (executed in each second in the present embodiment).

To begin with, the main CPU 241 decrements, by one second, the game qualification time of each gaming terminal 10, which is managed in the game qualification time management table of the RAM 243 (F1). The game qualification time is decremented from the game qualification time corresponding to the highest payout rate. For this reason, in the case of, for example, the gaming terminal 10*a* in the game qualification time management table shown in FIG. 15, first of all "six seconds" corresponding to the payout rate of four is decremented by one second. In the case of the gaming terminal 10*b*, first of all "one second" corresponding to the payout rate of three is decremented by one second.

Thereafter, as shown in FIG. 50, the main CPU 241 carries out random determination of whether to start a common game (F2). More specifically, with reference to the common game start random determination table shown in FIG. 30, to which one of the ranges, "occurrence", "effect only", and "non-occurrence", the determined random number corresponds. Note that, in addition to the above, which one of common games is generated as a result of the determined random number is determined with reference to the common game type random determination table shown in FIG. 31.

Thereafter, the main CPU 241 determines whether to conduct an effect for the start of a common game (F3). More specifically, an effect is conducted when the result of the step F2 is "occurrence" or "effect only". If no effect for the start of a common game is conducted (F3: NO), the routine finishes.

On the other hand, if the effect for the start of a common game is conducted (F3: YES), the main CPU 241 determines whether a bonus game is being run on any one of the gaming terminal 10 (F4). If a bonus game is being run, the routine waits for the end of the bonus game (F4: YES). If no bonus game is being run (F4: NO), a common game start effect image display command corresponding to the selected type of the common game is transmitted to all gaming terminals 10 (F5) and a common game start effect image is displayed on the upper display 700 (F6).

Thereafter, the main CPU 241 transmits a common game start signal to each gaming terminal 10 qualified to participate in the common game (F7). More specifically, with reference to the game qualification time management table shown in FIG. 15, the common game start signal is transmitted to each gaming terminal 10 having a qualification time. It is noted that the common game start signal has information regarding the highest payout rate among the game qualification times of the gaming terminals 10 in the game qualification time management table. In other words, the main CPU 241 notifies the gaming terminals 10 of the highest payout rate of each terminal. Furthermore, with reference to the game qualification time management table shown in FIG. 15, a common game non-participating payout signal is sent to the gaming terminals 10 not having the qualification time.

The main CPU 241 then determines the winning bonus type of each participating gaming terminal 10 with reference to tables such as the first common game probability table shown in FIG. 35 and the third common game probability table shown in FIG. 38 (F8). Thereafter, the payout for each participating gaming terminal 10 is determined based on the determined winning bonus type of each participating gaming terminal 10, payout information is transmitted to each gaming terminal 10 (F9), and the routine finishes.

Note that the common game random determination process is being executed while the common game is being run. When the start of a common game is awarded while a common game is being run, a fixed payout is awarded to a gaming terminal 10 which is not participating in the common game but has a qualification time. More specifically, each gaming terminal 10 executes the non-participating terminal payout process shown in FIG. 56.

In the non-participating terminal payout process, first of all, whether a common game non-participating payout signal has been received from the center controller 200 is determined (O1). If no common game non-participating payout signal has been received (O1: NO), the process is terminated. On the other hand, if the common game non-participating payout signal has been received (O1: YES), a predetermined fixed payout is awarded as a mystery competition bonus.

(Progressive Bonus Related Process)

Now, a progressive bonus related process will be described with reference to FIG. 51. The main CPU 41 of the gaming terminal 10 executes a progressive bonus related process shown in FIG. 51 in C5 of the terminal-side basic game process shown in FIG. 45.

To begin with, the main CPU 41 calculates an accumulation value added to the progressive bonus (K1). More specifically, when a betting is made in C1, the main CPU 41 multiplies the bet amount by a predetermined accumulation rate (e.g., 10%), so as to figure out an accumulation value added to the progressive bonus.

Thereafter, the main CPU 41 sends the calculated accumulation value to be added to the progressive bonus to the progressive controller 340 (K2). The process is then terminated.

(Terminal-Side Progressive Bonus Process)

Figure 52:
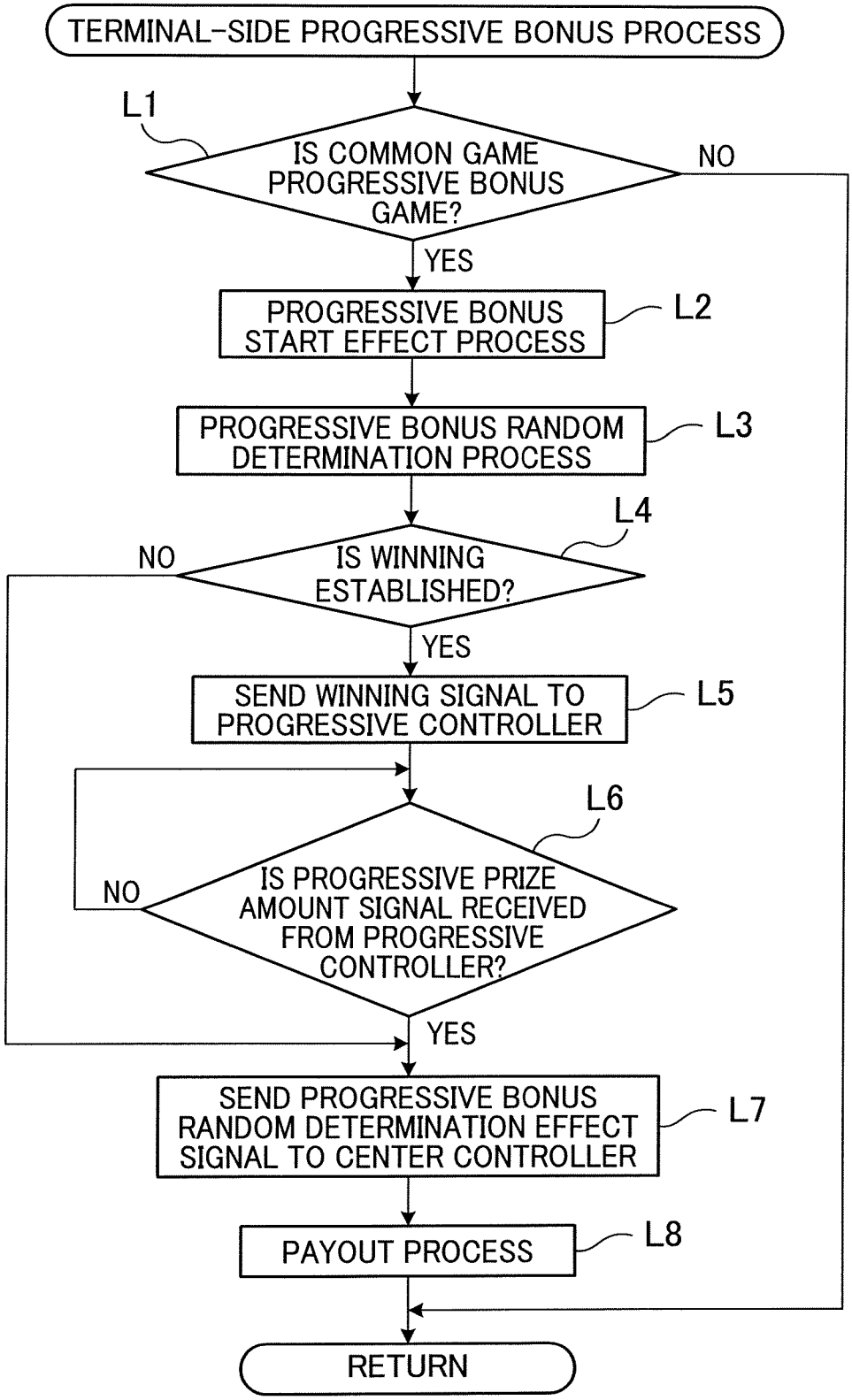
FIG. 52 is a flowchart of a terminal-side progressive bonus process.

Now, a terminal-side progressive bonus process will be described with reference to FIG. 52. To begin with, the main CPU 41 of the gaming terminal 10 determines whether the common game having occurred in F2 is a progressive bonus game (L1). If the common game is not the progressive bonus game (L1: NO), the process is terminated.

On the other hand, if the game is the progressive bonus game (L1: YES), a progressive bonus start effect process is executed (L2). In this process, a lookup display unit 404 shown in FIG. 21 is displayed on the terminal image display panel 16.

Thereafter, the main CPU 41 executes a progressive bonus random determination process (L3). In this process, internal random determination is carried out so that one of the grande progressive bonus, the major progressive bonus, the minor progressive bonus, and the mini progressive bonus, or a blank is awarded.

Subsequently, the main CPU 41 determines, as a result of the progressive bonus random determination, whether one of the grande progressive bonus, the major progressive bonus, the minor progressive bonus, and the mini progressive bonus is awarded (L4).

When one of the grande progressive bonus, the major progressive bonus, the minor progressive bonus, and the mini progressive bonus is awarded (L4: YES), information indicating that the grande progressive bonus, the major progressive bonus, the minor progressive bonus, or the mini progressive bonus is awarded and information for identifying the winning gaming terminal 10 are sent to the progressive controller 340 as a winning signal (L5).

Thereafter, the main CPU 41 determines whether the progressive prize amount signal has been received from the progressive controller 340 (L6). If the progressive prize amount signal has not been received (L6: NO), the progressive prize amount signal is waited for.

On the other hand, if the progressive prize amount signal has been received (L6: YES) or winning is not achieved in L4 (L4: NO), the main CPU 41 sends a progressive bonus random determination effect signal to the center controller 200 (L7).

Subsequently, the main CPU 41 executes a payout process (L8). More specifically, a progressive prize amount is awarded as a payout based on the progressive prize amount signal having been received in L6.

(Progressive-Controller-Side Progressive Bonus Process)

Figure 53:
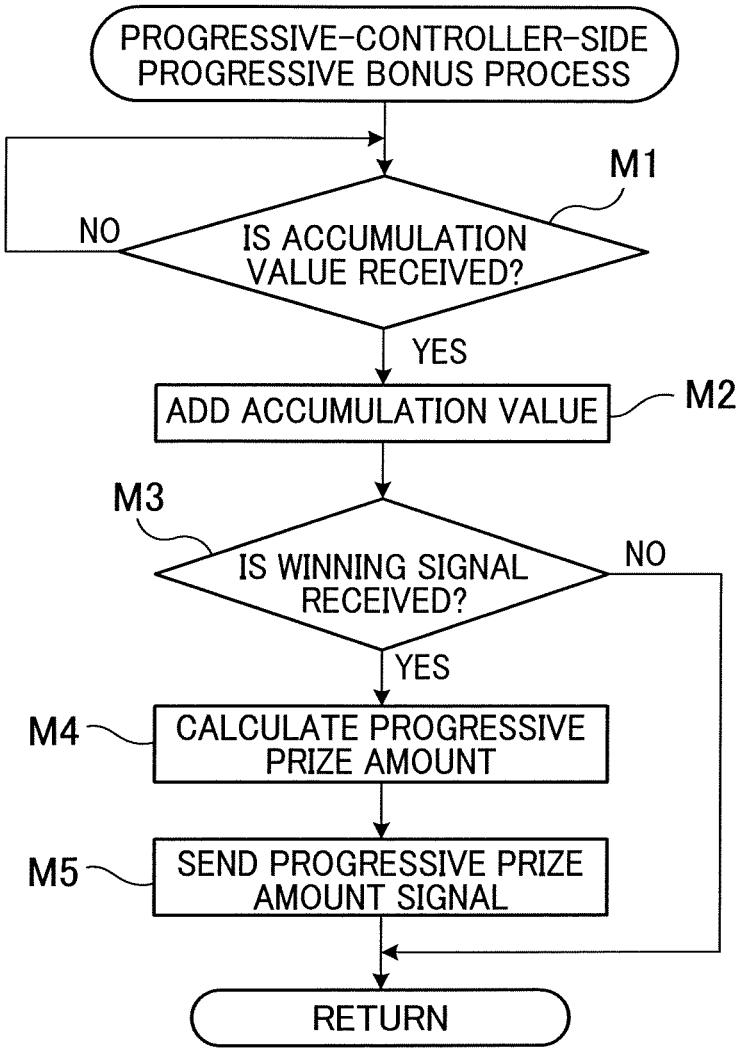
FIG. 53 is a flowchart of a progressive-controller-side progressive bonus process.

Although not illustrated, a progressive-controller-side progressive bonus process shown in FIG. 53 is executed by a CPU of the progressive controller 340.

To begin with, the CPU determines whether the accumulation value to be added to the progressive bonus, which is sent from the gaming terminal 10 as a result of the above-described progressive bonus related process in K2, has been received (M1). If the accumulation value to be added to the progressive bonus has not been received (M1: NO), the value is waited for.

On the other hand, if the accumulation value to be added to the progressive bonus has been received (M1: YES), the progressive bonus amount is updated such that the accumulation value is added to the progressive bonus amount accumulated in the RAM 343 (M2). In this regard, there are four types of the progressive bonus amount accumulatively stored in the RAM 343, namely, a grande progressive bonus amount, a major progressive bonus amount, a minor progressive bonus amount, and a mini progressive bonus amount. The transmitted accumulation value to be added to the progressive bonus is added to the grande progressive bonus amount, the major progressive bonus amount, the minor progressive bonus amount, and the mini progressive bonus amount at the ratio of 4:3:2:1 and accumulatively stored. For example, when the transmitted accumulation value is "1", "0.4" is added to the grande progressive bonus amount, "0.3" is added to the major progressive bonus amount, "0.2" is added to the minor progressive bonus amount, and "0.1" is added to the mini progressive bonus amount, respectively.

Subsequently, the CPU determines whether the winning signal transmitted from the gaming terminal 10 as a result of the above-described terminal-side progressive bonus process in L5 has been received (M3). If the winning signal has not been received (M3: NO), the process is terminated.

On the other hand, if the winning signal has been received (M3: YES), a progressive prize amount is calculated (M4). More specifically, the type of the awarded progressive bonus (one of the grande progressive bonus, the major progressive bonus, the minor progressive bonus, and the mini progressive bonus) is determined with reference to the winning signal, and a progressive bonus amount corresponding to the determined type of the progressive bonus is selected as the progressive prize amount.

Subsequently, to the gaming terminal 10 which has sent the winning signal, the progressive prize amount calculated in M4 is sent as a progressive prize amount signal (M5). With this step, the process is terminated.

(Center-Controller-Side Progressive Bonus Process)

Figure 54:
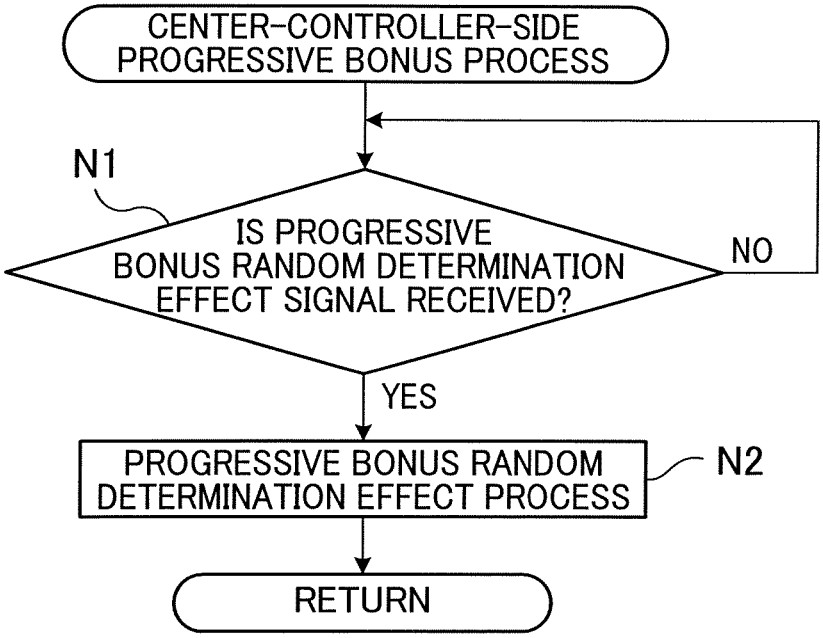
FIG. 54 is a flowchart of a center-controller-side progressive bonus.

After completing the center-side initial setting routine, the main CPU 241 of the center controller 200 executes a center-controller-side progressive bonus process shown in FIG. 54.

To begin with, the main CPU 241 determines whether the progressive bonus random determination effect signal transmitted from the gaming terminal 10 as a result of the above-described terminal-side progressive bonus process in L7 has been received (N1). If the progressive bonus random determination effect signal has not been received (N1: NO), the progressive bonus random determination effect signal is waited for.

Figure 55:
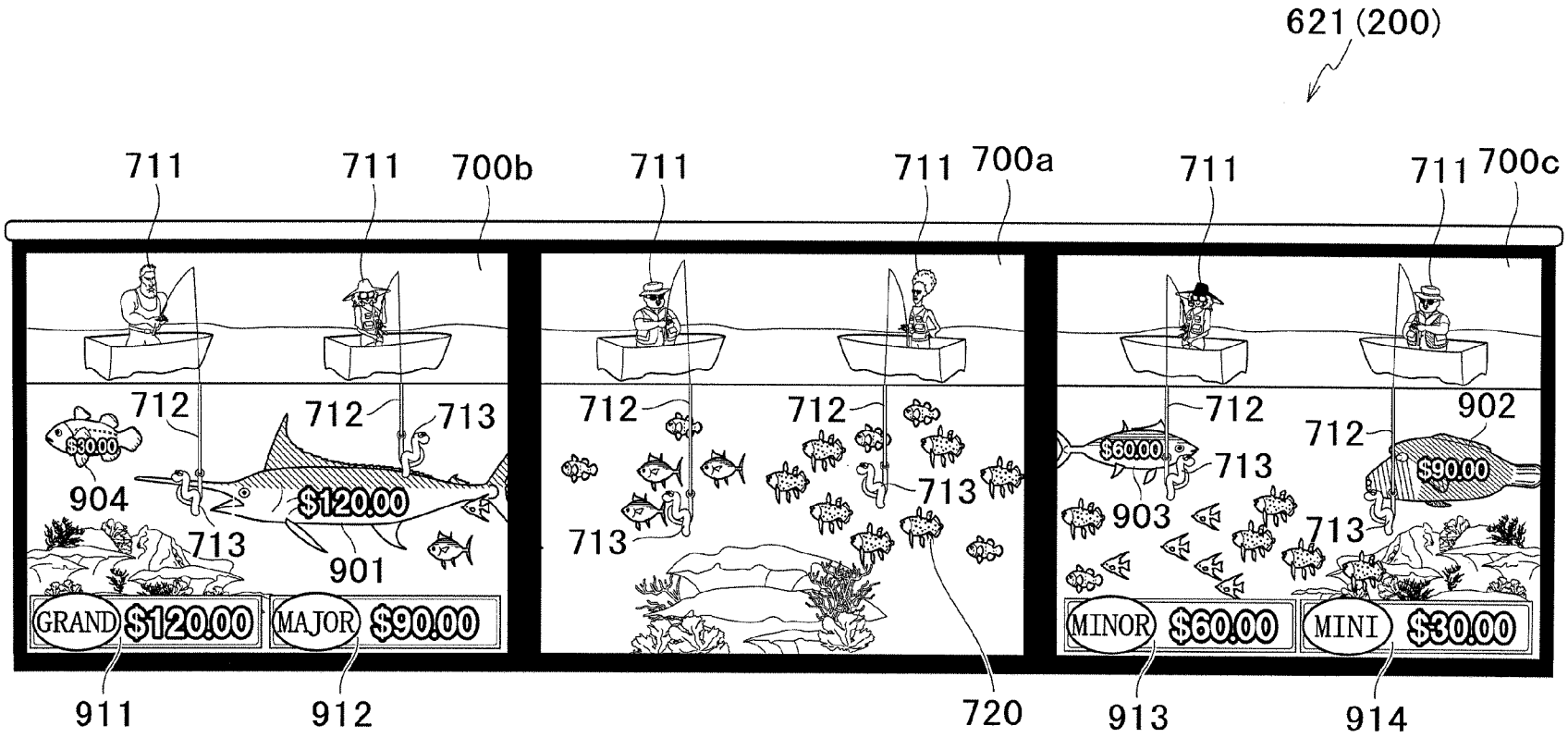
FIG. 55 shows an example of a progressive bonus effect image.

On the other hand, if the progressive bonus random determination effect signal has been received (N1: YES), a progressive bonus random determination effect process is executed (N2). In this process, in a later-described progressive bonus effect image shown in FIG. 55 is displayed a fisher image 711 corresponding to the winning gaming terminal 10 catches a fish school image 720 (one of the grande fish 901, the major fish 902, the minor fish 903, and the mini fish 904) corresponding to the type of the progressive bonus (one of the grande progressive bonus, the major progressive bonus, the minor progressive bonus, and the mini progressive bonus) selected in the progressive bonus random determination process. With this step, the process is terminated.

(Progressive Bonus Effect Image)

When no common game has occurred, a progressive bonus effect image shown in FIG. 55 is displayed. This progressive bonus effect image is stored in the RAM 243 of the center controller 200.

FIG. 55 shows the display states of upper displays 700*a*, 700*b*, and 700*c*. More specifically, on the upper displays 700*a*, 700*b*, and 700*c*, a game start effect image that shows many fish school images 720 pass through from right to left is displayed. The fish school images 720 include images representing grande fish 901, major fish 902, minor fish 903, and mini fish 904. Furthermore, on the grande fish 901, the major fish 902, the minor fish 903, and the mini fish 904, a grande progressive bonus amount, a major progressive bonus amount, a minor progressive bonus amount, and a mini progressive bonus amount, which are accumulatively stored in the RAM 343, are displayed, respectively.

In addition to the above, at the bottom parts of the upper displays 700*a*, 700*b*, and 700*c* are displayed a grande display frame 911 for displaying the grande progressive bonus amount, a major display frame 912 for displaying the major progressive bonus amount, a minor display frame 913 for displaying the minor progressive bonus amount, and a mini display frame 914 for displaying the mini progressive bonus amount. At the top parts of the upper displays 700*a*, 700*b*, and 700*c* are displayed a fisher image 711, a fishhook image 712, and a fishing bait image 713. The fisher images 711 are different for the respective gaming terminals 10 to indicate which image corresponds to each gaming terminal 10.

As described above, inclusive of the basic game, on the upper displays 700*a*, 700*b*, and 700*c* are displayed grande fish 901, major fish 902, minor fish 903, and mini fish 904 representing a grande progressive bonus, a major progressive bonus, a minor progressive bonus, and a mini progressive bonus, respectively. Because a current grande progressive bonus amount, a current major progressive bonus amount, a current minor progressive bonus amount, and a current mini progressive bonus amount are displayed on the grande fish 901, the major fish 902, the minor fish 903, and the mini fish 904, respectively, the player is able to visually grasp a progressive prize amount to be paid out if the player succeeds in fishing at this stage.

Thereafter, when a progressive bonus random determination effect process in a center-controller-side progressive bonus process, an effect image is displayed to show that a fisher image 711 corresponding to the winning gaming terminal 10 catches a fish school image 720 (one of the grande fish 901, the major fish 902, the minor fish 903, and the mini fish 904) corresponding to the type of the progressive bonus (one of the grande progressive bonus, the major progressive bonus, the minor progressive bonus, and the mini progressive bonus) selected in the progressive bonus random determination process (L3).

According to the arrangement above, game qualification time for participating in a common game (third game) is available in a basic game (first game). This game qualification time is awarded in accordance with a bet amount stored in the RAM 243 (memory) after receiving a bet input by means of the 1-bet button 26 and the maximum bet button 27 (switch). A winning probability in a quick catch bonus game (second game) which is played when the basic game results in a predetermined result is increased in accordance with the length of the game qualification time defined in the game qualification time management table (timer) stored in the RAM 243 (i.e., change from the basic quick catch bonus payout table to the special quick catch bonus payout table). This motivates the player to continue the basic game and also to participate in the common game, with the result that the entertainment factor is enhanced.

Furthermore, according to arrangement above, game qualification time required for participating in a common game (third game) from a basic game (first game) is available. This game qualification time is counted and stored in the game qualification time management table (timer) in the RAM 243, in accordance with the bet amount stored in the RAM 243 (memory) after receiving a bet input by means of the 1-bet button 26 and the maximum bet button 27 (switch). When in the basic game the quick catch bonus game (second game) is awarded as a result of satisfying a predetermined condition and the quick catch bonus game is executed, the table defining a winning probability of a benefit is changed from a basic quick catch bonus payout table (second game basic random determination table) to a special quick catch bonus payout table (second game specific random determination table), and a benefit is awarded after random determination.

In this regard, according to the present arrangement, because a predetermined maximum qualification time table (upper limit) is applied for the game qualification time, it is possible to prevent the participation in a common game from becoming too advantageous for the players, and hence the balance in the benefit is balanced between the players and the administrator of the gaming machine 300. However, it is unilaterally disadvantageous toward the players if the game qualification time does not increase beyond the upper limit when the awarded game qualification time becomes longer than the upper limit.

To solve this problem, when the game qualification time counted in the game qualification time management table exceeds the predetermined upper limit (40 seconds), the disadvantage of the players is resolved such that, in the quick catch bonus game (second game), a benefit is awarded based on the special quick catch bonus payout table (second game specific random determination table) defining the winning probability which has been increased in accordance with the time exceeding the upper limit.

This motivates the player to continue the basic game and also to participate in the common game, with the result that the entertainment factor is enhanced.

Furthermore, according to the arrangement above, regarding a gaming machine 300 in which a plurality of gaming terminals 10 and a center controller 200 are used and a basic game (first game) run by a gaming terminal 10 is shifted to a common game in which game qualification time is set and in which only a gaming terminal 10 having a game qualification time is able to participate, whether a starting condition of a common game (third game) is established is determined at predetermined intervals (in each second in the present embodiment), a common game in which gaming terminals 10 having the game qualification time are synchronized is executed when the starting condition of the common game is established, and an award (payout) and a winning gaming terminal 10 receiving the award are determined based on the execution result of the common game. If in each gaming terminal 10 the game qualification time counted in the game qualification time management table (timer) exceeds the upper limit defined in the predetermined maximum qualification time table, the disadvantage of the player who exceeds the upper limit is resolved such that, in the quick catch bonus game (second game) awarded when a predetermined condition is satisfied in the basic game, a benefit is awarded based on the special quick catch bonus payout table (second game specific random determination table) which defines a winning probability which has been increased based on the time exceeding the upper limit.

This motivates the player to continue the basic game and also to participate in the common game, with the result that the entertainment factor is enhanced.

According to the arrangement above, only the gaming terminals to which the common game qualification time is given are allowed to join a common game (third game). Based on the bet amount stored in the RAM 243 (memory), game qualification time to be awarded and a payout rate of each unit time of the game qualification time are determined, and the game qualification time of each payout rate is added and stored in the game qualification time management table (timer) in association with the payout rate, for each gaming terminal 10. This motivates the players to continue the playing of the basic game with a high bet amount, thereby improving the entertainment characteristics.

Furthermore, according to the arrangement above, a winning probability in the special quick catch bonus payout table (second game specific random determination table) is calculated by adding, to the winning probability defined in the basic quick catch bonus payout table (second game basic random determination table), a value calculated by multiplying the time exceeding the upper limit by a predetermined value (which is 80/18038 in the present embodiment). This makes it possible to balance the winning probabilities between the special quick catch bonus payout table and the basic quick catch bonus payout table, so as to prevent the winning probability in the special quick catch bonus payout table from becoming excessively high or low.

Furthermore, according to the arrangement above, when the basic game (first game) results in a predetermined result, it is possible to shift to the quick catch bonus game (second game) having a different winning probability from the basic game, and the winning probability in the quick catch bonus game after the shifting is increased in accordance with the bet amount bet in the basic game. This motivates the players to continue the playing of the basic game with a high bet amount, thereby improving the entertainment characteristics.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

For example, the aspects, values, or the like concerning the effects are not limited to those recited in the embodiment above. Furthermore, the data or the like exchanged between the gaming terminals 10 and the center controller is not limited to the above. For example, the information of the number of paylines L activated in response to betting is transmitted in the present embodiment. Not limited to this, information indicating the bet amount may be transmitted. In this case, a table associated with the number of paylines may be associated with the bet amount or the range of the bet amount.

In addition to the above, while the present embodiment is arranged so that effects are conducted after the random determination of payouts of a basic game, a bonus game, and a common game, the random determination may be carried out while the effect is being conducted. For example, as effects during a bonus game and a common game, a payout amount is indicated by using the fish image 714 and the fishing bait image 713. In this regard, the following effect may be carried out using the fishing bait image 713.

More specifically, when an effect of causing the fish image 714 to approach the fishing bait image 713 is conducted and the probability of winning a bonus corresponding to that fish image 714 is high (e.g., 73% or higher), the fishing bait image 713 is displayed in red. When the probability of winning a bonus corresponding to that fish image 714 is middle (e.g., 54% or higher), the fishing bait image 713 is displayed in orange. When the probability of winning a bonus corresponding to that fish image 714 is low (e.g., less than 53%), the color of the fishing bait image 713 is maintained to be green. In addition to the above, the fish image 714 may be arranged to open the mouth to attack the fishing bait image 713 displayed in red, and the fish image 714 may also be arranged to peck at the fishing bait image 713 by the mouth when the fishing bait image 713 is displayed in orange.

In addition to the above, the base game qualification time awarding table shown in FIG. 14 is arranged so that a plurality of payout rates are awarded for each number of activated paylines, but the disclosure is not limited to this. For example, as shown in FIG. 57, a payout rate is independently awarded for each number of activated paylines.

Figures 56, 57:
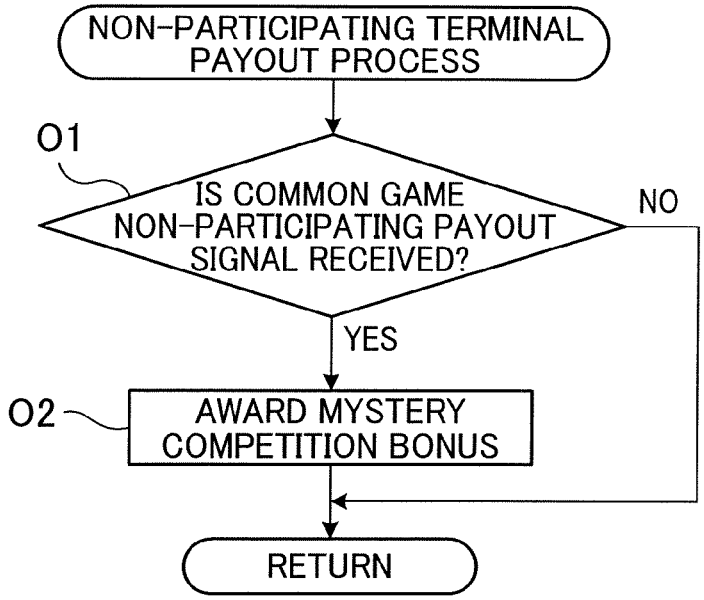
FIG. 56 is a flowchart of a non-participating terminal payout process.
FIG. 57 illustrates a modification of the base game qualification time awarding table.

More specifically, in the case of FIG. 57, if the number of paylines L activated as a result of betting on the basic game is one, game qualification time of six seconds is awarded. The payout rate is therefore one for six seconds of the game qualification time. For example, when the number of activated paylines L corresponding to the betting on a basic game is five, eight seconds are awarded as the common game qualification time. The payout rate is one for one second, two for one second, three for one second, and four for one second of the common game qualification time, and is five for four seconds of the common game qualification time. As such, the number of activated paylines increases as the bet amount increases in a basic game, and an awarded game qualification time and a payout rate also increase.

Because a payout rate is independently awarded for each number of activated paylines, for example, qualification time of the same payout rate is accumulated as the player repeatedly bets the same bet amount. In this case, because at least a qualification time of smaller than the payout rate above is not accumulated, the payout rate is kept to be equal to or higher than a predetermined value, until the qualification time reaches zero.

In addition to the above, the present embodiment is arranged so that, when any one of the gaming terminals 10 wins an independent special game or a mystery bonus and effect regarding the same is being conducted on any one of the gaming terminal area 703 of the upper display 700, a common game starts after the end of the effect even if the start of a common game is determined. the disclosure, however, is not limited to this. For example, when the start of a common game is determined, the effect concerning the independent special game or mystery bonus may be canceled and the common game may be stared. This allows the gaming terminal 10 qualified to participate in the common game to start the common game without waiting for the end of the common game which is being run.

Figure 58:
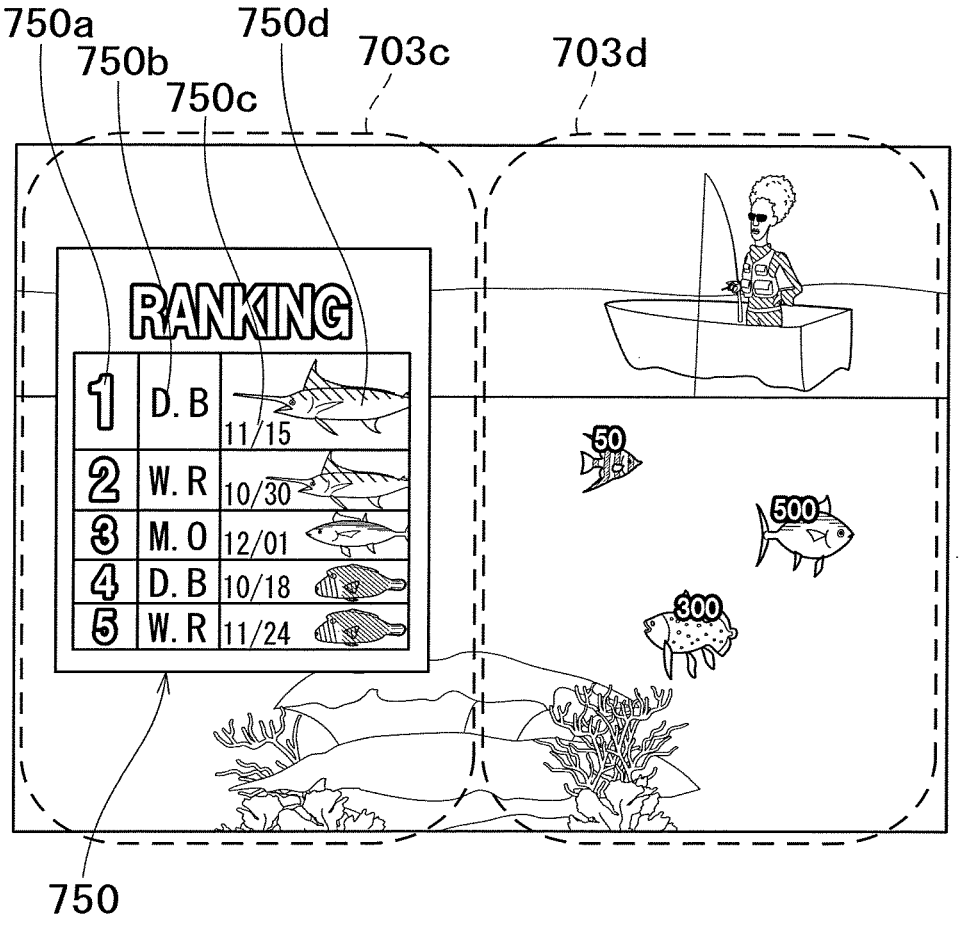
FIG. 58 shows an example of a display screen of a ranking.

In addition to the above, when no game is run by the gaming machine 300 or no game is run by any one of the gaming terminals 10, the ranking of bonus types which have been awarded as payouts may be displayed on the upper display 700 as shown in FIG. 58.

In FIG. 58, no game is being run at the gaming terminal 10*c*. More specifically, at the central part of the gaming terminal area 703*c* corresponding to the gaming terminal 10*c*, a ranking image 750 is displayed. The ranking image 750 has a ranking area 750*a*, a name area 750*b*, a date area 750*c*, and a fish area 750*d*. The ranking area 750*a* shows the ranking of amounts of awarded bonuses. The name area 750*b* shows the names of player who have obtained bonuses. If the gaming terminals 10 can store a membership card or the like storing an identification name of each player and a member ship number, the name, the membership number, or the like may be displayed. The date area 750*c* displays dates of obtaining bonuses. The fish area 750*d* displays images of fishes corresponding to obtained bonuses. It is noted that the fish area 750*d* may display texts indicating obtained bonuses, unit payout amounts of obtained bonuses, or one of them including the images of the fishes. The ranking may be determined based on unit payout amounts of obtained bonuses or based on a calculation of multiplying a unit payout amount by a payout rate.

Furthermore, in the present embodiment, as the count display unit 720 in FIG. 33 shows, the execution time of a common game, which is predetermined, may be arranged to be changeable for each gaming terminal 10, to allow the execution time of the common game to be extendable in accordance with an average bet amount in each unit game of the basic game before the start of the common game. In this case, a current average bet amount is required to be displayed on the terminal image display panel 16. With this, in consideration of a common game that starts at an unknown timing, the player is able to adjust the bet amount made by the player to execute a common game with the desired execution time, while checking the average bet amount displayed on the terminal image display panel 16.

In addition to the above, the execution time of the common game may be elongated based on the accumulative bet amount until the start of the common game. Also in this case, it is desirable to display the current accumulative bet amount on the terminal image display panel 16. According to this arrangement, in consideration of a common game that starts at an unknown timing, the player is able to adjust the bet amount made by the player to execute a common game with a desired execution time, while checking the average bet amount displayed on the terminal image display panel 16. Furthermore, because the accumulative bet amount is adjusted, fine adjustment is possible and hence strategic excitement is high as compared to the case where the average bet amount is adjusted.

In addition to the above, the execution time of the common game may be determined based on the bet amount in the basic game immediately before the start of the common game. According to this arrangement, in consideration of a common game that starts at an unknown timing, the player may increase the bet amount to always secure a desired execution time of a common game.

Figure 59:
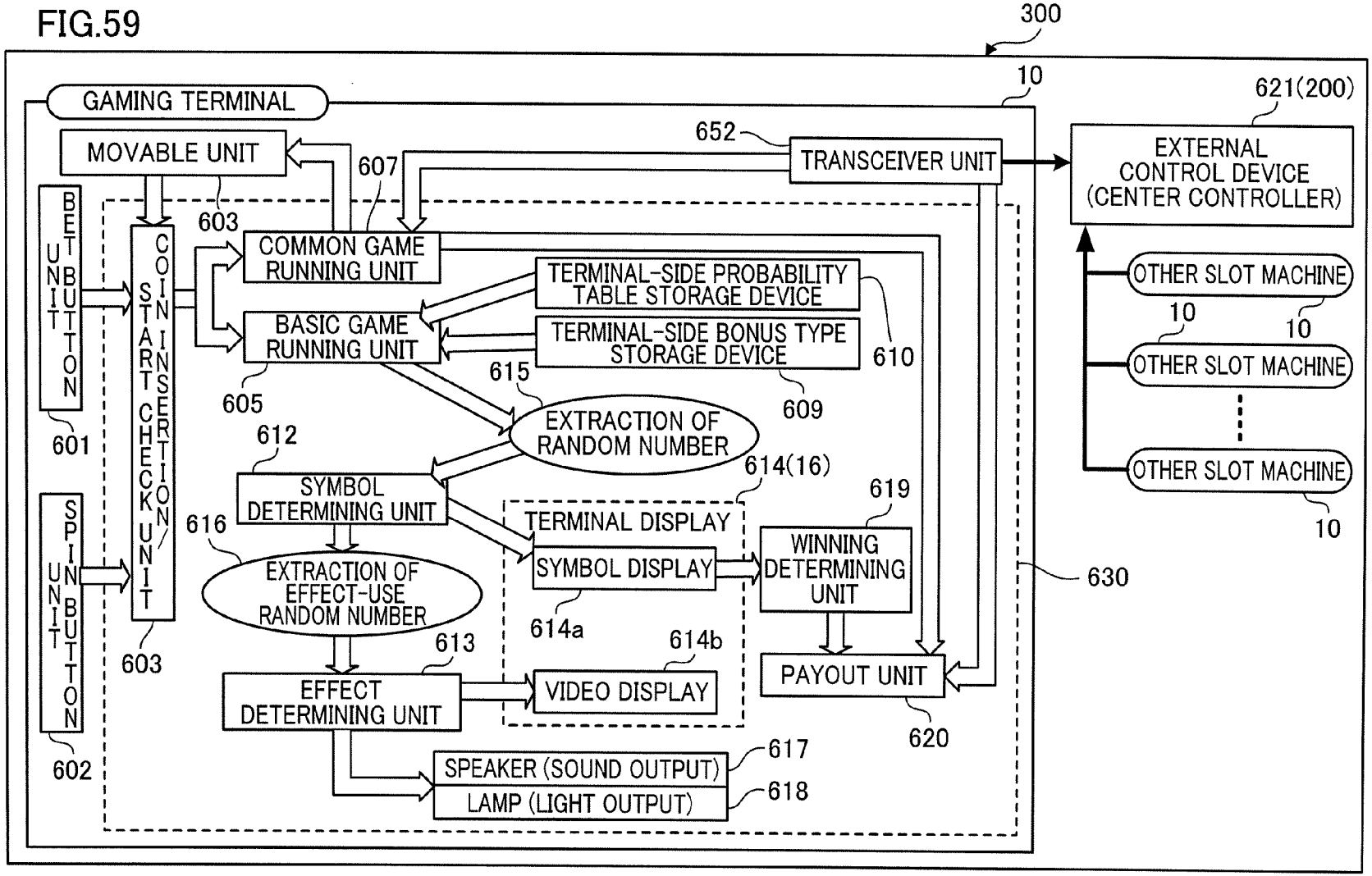
FIG. 59 is a block diagram of a gaming terminal of a modification.

In the gaming machine 300 of the embodiment above, as shown ion FIG. 2, the gaming terminal 10 and an external controller (center controller 200, etc.) which is connected with the gaming terminals 10 to be able to communicate therewith are able to communicate with each other in mutual directions. Alternatively, as shown in FIG. 59, the external controller 621 (e.g., center controller 200) may only receive data from the gaming terminal 10 or the like but not transmit data to the outside. In such a case, data communication is one way from the gaming terminal 10 to the external controller 621 (center controller 200, etc.).

More specifically, the operation of the gaming machine 300 when is connected so that one-way data communication from the gaming terminal 10 to the external controller 621 (center controller 200, etc.) is carried out will be described with reference to the flow of the modification below. In this modification, the descriptions identical with those of the embodiment above will not be repeated.

(Terminal-Side Basic Game Process Routine in Modification)

In the embodiment above, the main CPU 41 of the gaming terminal 10 carries out the terminal-side basic game process routine shown in FIG. 45 after the completion of the terminal side initial setting routine shown in FIG. 44. In the modification, a basic game progresses as the main CPU 41 executes a terminal-side basic game process routine of the modification shown in FIG. 60.

C1 to C15 in the terminal-side basic game process routine of the modification are identical with C1 to C15 in the terminal-side basic game process routine shown in FIG. 45. In the modification, after the completion of the terminal-side bonus process in C15, the terminal-side progressive bonus process shown in FIG. 52 is executed. L1 in this process is different from the step in the embodiment above. More specifically, internal random determination of whether to start a progressive bonus game is carried out to determine whether to start the progressive bonus game (L1). If it is determined that the progressive bonus game is started (L1: YES), the progressive bonus start effect process of L2 is executed in the same manner as the embodiment above. If it is determined not to start the progressive bonus game (L1: NO), the process is terminated. The subsequent processes are identical with the embodiment above.

Figure 60:
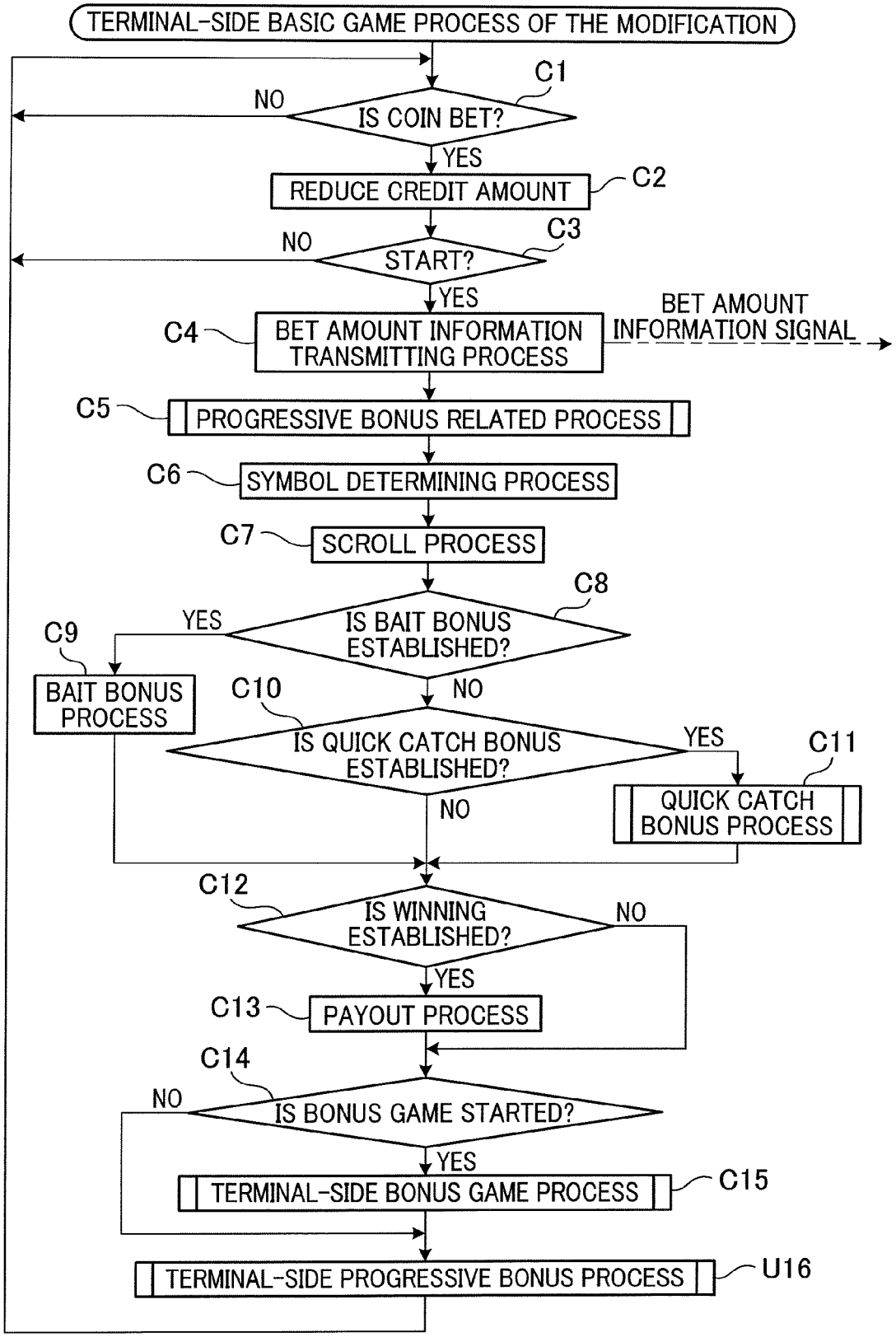
FIG. 60 is a flowchart of a terminal-side basic game process of the modification.

As the terminal-side basic game process routine of the modification shown in FIG. 60 is executed, the progressive-controller-side progressive bonus process shown in FIG. 53 is executed in the progressive controller 340, whereas the center-controller-side progressive bonus process shown in FIG. 54 is executed in the center controller 200.

As such, the gaming machine 300 of the modification is arranged so that, as shown in FIG. 54, the center controller 200 merely receives the progressive bonus random determination effect signal and produces an effect such as the progressive bonus effect image show in above-described FIG. 55 on the upper displays 700*a*, 700*b*, and 700*c* of the center controller 200, and does not transmit data to other devices such as the gaming terminal 10.

(Another Embodiment)

Figure 61:
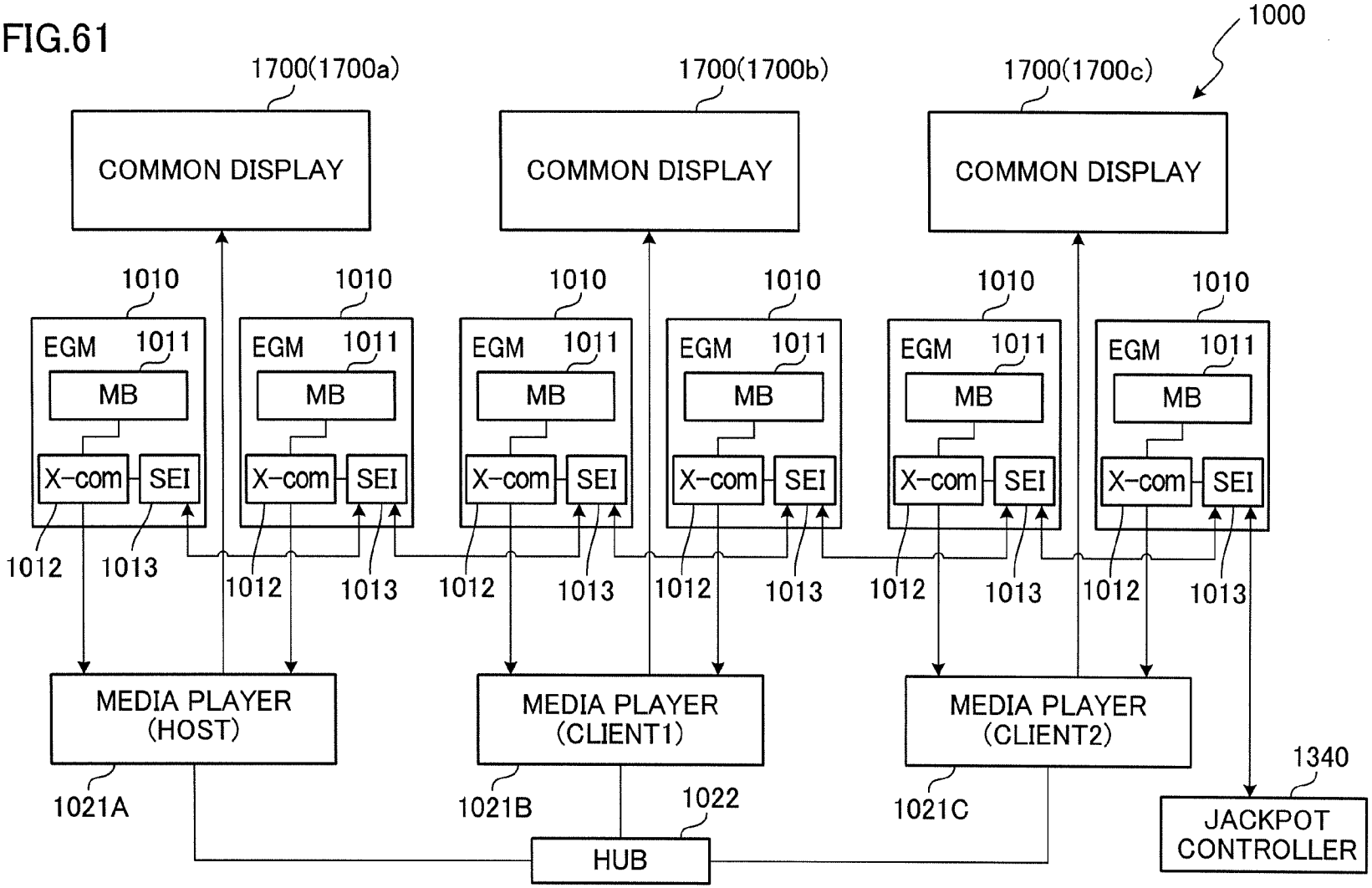
FIG. 61 illustrates the internal connection structure of a gaming machine another embodiment.

In addition to the above, referring to FIG. 61, the internal connection structure of a gaming machine 1000 of Another Embodiment, which includes gaming terminals 1010. FIG. 61 shows a gaming machine 1000 of Another Embodiment including gaming terminals 1010.

The gaming machine 1000 includes, as shown in FIG. 61, six gaming terminals (EGM (Each Gaming Machine)) 1010, media players 1021A, 1021B, and 1021C (each of which is connected to two gaming terminals 1010), a HUB 1022 connecting the three media players 1021A, 1021B, and 1021C with one another by means of LAN cables, a jackpot controller 1340 provided with a RAM, and three common displays 1700 (1700*a*, 1700*b*, and 1700*c*) connected to the media players 1021A, 1021B, and 1021C, respectively.

The gaming terminal 1010 is identical with the gaming terminal described in the embodiment above, except that a mother board (MB) 1011 having a CPU is mounted, and includes an X-com board 1012 that allows the media players 1021A, 1021B, and 1021C corresponding to the respective gaming terminals 1010 to perform only one-way communications and an SEI (Serial Electric Interface) 1013 that is able to perform two-way communications with the other gaming terminals 1010 and the jackpot controller 1340. The media player 1021A has a function of hosting the other media players 1021B and 1021C. That is to say, the media players 1021B and the 1021C are clients of the media player 1021A. The media players 1021A, 1021B, and 1021C are connected to the respective common displays 1700 (1700*a*, 1700*b*, and 1700*c*) by means of monitor cables, and function as the center controllers for controlling the common displays 1700 (1700*a*, 1700*b*, and 1700*c*). The jackpot controller 1340 is similar to the progressive controller 340 described in the embodiment above.

Now, a gaming-terminal-side SEA FISHING BONUS process as the terminal-side bonus game process and a media player process executed by the media players 1021A, 1021B, and 1021C, when the gaming machine 1000 is used and "SEA FISHING BONUS" is started as the bonus game in each gaming terminal 1010 and in the media players 1021A, 1021B, and 1021C, will be described with reference to FIG. 62 to FIG. 65.

(Gaming-Terminal-Side SEA FISHING BONUS Process)

Figure 62:
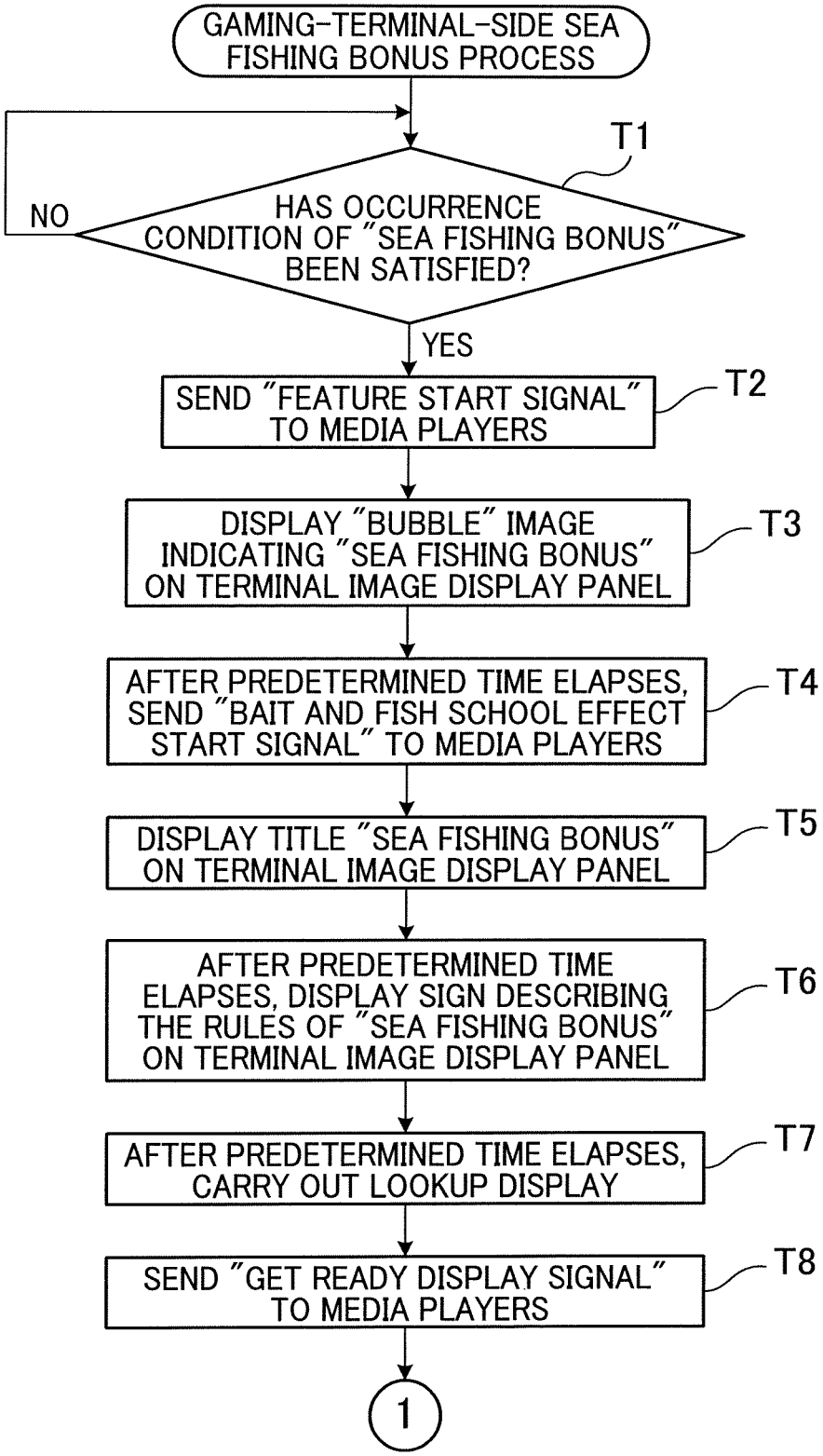
FIG. 62 is a flowchart of a gaming-terminal-side SEA FISHING BONUS process.
Figure 63:
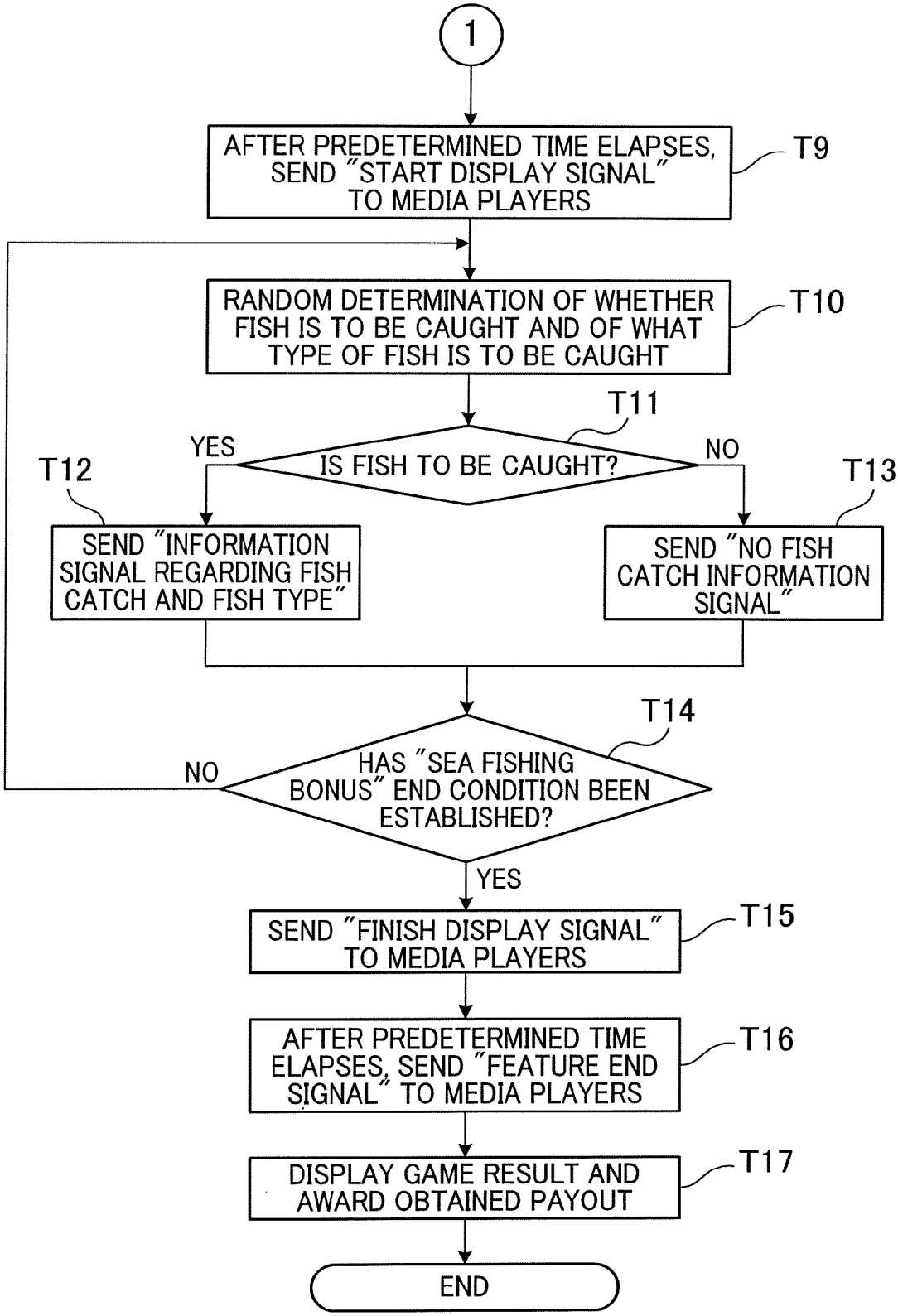
FIG. 63 is a flowchart of the gaming-terminal-side SEA FISHING BONUS process.

The CPU of the mother board (MB) 1011 executes a gaming-terminal-side SEA FISHING BONUS process routine shown in FIG. 62 and FIG. 63, when it is determined that the gaming-terminal-side SEA FISHING BONUS process is to be executed as the terminal-side bonus game process.

As shown in FIG. 62, the CPU of the mother board (MB) 1011 determines whether the occurrence condition of "SEA FISHING BONUS" has been satisfied (T1). More specifically, when three predetermined symbols triggering "SEA FISHING BONUS" are stopped on the payline L shown in FIG. 20, it is determined that the occurrence condition of "SEA FISHING BONUS" is satisfied. When the occurrence condition of "SEA FISHING BONUS" is not satisfied (T1: NO), the routine is on standby.

On the other hand, when the occurrence condition of "SEA FISHING BONUS" is satisfied (T1: YES), the CPU of the mother board (MB) 1011 sends a "feature start signal" to the media players 1021A, 1021B, and 1021C corresponding to the gaming terminals 1010 that have satisfied the occurrence condition of "SEA FISHING BONUS" (T2). In so doing, the "feature start signal" is sent by one-way communication from the X-com board 1012 of the gaming terminal 1010 to the corresponding media players 1021A, 1021B, and 1021C.

Thereafter, a "bubble" image indicating "SEA FISHING BONUS" is displayed on the terminal image display panel 16 of the gaming terminal 1010 (T3). Subsequently, after a predetermined time elapses, a "bait and fish school effect start signal" is sent to the corresponding media players 1021A, 1021B, and 1021C (T4). In so doing, the "bait and fish school effect start signal" is sent by one-way communication from the X-com board 1012 of the gaming terminal 1010 to the media players 1021A, 1021B, and 1021C.

Thereafter, the title "SEA FISHING BONUS" is displayed on the terminal image display panel 16 (T5). Subsequently, after a predetermined time elapses, a sign describing the rules of "SEA FISHING BONUS" is displayed on the terminal image display panel 16 (T6). Subsequently, after a predetermined time elapses, lookup display as shown in FIG. 21 is carried out (T7).

Thereafter, a "GET READY display signal" is sent to the corresponding media players 1021A, 1021B, and 1021C (T8). In so doing, the "GET READY display signal" is sent by one-way communication from the X-com board 1012 of the gaming terminal 1010 to the corresponding media players 1021A, 1021B, and 1021C.

Thereafter, as shown in FIG. 63, after a predetermined time elapses, a "START display signal" is sent to the corresponding media players 1021A, 1021B, and 1021C (T9). In so doing, the "START display signal" is sent by one-way communication from the X-com board 1012 of the gaming terminal 1010 to the corresponding media players 1021A, 1021B, and 1021C.

Subsequently, the CPU of the mother board (MB) 1011 conducts random determination of whether fish is to be caught and of what type of fish is to be caught when fish will be caught in "SEA FISHING BONUS", based on a "SEA FISHING BONUS" random determination table read out from the storage device of the gaming terminal 1010 (T10). By the random determination in T10, whether fish is caught is determined (T11).

If it is determined that fish is caught (T11: YES), an "information signal regarding fish catch and fish type" is sent to the corresponding media players 1021A, 1021B, and 1021C (T12). In so doing, the "information signal regarding fish catch and fish type" is sent by one-way communication from the X-com board 1012 of the gaming terminal 1010 to the corresponding media players 1021A, 1021B, and 1021C.

On the other hand, when it is determined that no fish is caught (T11: NO), a "no fish catch information signal" is sent to the corresponding media players 1021A, 1021B, and 1021C (T13). In so doing, the "no fish catch information signal" is sent by one-way communication from the X-com board 1012 of the gaming terminal 1010 to the media players 1021A, 1021B, and 1021C.

After T12 or T13, the CPU of the mother board (MB) 1011 determines whether a "SEA FISHING BONUS" end condition has been established (T14). When the end condition is not established (T14: NO), the routine shifts to T10.

On the other hand, when the end condition is established (T14: YES), a "FINISH display signal" is sent to the corresponding media players 1021A, 1021B, and 1021C (T15). In so doing, the "FINISH display signal" is sent by one-way communication from the X-com board 1012 of the gaming terminal 1010 to the corresponding media players 1021A, 1021B, and 1021C.

Thereafter, after a predetermined time elapses, a "feature end signal" is sent to the corresponding media players 1021A, 1021B, and 1021C (T16). In so doing, the "feature end signal" is sent by one-way communication from the X-com board 1012 of the gaming terminal 1010 to the corresponding media players 1021A, 1021B, and 1021C.

Thereafter, the game result of "SEA FISHING BONUS" is displayed on the terminal image display panel 16 and the obtained payout is awarded (T17). This marks the end of the routine.

(Media Player Process)

Figure 64:
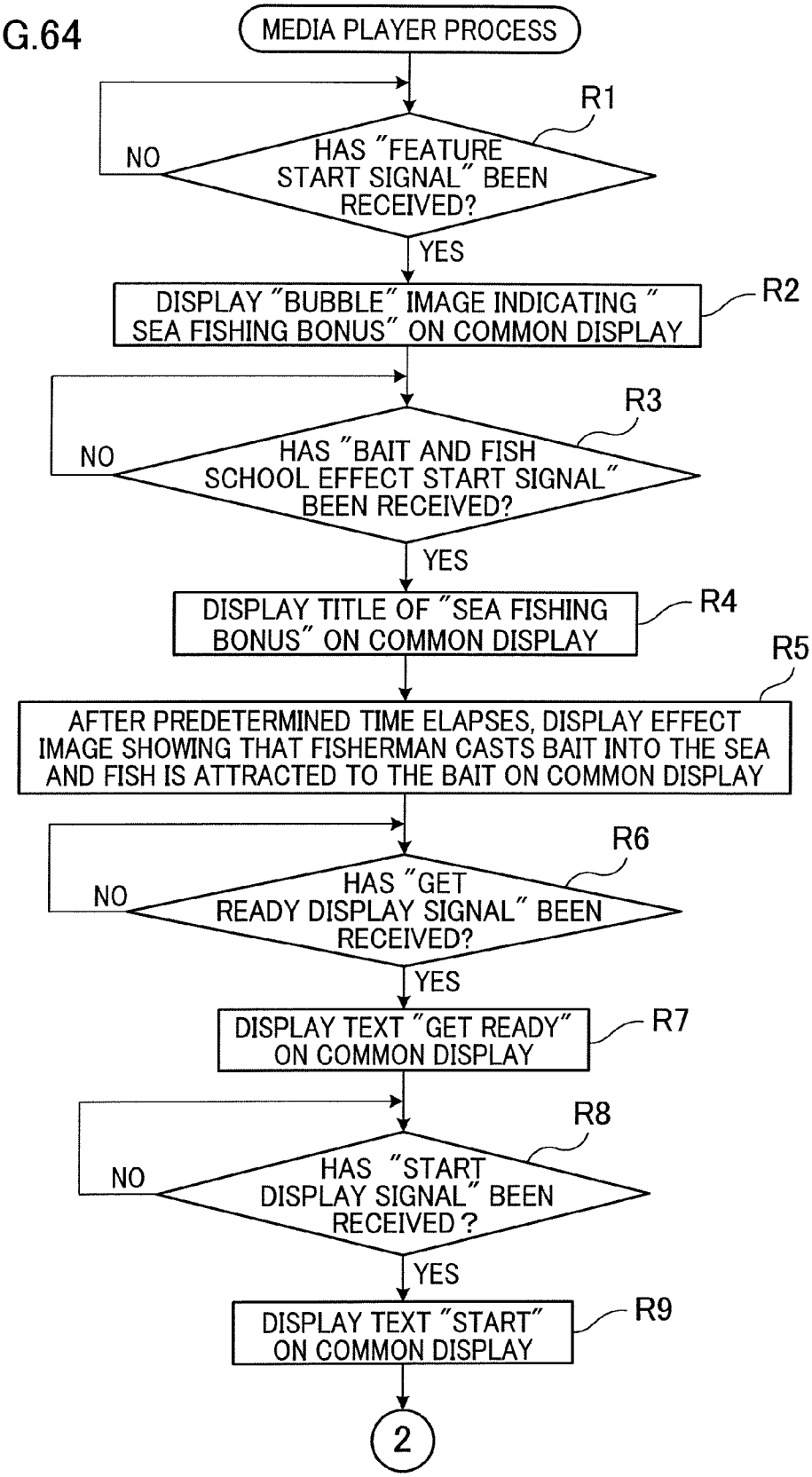
FIG. 64 is a flowchart of a media player process.

To begin with, as shown in FIG. 64, the CPU of each of the media players 1021A, 1021B, and 1021C determines whether the "feature start signal" has been received from the gaming terminal 1010 (R1). When the "feature start signal" has not been received (R1: NO), the "feature start signal" is waited for.

On the other hand, when the "feature start signal" has been received (R1: YES), the common display 1700 displays a "bubble" image indicating "SEA FISHING BONUS" (R2).

Thereafter, the CPU of each of the media players 1021A, 1021B, and 1021C determines whether the "bait and fish school effect start signal" has been received from the gaming terminal 1010 (R3). When the "bait and fish school effect start signal" has not been received (R3: NO), the "bait and fish school effect start signal" is waited for.

On the other hand, when the "bait and fish school effect start signal" has been received (R3: YES), the common display 1700 displays the title of "SEA FISHING BONUS" (R4).

Subsequently, after a predetermined time elapses, an effect image showing that a fisherman casts a bait into the sea and fish is attracted to the bait is displayed on the common display 1700 (R5).

Thereafter, the CPU of each of the media players 1021A, 1021B, and 1021C determines whether the "GET READY display signal" has been received from the gaming terminal 1010 (R6). When the "GET READY display signal" has not been received (R6: NO), the "GET READY display signal" is waited for.

On the other hand, when the "GET READY display signal" has been received (R6: YES), the text "GET READY" is displayed on the common display 1700 (R7).

Subsequently, the CPU of each of the media players 1021A, 1021B, and 1021C determines whether the "START display signal" has been received from the gaming terminal 1010 (R8). When the "START display signal" has not been received (R8: NO), the "START display signal" is waited for.

On the other hand, when the "START display signal" has been received (R8: YES), the text "START" is displayed on the common display 1700 (R9).

Figure 65:
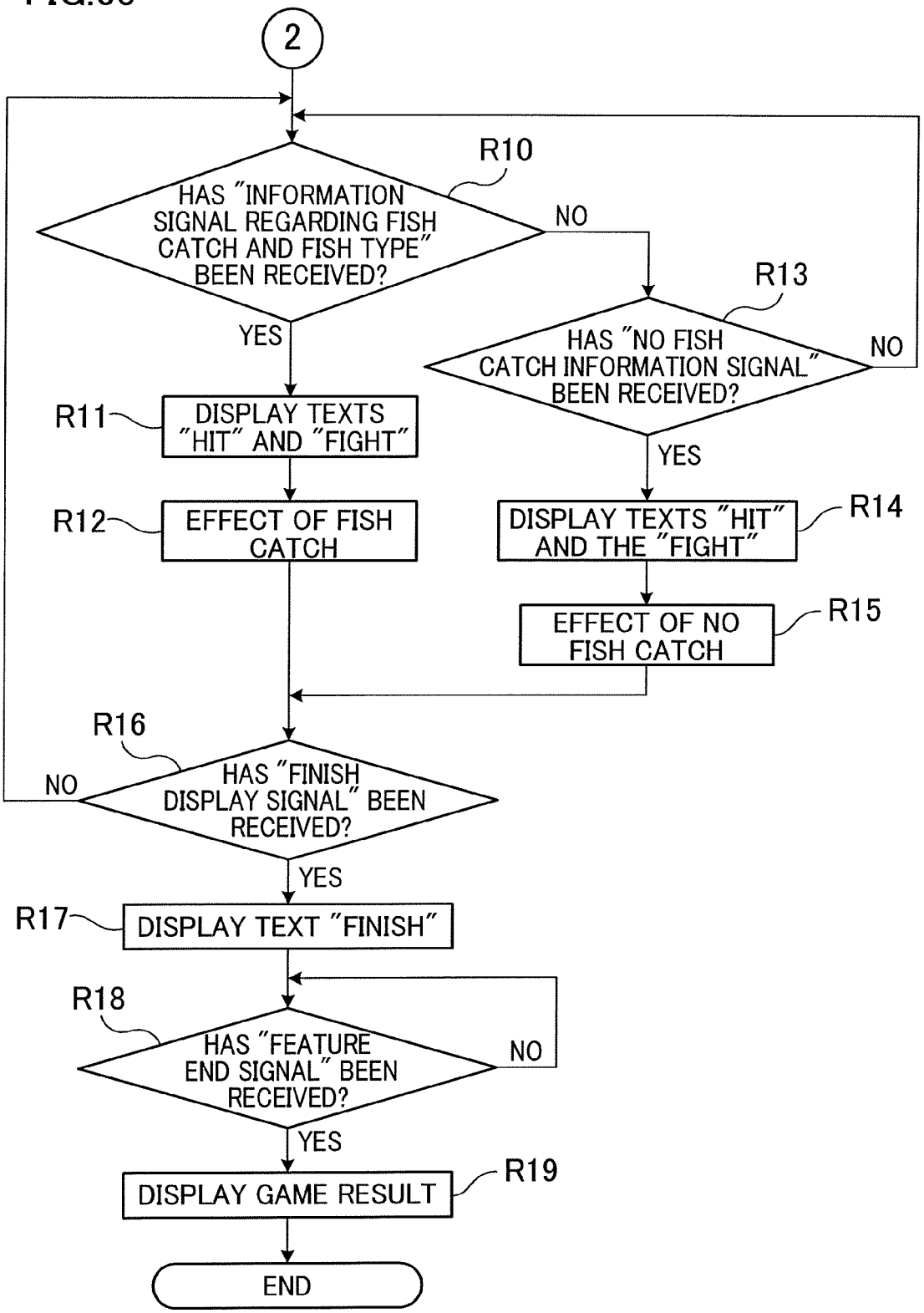
FIG. 65 is a flowchart of the media player process.

Thereafter, as shown in FIG. 65, the CPU of each of the media players 1021A, 1021B, and 1021C determines whether the "information signal regarding fish catch and fish type" has been received from the gaming terminal 1010 (R10). When the "information signal regarding fish catch and fish type" has been received (R10: YES), the texts "HIT" and "FIGHT" are displayed on the common display 1700 (R11). Thereafter, an effect image showing that fish is being caught is displayed on the common display 1700 (R12). Thereafter, an effect image indicating that the fishing rod is cast is displayed on the common display 1700.

On the other hand, when the "information signal regarding fish catch and fish type" has not been received (R10: NO), the CPU of each of the media players 1021A, 1021B, and 1021C determines whether the "no fish catch information signal" has been received from the gaming terminal 1010 (R13). When the "no fish catch information signal" has not been received (R13: NO), the routine returns to R10. On the other hand, when the "no fish catch information signal" has been received (R13: YES), the texts "HIT" and the "FIGHT" are displayed on the common display 1700 (R14). The time interval from the start of "HIT" to the end of "FIGHT" varies in accordance with the type of fish to be caught. Thereafter, an effect image showing that no fish is caught is displayed on the common display 1700 (R15). Thereafter, an effect image showing that the fishing rod is cast is displayed on the common display 1700.

After R12 or R15, the CPU of each of the media players 1021A, 1021B, and 1021C determines whether the "FINISH display signal" has been received from the gaming terminal 1010 (R16). When the "FINISH display signal" has not been received (R16: NO), the routine returns to R10.

On the other hand, when the "FINISH display signal" has been received (R16: YES), the text "FINISH" is displayed on the common display 1700 (R17).

Thereafter, the CPU of each of the media players 1021A, 1021B, and 1021C determines whether the "feature end signal" has been received from the gaming terminal 1010 (R18). When the "feature end signal" has not been received (R18: NO), the "feature end signal" is waited for.

On the other hand, when the "feature end signal" has been received (R18: YES), the game result of "SEA FISHING BONUS" is displayed on the common display 1700 (R19). This marks the end of the routine.

The gaming machine 1000 of Another Embodiment has been described above. In this gaming machine 1000, each gaming terminal 1010 and the jackpot controller 1340 are connected via the SEI 1013 so that two-way communications therebetween are possible, whereas each gaming terminal 1010 and the corresponding media players 1021A, 1021B, and 1021C are connected via the X-com board 1012 so that only one-way communications from the gaming terminals 1010 to the media players 1021A, 1021B, and 1021C are possible. As such, the media players 1021A, 1021B, and 1021C cannot send any information signals to each gaming terminal 1010.

Furthermore, according to the gaming machine 1000 above, by sending instruction signals to the media players 1021A, 1021B, and 1021C at a timing (predetermined timing) to start an effect such as displaying an image on the terminal image display panel 16 of the gaming terminal 1010, producing effect sound by the gaming terminal 1010, or generating vibrations by the movable unit 603 operating the fishing rod, it is possible to synchronize the image effects on the common displays 1700 performed by the media players 1021A, 1021B, and 1021C receiving the signals with the effect on the gaming terminal 1010 (e.g., images displayed on the terminal image display panel 16 of the gaming terminal 1010, effect sound generated by the gaming terminal 1010, vibrations of the movable unit 603 operating the fishing rod, or the like).

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A wagering machine that transitions from a first game in which no game qualification time is set to a third game in which the game qualification time is set and participation to the third game is allowed when the game qualification time is owned, the wagering machine comprising:

a display configured to display a game result;

a value-addition mechanism by which a player adds to the wagering machine currency or other gaming media;

a switch by means of which the player wagers an amount of gaming media;

an award payout mechanism by which currency or other gaming media is paid out to the player or credited to an available-betting-amount account of the player;

a memory configured to store the amount of gaming media that has been wagered;

a timer configured to count the game qualification time; and a controller programmed to execute, as a result of the player having wagered said amount of gaming media, the steps of:

storing in the memory the amount of gaming media that has been wagered;

after receiving the wager, starting the first game in which a plurality of symbols are rearranged on the display and awarding an award based on a combination of the rearranged symbols;

if in the first game a predetermined condition is satisfied, awarding a second game which is run independently from the first game;

in the second game, awarding a benefit based on a second game basic random determination table that defines a winning probability of the benefit;

awarding the game qualification time in accordance with the bet amount stored in the memory, adding the awarded game qualification time to the timer, and counting down the game qualification time stored in the timer;

if the game qualification time stored in the timer exceeds a predetermined upper limit, awarding a benefit in the second game based on a second game specific random determination table that defines a winning probability which is increased in accordance with a time exceeding the upper limit; and determining whether a condition to start the third game is established at predetermined intervals, running the third game if the condition to start the third game is established and the game qualification time is owned, and awarding an award based on an execution result of the third game.

2. A wagering machine that transitions from a first game run in a gaming terminal to a third game in which game qualification time is set and only a gaming terminal that owns the game qualification time is allowed to participate in the third game, the wagering machine comprising:

a plurality of gaming terminals each having a value-addition mechanism by which a player adds to the wagering machine currency or other gaming media, a switch by means of which the player wagers an amount of gaming media, a terminal display configured to display a game result, an award payout mechanism by which currency or other gaming media is paid out to the player or credited to an available-betting-amount account of the player, and a terminal controller programmed to execute steps (a1) to (a5);

a memory configured to store the amount of gaming media that has been wagered; a timer configured to count the game qualification time that is owned; and a center controller programmed to execute steps (b1) to (b6), the terminal controller executing the steps of:

(a1) transmitting to the center controller information of the amount of gaming media that has been wagered;

(a2) after receiving the wager, starting a first game in which a plurality of symbols are rearranged on the display, independently from other gaming terminals, and awarding an award based on a combination of the rearranged symbols;

(a3) when a predetermined condition is satisfied in the first game, awarding a second game that is run independently of the first game;

(a4) in the second game, awarding a benefit based on a second game basic random determination table defining a winning probability of a benefit; and (a5) if award information regarding the third game is received, awarding an award based on the award information, and the center controller executing the steps of:

(b1) storing the transmitted wager amount in the memory for each of the gaming terminals;

(b2) awarding the game qualification time in accordance with the wager amount stored in the memory and adding the awarded game qualification time to the timer;

(b3) counting down the game qualification time stored in the timer;

(b4) when the game qualification time stored in the timer exceeds a predetermined upper limit, in the next second game, awarding a benefit based on a second game specific random determination table that defines a winning probability which is increased in accordance with a time exceeding the upper limit;

(b5) determining whether a condition to start the third game is established at predetermined intervals, running the third game in which the gaming terminals having the game qualification time are synchronized, if the condition to start the third game is established, and determining an award and selecting which gaming terminal receives the award; and (b6) transmitting the award information to the selected gaming terminal.

3. A wagering machine that transitions from a first game run in a gaming terminal to a third game in which game qualification time is set and only a gaming terminal that owns the game qualification time is allowed to participate in the third game, the wagering machine comprising:

a plurality of gaming terminals each having a value-addition mechanism by which a player adds to the wagering machine currency or other gaming media, a switch by means of which the player wagers an amount of gaming media, a terminal display configured to display a game result, an award payout mechanism by which currency or other gaming media is paid out to the player or credited to an available-betting-amount account of the player, and a terminal controller programmed to execute steps (c1) to (c5);

a memory configured to store the amount of gaming media that has been wagered; a timer configured to count the game qualification time that is owned; and a center controller programmed to execute steps (d1) to (d6), the terminal controller executing the steps of:

(c1) transmitting to the center controller information of the amount of gaming media that has been wagered;

(c2) after receiving the wager, starting a first game in which a plurality of symbols are rearranged on the display, independently from other gaming terminals, and awarding an award based on a combination of the rearranged symbols;

(c3) when a predetermined condition is satisfied in the first game, awarding a second game that is run independently of the first game;

(c4) in the second game, awarding a benefit based on a second game basic random determination table defining a winning probability of a benefit; and (c5) if payout amount information regarding the third game is received, awarding an award based on the payout amount information, the center controller executing the steps of:

(d1) storing the transmitted wager amount in the memory for each of the gaming terminals;

(d2) determining the game qualification time to be awarded and a payout rate of each unit time of the game qualification time based on the bet amount stored in the memory, and adding the game qualification time of each payout rate to the timer in association with the payout rate, for each of the gaming terminals;

(d3) counting down the game qualification time which is associated with the highest payout rate of each of the gaming terminals;

(d4) when the game qualification time of each payout rate in the timer exceeds a predetermined upper limit associated with each payout rate, in the next second game, awarding a benefit based on a second game specific random determination table that defines a winning probability which is increased in accordance with a time exceeding the upper limit;

(d5) determining whether a condition to start the third game is established at predetermined intervals, running the third game in which the gaming terminals having the game qualification time are synchronized, and determining a unit payout amount and selecting which gaming terminal receives the unit payout amount based on an execution result of the third game; and (d6) sending, to the selected gaming terminal, the payout amount information calculated by multiplying, by the unit payout amount, the highest payout rate among the payout rates associated with the game qualification time of the selected gaming terminal.

4. The wagering machine according to claim 3, wherein, the winning probability defined in the second game specific random determination table is calculated by adding a value calculated by multiplying a time exceeding upper limit by a predetermined value to the winning probability defined in the second game basic random determination table.

5. A game control method of a wagering machine comprising a display, a value-addition mechanism, a switch, a payout mechanism, a memory, a timer, and a controller, the game control method comprising:

transitioning, via the controller, from a first, base game in which no game qualification time is set to a third game in which the game qualification time is set and participation to the third game is allowed when the game qualification time is owned, the third game being a common game that can be executed simultaneously by any machine in a group of machines that qualifies to participate in the third game by virtue of owning said qualification time;

displaying, via the display a game result;

adding, via the value-addition mechanism, to the wagering machine game value to be bet;

receiving, via the switch, a bet;

paying out, via the payout mechanism game value;

storing, via the memory, a bet amount;

counting, via the timer the game qualification time;

storing in the memory, via the controller, the bet amount received by means of the switch;

starting, via the controller, the first game after receiving the bet input by means of the switch;

displaying, via the controller, a first game result of the first game on the display;

awarding, via the controller, an award based on the first game result;

when the game result of the first game is a predetermined game result, transitioning, via the controller, to a second, local bonus game in which a winning probability is different from a winning probability in the first, base game;

in the second, local bonus game, awarding, via the controller, a benefit based on a second game basic random determination table that defines a winning probability of the benefit;

awarding, via the controller, the game qualification time in accordance with the bet amount stored in the memory;

adding, via the controller, the awarded game qualification time to the timer;

counting down, via the controller, the game qualification time stored in the timer;

awarding, via the controller, a benefit in the second, local bonus game, based on a second-game-specific random determination table that defines a winning probability which is increased in accordance with a time in excess of a predetermined upper limit, if the game qualification time stored in the timer exceeds the predetermined upper limit;

determining at predetermined intervals, via the controller, whether a condition to start the third game is established;

running, via the controller, the third game if the condition to start the third game is established and the game qualification time is owned; and awarding, via the controller, an award based on an execution result of the third game.

* * * * *